US010442618B2

(12) United States Patent
Briggs et al.

(10) Patent No.: US 10,442,618 B2
(45) Date of Patent: Oct. 15, 2019

(54) WASTE RECEPTACLE HAVING REPLACEABLE PANEL INSERTS

(71) Applicant: Rubbermaid Commercial Products LLC, Winchester, VA (US)

(72) Inventors: Bartholomew Nathaniel Briggs, Charlotte, NC (US); Allison Michelle Hammer, Chicago, IL (US); Michael A. Zarkis, Tega Cay, SC (US); Paul Watkins, Pfafftown, NC (US); Tyler Clas, Winchester, VA (US); Indira Biswas, Philadelphia, PA (US)

(73) Assignee: Rubbermaid Commercial Products LLC, Atlanta, GA (US)

( * ) Notice: Subject to any disclaimer, the term of this patent is extended or adjusted under 35 U.S.C. 154(b) by 263 days.

(21) Appl. No.: 15/494,486

(22) Filed: Apr. 22, 2017

(65) Prior Publication Data

US 2017/0305663 A1 Oct. 26, 2017

Related U.S. Application Data

(60) Provisional application No. 62/326,680, filed on Apr. 22, 2016.

(51) Int. Cl.

| | |
|---|---|
| ***B65F 1/08*** | (2006.01) |
| ***B65F 1/16*** | (2006.01) |
| ***B65F 1/02*** | (2006.01) |
| ***A24F 19/10*** | (2006.01) |

(52) U.S. Cl.

CPC ..... *B65F 1/08* (2013.01); *A24F 19/105* (2013.01); *B65F 1/02* (2013.01); *B65F 1/1607* (2013.01); *B65F 1/1646* (2013.01); *B65F 2210/104* (2013.01); *B65F 2250/11* (2013.01); *B65F 2250/114* (2013.01)

(58) Field of Classification Search

CPC ..... B65F 1/08; B65F 1/085; B65F 1/1484; A24F 19/08; A24F 19/10; A24F 21/00

See application file for complete search history.

(56) References Cited

U.S. PATENT DOCUMENTS

| | | | | |
|---|---|---|---|---|
| 2,973,879 A * | 3/1961 | Darst | ..... | A24F 19/06 131/235.1 |
| 5,014,985 A * | 5/1991 | Capps | ..... | A63B 47/04 15/21.2 |
| 2009/0218341 A1* | 9/2009 | Wu | ..... | B65F 1/06 220/4.28 |

* cited by examiner

*Primary Examiner* — Andrew T Kirsch
(74) *Attorney, Agent, or Firm* — Eversheds Sutherland (US) LLP

(57) ABSTRACT

A waste receptacle may include a frame, vertical arm supports, panel inserts, and fasteners. The frame may include vertical arms spaced apart from one another and window openings, each window opening defined between an adjacent pair of the vertical arms. The vertical arm supports may be spaced apart from one another, each vertical arm support fixedly secured to one of the vertical arms and defining a pair of channels between the vertical arm support and the one of the vertical arms. The panel inserts may be removably secured with respect to the frame, each panel insert removably received within two of the channels and partially exposed through one of the window openings. Each fastener may be configured to move between an engaged position preventing removal of one of the panel inserts from the respective channels and a disengaged position allowing removal of the one of the panel inserts from the respective channels.

20 Claims, 27 Drawing Sheets

WASTE RECEPTACLE HAVING REPLACEABLE PANEL INSERTS

CROSS-REFERENCE TO RELATED APPLICATIONS

The present application claims priority to and the benefit of U.S. Provisional Application No. 62/326,680, filed on Apr. 22, 2016, entitled "WASTE RECEPTACLE HAVING REPLACEABLE PANEL INSERTS," which is hereby incorporated herein by reference in its entirety.

FIELD OF THE DISCLOSURE

The present disclosure relates generally to waste receptacles and more particularly to a waste receptacle having replaceable panel inserts and a mechanism for securing the panel inserts with respect to a frame of the waste receptacle.

BACKGROUND

Various types of waste receptacles are known in the art for receiving and containing waste in different types of facilities or environments. Certain facilities may provide decorative waste receptacles having a design or style that suits the interior or exterior décor, the exterior landscaping, and/or the architectural construction of the facility. Examples of such facilities may include hotels, casinos, museums, airports, universities, hospitals, office buildings, and various luxury properties. When such facilities undertake renovations or significant changes in décor, the owner often may desire to change the design or style of the waste receptacles located throughout the facility such that the waste receptacles provide a coordinated appearance with respect to the renovations or décor changes being made. In order to meet this desire, the owner typically may purchase entirely new waste receptacles and dispose of the old waste receptacles. Of course, such practice may be very costly, particularly for facilities that have many waste receptacles and/or make décor changes on a relatively frequent basis.

Certain existing waste receptacles may include a frame and one or more replaceable panel inserts that are removably secured with respect to the frame. The panel inserts may be at least partially exposed along the outside of the waste receptacle and may have a decorative appearance. When the owner desires to change the design or style of the waste receptacles to suit décor changes to the facility or otherwise, the existing panel inserts may be replaced with new panel inserts having a different decorative appearance. In this manner, the owner may achieve significant cost savings by purchasing only the new panel inserts and maintaining the remaining portions of the waste receptacles. However, such waste receptacles may present certain problems. For example, retention features or mechanisms used to removably secure the panel inserts with respect to the frame may result in difficulties in maintaining engagement between the panel inserts and the frame or other components, which may cause the panel inserts to become dislodged over time. This problem may be particularly significant when the panel inserts are curved or otherwise contoured. Additionally, the retention features or mechanisms may become worn over time, for example due to multiple replacements of the panel inserts, which may necessitate replacement of such features or mechanisms. Furthermore, if dimensions of mating features of the panel inserts and the frame or other components are not kept within tight tolerance ranges, removal of existing panel inserts and insertion of new panel inserts may be challenging. Finally, the process of removing the existing panel inserts and inserting the new panel inserts may be cumbersome and time-consuming and may require several tools to complete.

BRIEF DESCRIPTION OF THE DRAWINGS

The detailed description is set forth with reference to the accompanying drawings. The use of the same reference numerals may indicate similar or identical items. Various embodiments may utilize elements and/or features other than those illustrated in the drawings, and some elements and/or features may not be present in various embodiments. Elements and/or features in the drawings are not necessarily drawn to scale. Throughout this disclosure, depending on the context, singular and plural terminology may be used interchangeably.

DETAILED DESCRIPTION OF EXAMPLE EMBODIMENTS

Overview

Figure 1A:
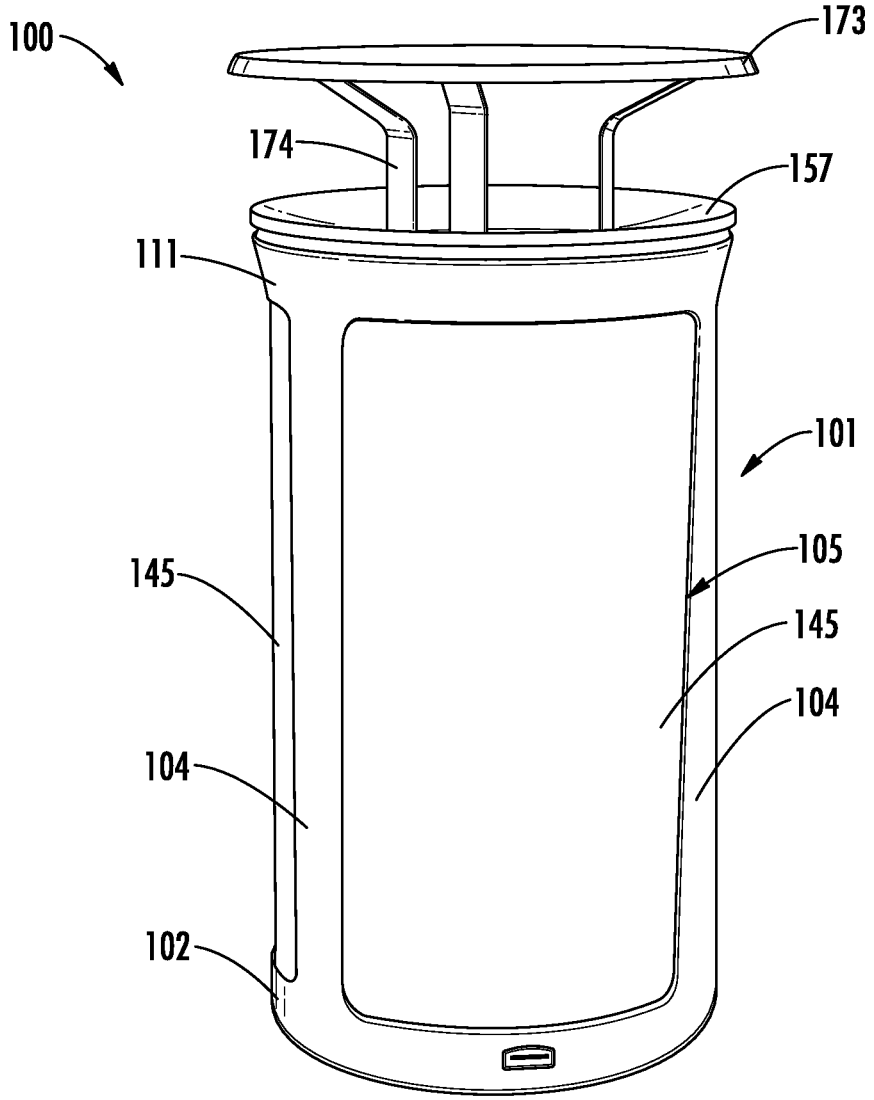
FIG. 1A is a perspective view of a waste receptacle in accordance with one or more example embodiments of the disclosure.

Described below are example embodiments of a waste receptacle as well as individual components and features of the waste receptacle. The waste receptacle may be used in various types of facilities or environments to receive and contain waste. As described below, the waste receptacle may include a frame and one or more replaceable panel inserts that are removably secured with respect to the frame by retention components and features. The panel inserts may be at least partially exposed along the outside of the waste receptacle and may have a decorative appearance that suits the interior or exterior décor, the exterior landscaping, and/or the architectural construction of the facility at which the waste receptacle is located. When desired, the panel inserts may be removed from the frame and replaced with new panel inserts having a different decorative appearance. In this manner, the owner of the waste receptacle may achieve significant cost savings by purchasing only the new panel inserts and maintaining the remaining portions of the waste receptacle.

As compared to certain existing waste receptacles that include a frame and one or more replaceable panel inserts, embodiments of the waste receptacle described herein may include retention components and features that securely maintain the panel inserts in a desired position with respect to the frame and prevent the panel inserts from becoming dislodged over time, may include retention components and features that resist wear and maintain their integrity even after multiple replacements of the panel inserts, may reduce the need to keep dimensions of mating features of the panel inserts, the frame, and other components of the waste receptacle within tight tolerance ranges, thereby easing manufacture of the waste receptacle and replacement of the panel inserts, and/or may allow the process of removing existing panel inserts and inserting new panel inserts to be completed easily and quickly with a single tool.

According to one aspect, a waste receptacle may include a frame, a number of vertical arm supports, a number of panel inserts, and a number of fasteners. The frame may include a number of vertical arms spaced apart from one another and a number of window openings, each window opening defined between an adjacent pair of the vertical arms. The vertical arm supports may be spaced apart from one another, each vertical arm support fixedly secured to one of the vertical arms and defining a pair of channels between the vertical arm support and the one of the vertical arms. The panel inserts may be removably secured with respect to the frame, each panel insert removably received within two of the channels and partially exposed through one of the window openings. The fasteners each may be configured to move between an engaged position preventing removal of one of the panel inserts from the respective channels and a disengaged position allowing removal of the one of the panel inserts from the respective channels.

In certain example embodiments, the frame, the vertical support arms, and the panel inserts may be formed of sheet metal. In certain example embodiments, the frame may further include a bottom ring and a top ring vertically spaced apart from the bottom ring, and the vertical arms may extend from the bottom ring to the top ring. In certain example embodiments, the frame may have a round shape. In certain example embodiments, the frame may have a pill shape with two flat sides and two curved sides. In certain example embodiments, the panel inserts each may have a curved shape corresponding to a shape of the frame. In certain example embodiments, one or more of the panel inserts may have a curved shape and one or more of the panel inserts may have a flat shape.

In certain example embodiments, each vertical arm support may include a base portion and a pair of wings extending from the base portion, the base portion may be fixedly secured to the one of the vertical arms, and the wings may be spaced apart from the one of the vertical arms to define the channels between the vertical arm support and the one of the vertical arms. In certain example embodiments, the fasteners may include screws. In certain example embodiments, the waste receptacle may further include a number of brackets, each bracket may be fixedly secured to one of the vertical arm supports, and the fasteners may be supported by the brackets.

According to another aspect, a waste receptacle may include a frame, a number of panel retainers, a panel insert, and a fastener. The frame may include a back wall, a pair of side walls, and a window opening defined between the side walls. The panel retainers may be spaced apart from one another, and each panel retainer may be fixedly secured to the back wall and may define a channel between the panel retainer and the frame. The panel insert may be removably secured with respect to the frame, and the panel insert may be removably received within two of the channels and partially exposed through the window opening. The fastener may be configured to move between an engaged position preventing removal of the panel insert from the channels and a disengaged position allowing removal of the panel insert from the channels.

In certain example embodiments, the frame, the panel retainers, and the panel inserts may be formed of sheet metal. In certain example embodiments, the frame may further include a bottom ring and a top ring vertically spaced apart from the bottom ring, and the back wall and the side walls may extend from the bottom ring to the top ring. In certain example embodiments, the frame may have a D-shape. In certain example embodiments, the panel insert may have a curved shape corresponding to a shape of the frame.

In certain example embodiments, each panel retainer may include a back portion and a wing, the back portion may be fixedly secured to the back wall, and the wing may be spaced apart from one of the side walls to define the channel between the panel retainer and the one of the side walls. In certain example embodiments, the number of panel retainers may include a pair of upper panel retainers positioned at or near a top of the frame, and a pair of lower panel retainers positioned at or near a bottom of the frame. In certain example embodiments, the fastener may include a screw. In certain example embodiments, the screw may engage a nut when the fastener is in the engaged position, and the screw may disengage the nut when the fastener is in the disengaged position. In certain example embodiments, the waste receptacle may further include a support arm positioned within the frame, and the fastener may be supported by the support arm.

According to another aspect, a waste receptacle may include a frame, a lid, a hood, and an ashtray body. The lid may be pivotably attached to the frame and configured to pivot between a closed position and an open position. The hood may be positioned above the lid and configured to move with the lid between the closed position and the open position. The ashtray body may be positioned at least partially above the hood and configured to move with the lid between the closed position and the open position. The ashtray body may include a number of openings defined therein and in communication with an interior space of the ashtray body. The number of openings may be contained within a circumferential sub-sector of the ashtray body that is less than half of a circumference of the ashtray body.

In certain example embodiments, the lid may be pivotally attached to the frame by a hinge positioned along a first side of the waste receptacle, and the circumferential sub-sector of the ashtray body may be positioned along a second side of the waste receptacle opposite the first side. In certain example embodiments, the waste receptacle also may include a number of ashtray support brackets and a number of rivets. The ashtray support brackets may be attached to the hood, and each rivet may be fixedly secured to one of the ashtray support brackets. The ashtray body may be removably attached to the hood by the ashtray support brackets and the rivets. In certain example embodiments, the ashtray body also may include a number of slots defined therein, and each slot may be configured to removably receive one of the rivets therein. In certain example embodiments, each slot may extend from an upper end of the ashtray body, and each slot may have a J-shape.

These and other example embodiments of the disclosure are described in more detail through reference to the accompanying drawings in the detailed description that follows. This brief overview, including section titles and corresponding summaries, is provided for the reader's convenience and is not intended to limit the scope of the claims or the preceding sections. Furthermore, the techniques described above and below may be implemented in a number of ways and in a number of contexts. Several example implementations and contexts are provided with reference to the accompanying drawings, as described below in more detail. However, the following implementations and contexts are but a few of many.

Certain components and features of the waste receptacle are described herein with reference to example embodiments illustrated in the drawings; however, such components and features are not limited to the example embodiments illustrated in the drawings.

Certain components and features of the waste receptacle are described herein using the terms "top," "bottom," "front," "back," or "side." It will be understood that these terms are used to describe a relative position of a component or feature of the waste receptacle when the waste receptacle is in a particular orientation, such as an orientation shown in the drawings. Certain relationships between components or features of the waste receptacle are described herein using the terms "above," "below," "in front of," or "behind." It will be understood that these terms are used to describe a relative relationship between two or more components or features of the waste receptacle when the waste receptacle is in a particular orientation, such as an orientation shown in the drawings.

Certain components and features of the waste receptacle are described herein using the terms "first," "second," "third," etc. These terms are used only to distinguish one component or feature from another identical or similar component or feature. For example, a "first" component or feature could be termed a "second" component or feature, and, similarly, a "second" component or feature could be termed a "first" component or feature, without departing from the scope of the disclosure. Additionally, as used herein the term "and/or" includes any and all combinations of one or more of the associated listed items.

Illustrative Embodiments

Figure 1C:
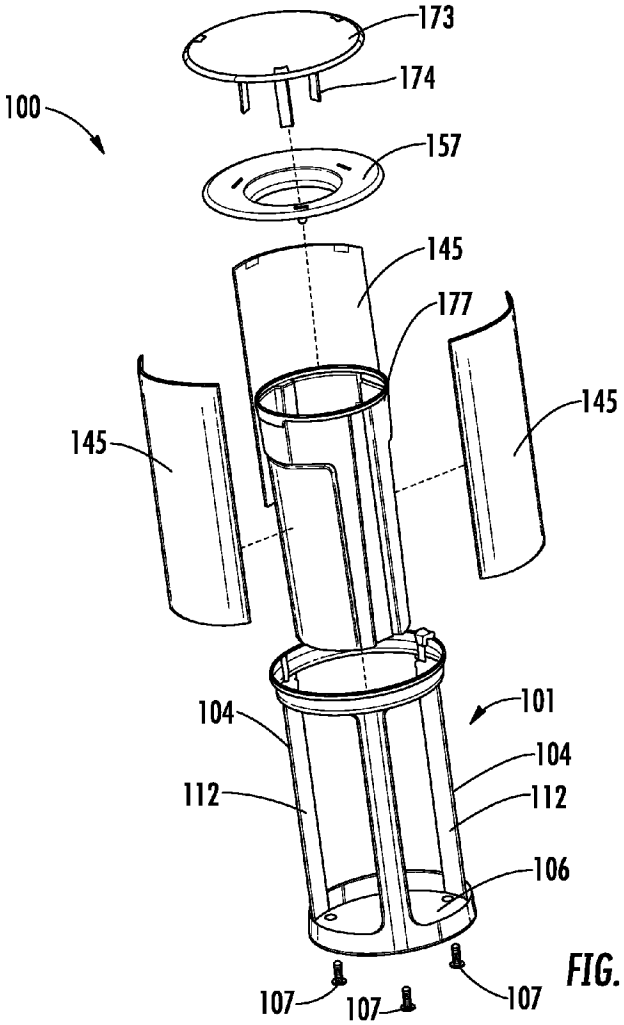
FIG. 1C is a partially exploded perspective view of the waste receptacle of FIG. 1A.
Figure 1B:
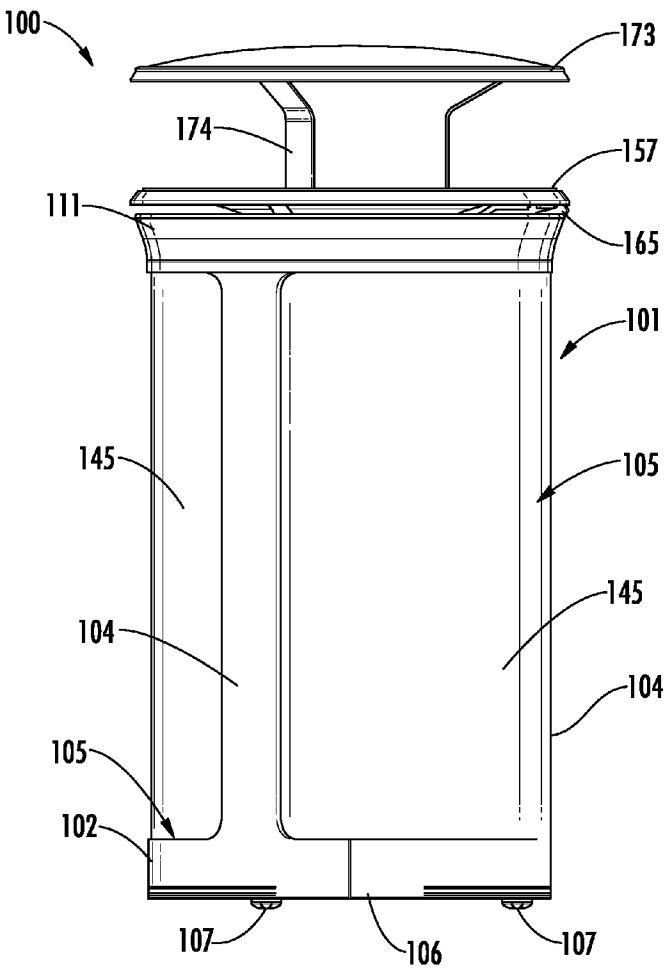
FIG. 1B is a side view of the waste receptacle of FIG. 1A.
Figure 1E:
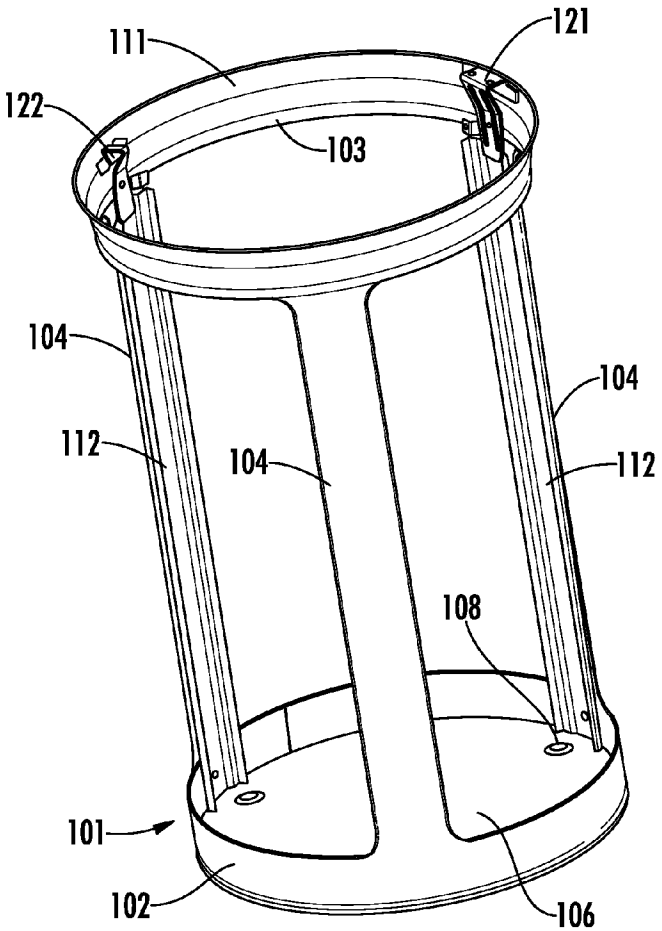
FIG. 1E is a perspective view of a portion of the waste receptacle of FIG. 1A.
Figure 1D:
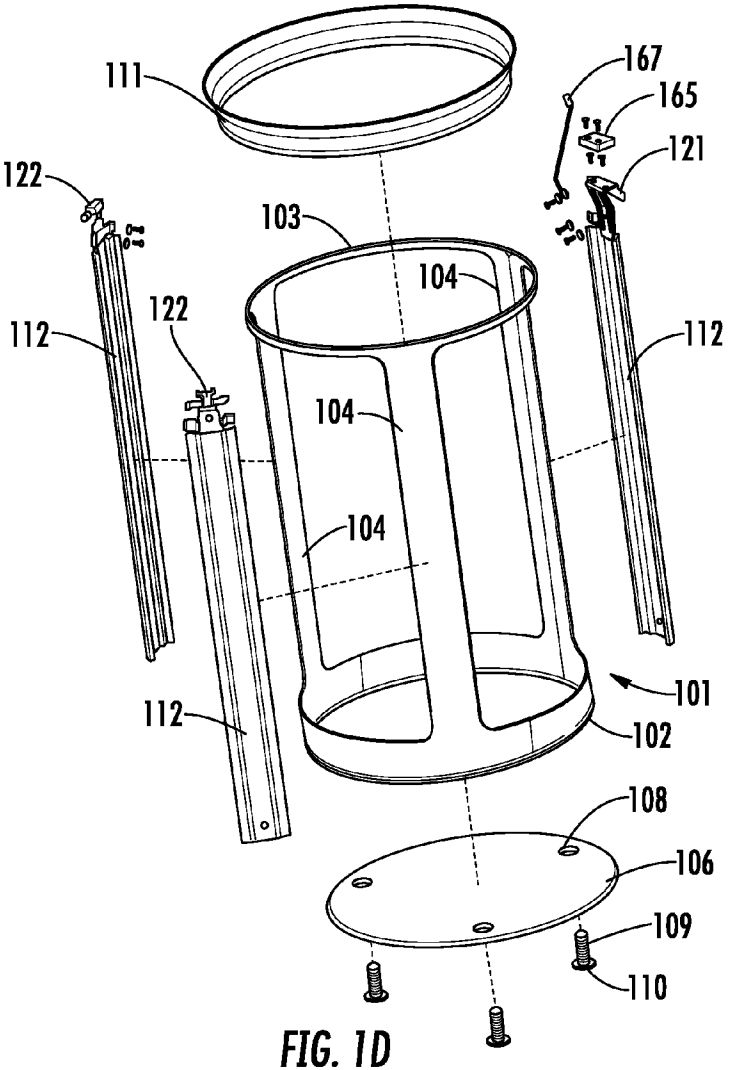
FIG. 1D is a partially exploded perspective view of a portion of the waste receptacle of FIG. 1A.
Figure 1H:
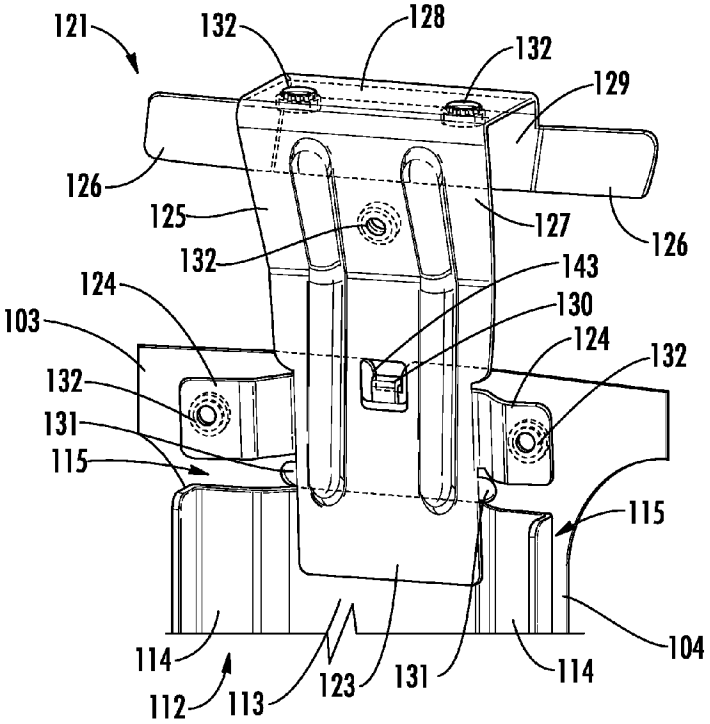
FIG. 1H is a detailed perspective view of a frame, an arm support, and the frame hinge bracket of the waste receptacle of FIG. 1A.
Figure 1F:
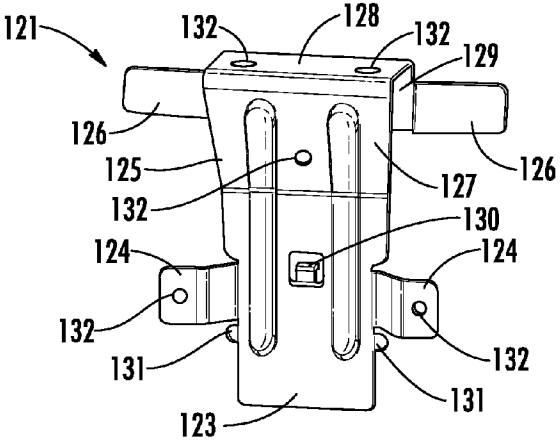
FIG. 1F is a detailed perspective view of a frame hinge bracket of the waste receptacle of FIG. 1A.
Figure 1G:
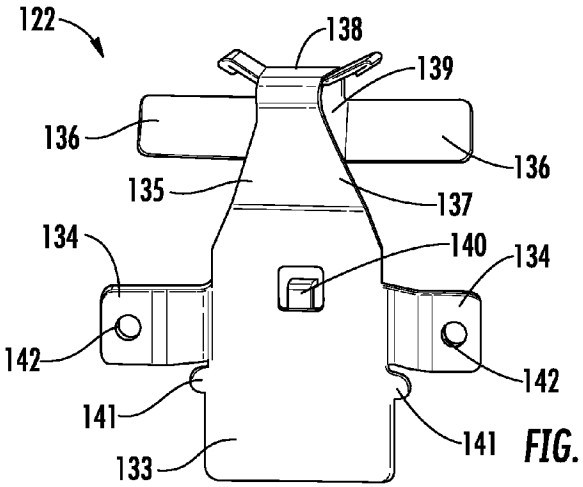
FIG. 1G is a detailed perspective view of a frame landing bracket of the waste receptacle of FIG. 1A.
Figure 1J:
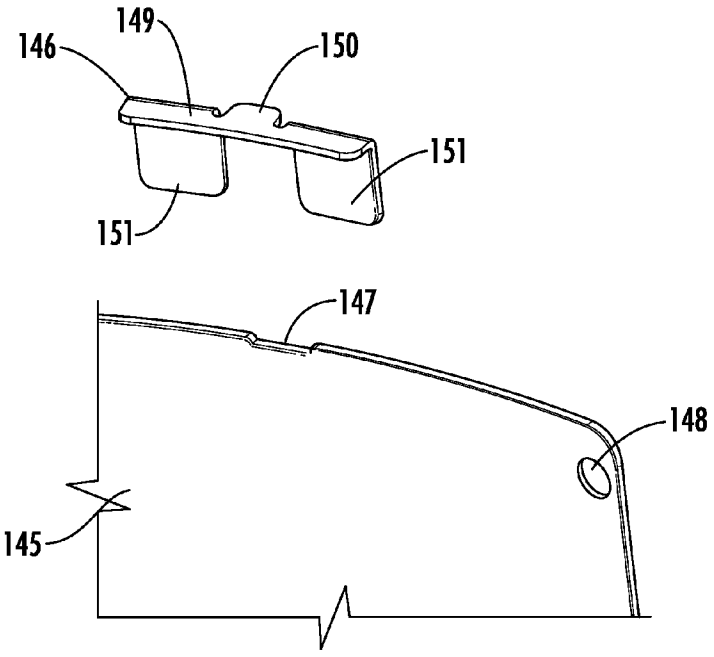
FIG. 1J is a detailed perspective view of the panel insert and one of the panel brackets of the waste receptacle of FIG. 1A.
Figure 1I:
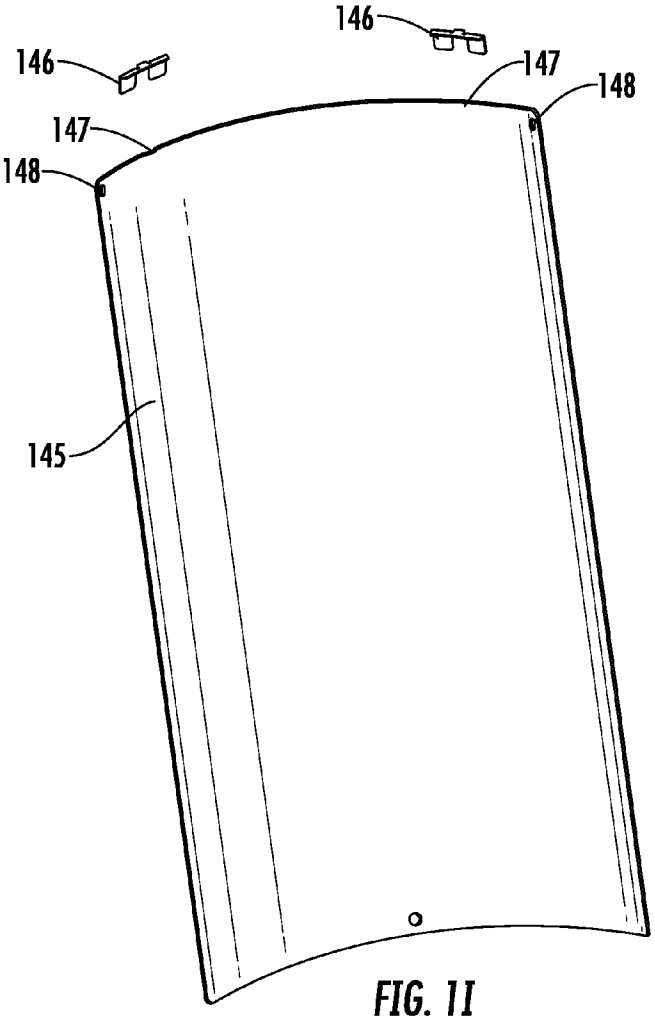
FIG. 1I is a perspective view of a panel insert and a pair of panel brackets of the waste receptacle of FIG. 1A.
Figure 1L:
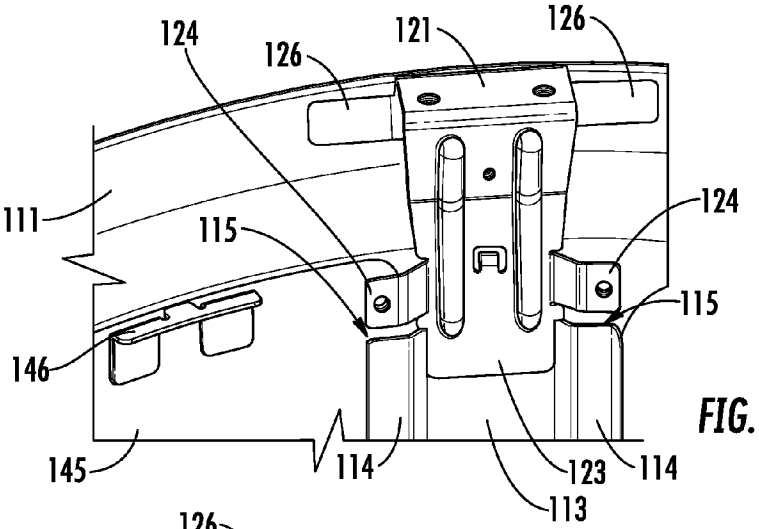
FIG. 1L is a detailed perspective view of a portion of the waste receptacle of FIG. 1A.
Figure 1M:
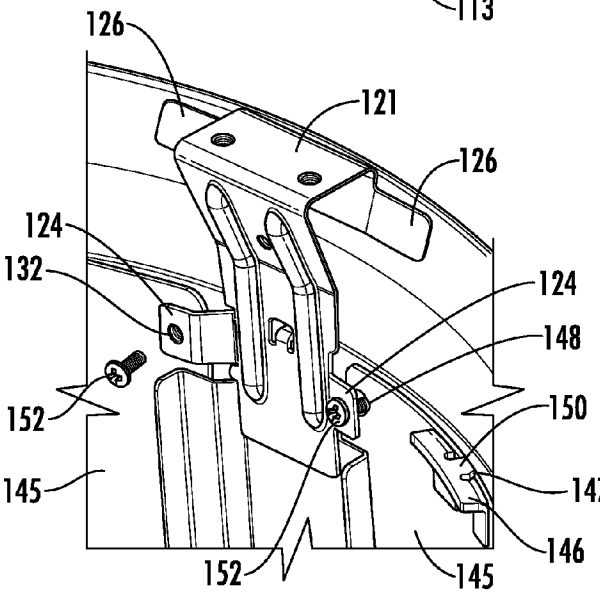
FIG. 1M is a detailed perspective view of a portion of the waste receptacle of FIG. 1A.
Figure 1K:
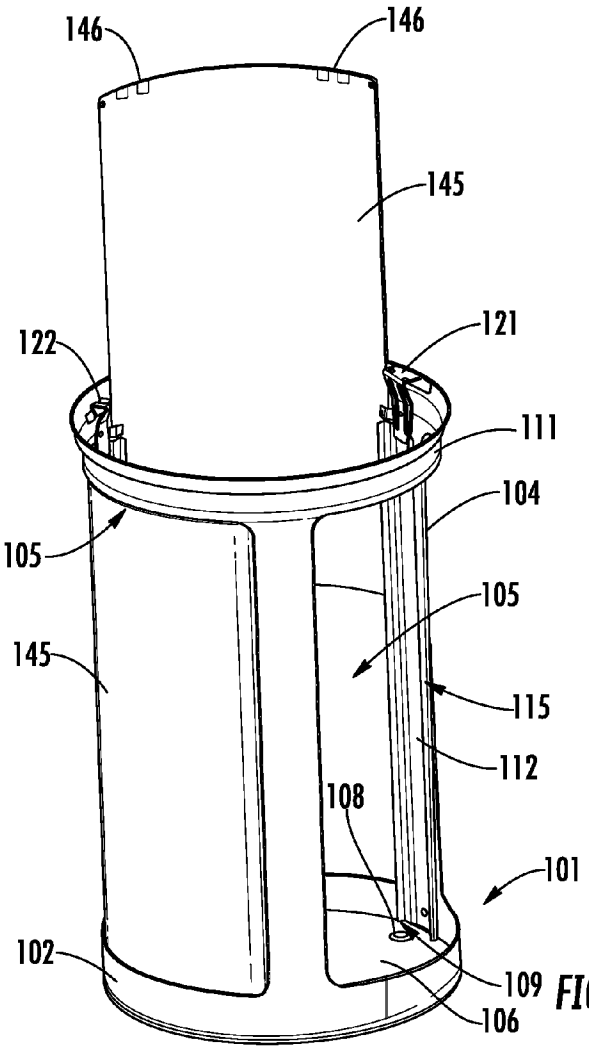
FIG. 1K is a perspective view of a portion of the waste receptacle of FIG. 1A.
Figure 1O:
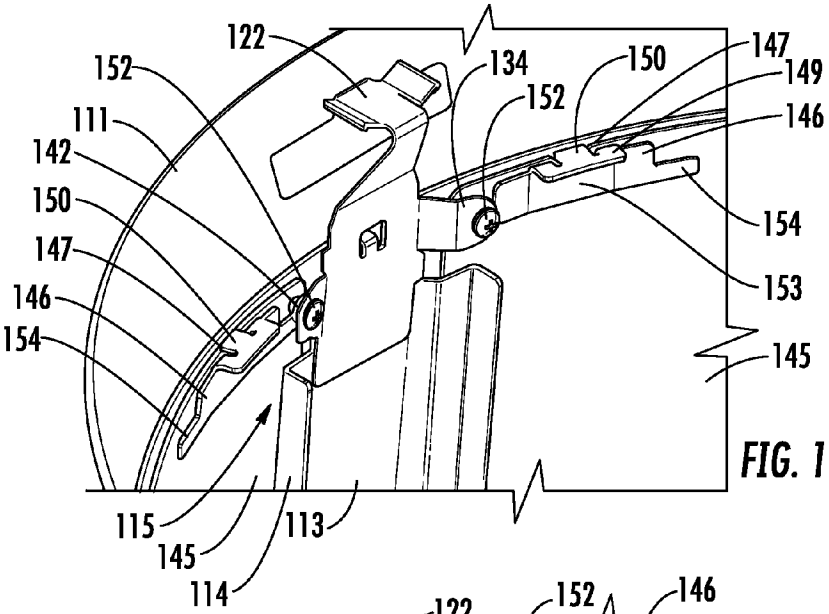
FIG. 1O is a detailed perspective view of a portion of the waste receptacle of FIG. 1A.
Figure 1P:
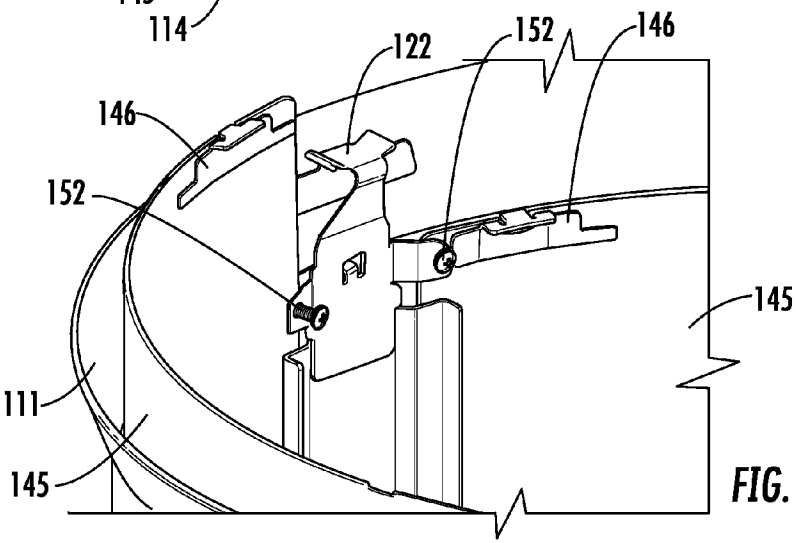
FIG. 1P is a detailed perspective view of a portion of the waste receptacle of FIG. 1A.
Figure 1N:
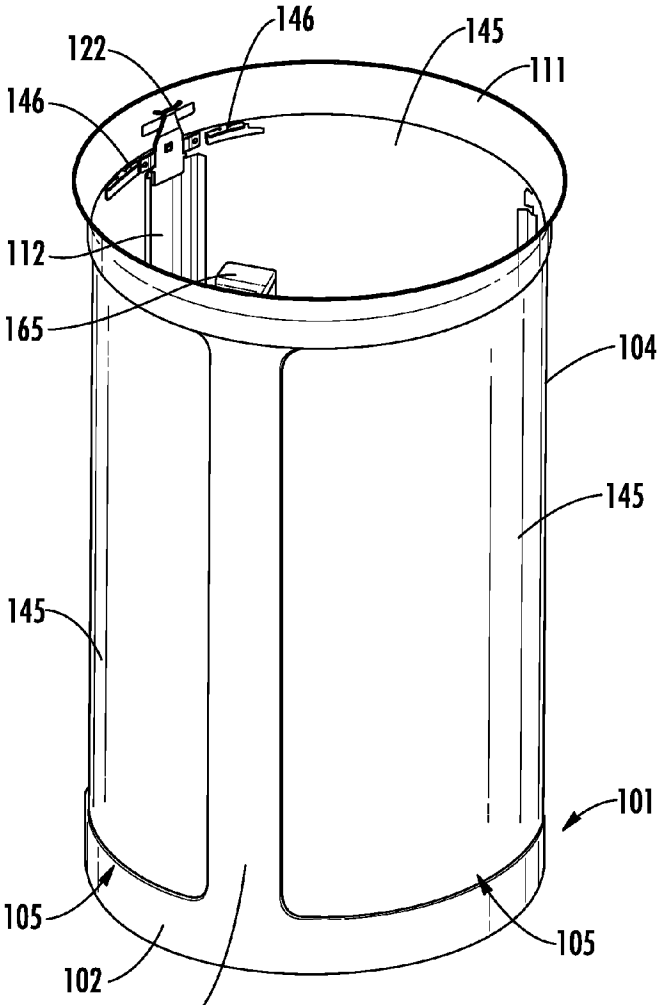
FIG. 1N is a perspective view of a portion of the waste receptacle of FIG. 1A.
Figure 1R:
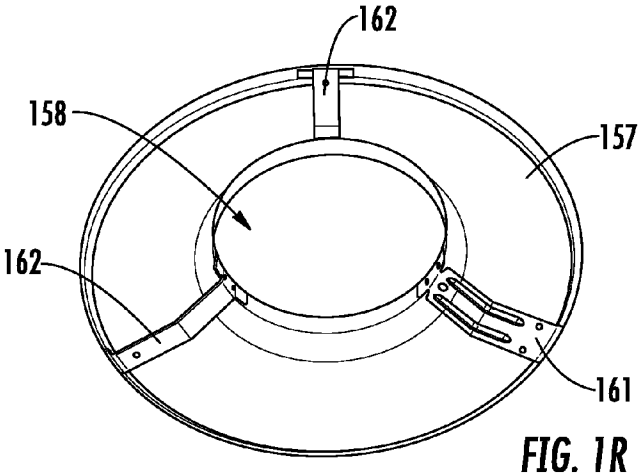
FIG. 1R is a perspective view of a portion of the waste receptacle of FIG. 1A.
Figure 1S:
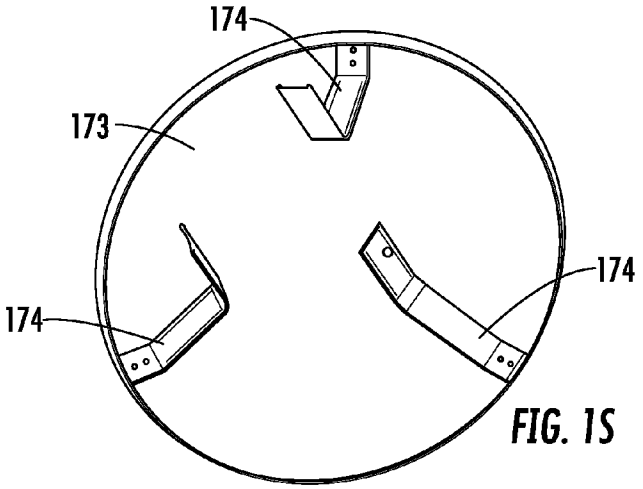
FIG. 1S is a perspective view of a portion of the waste receptacle of FIG. 1A.
Figure 1Q:
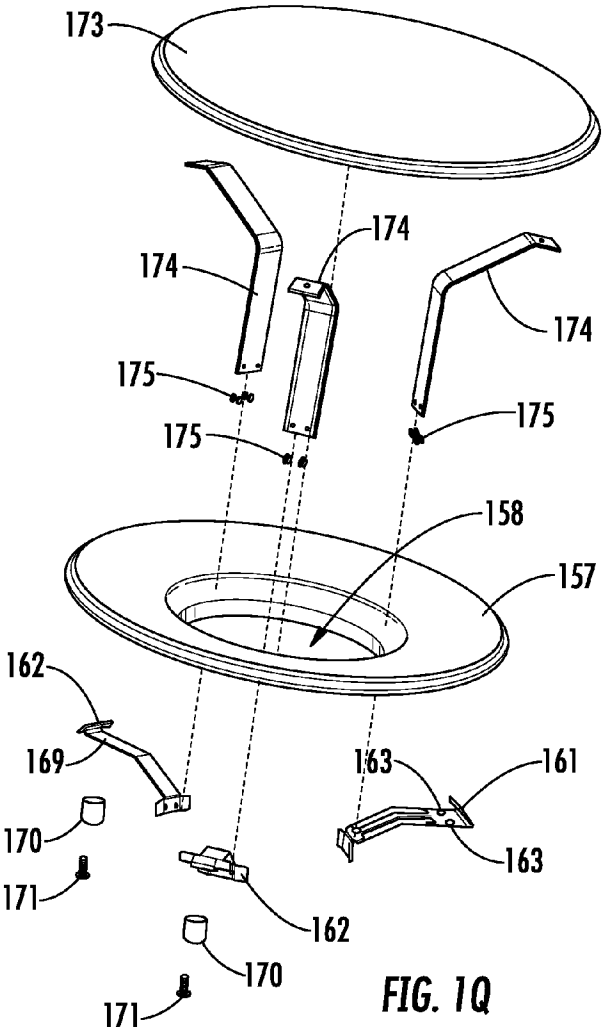
FIG. 1Q is an exploded perspective view of a portion of the waste receptacle of FIG. 1A.
Figure 1T:
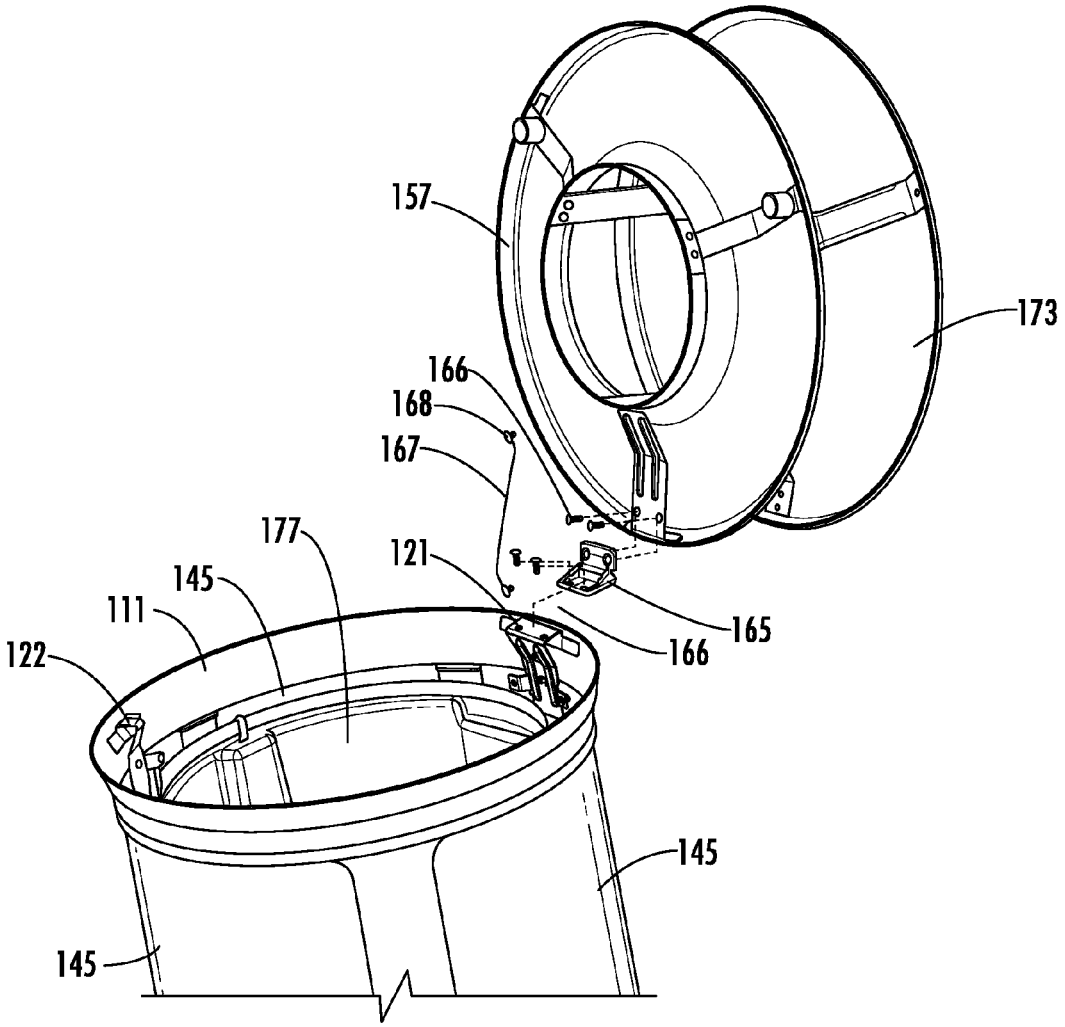
FIG. 1T is a partially exploded perspective view of a portion of the waste receptacle of FIG. 1A.
Figure 1V:
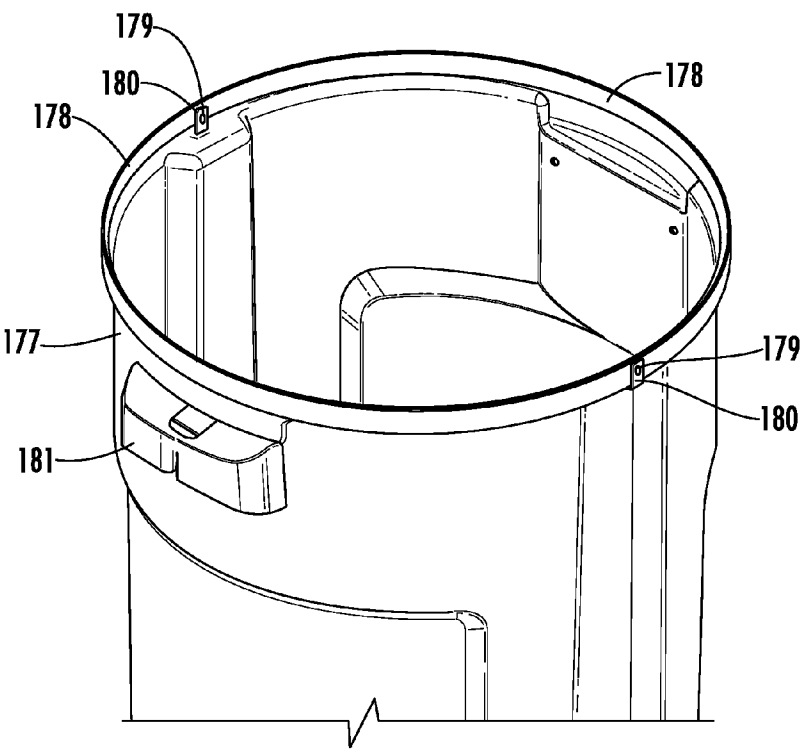
FIG. 1V is a detailed perspective view of the liner assembly of the waste receptacle of FIG. 1A.

FIGS. 1A-1V illustrate a waste receptacle 100 (which also may be referred to as a "refuse receptacle") as well as individual components and features of the waste receptacle 100 in accordance with one or more example embodiments of the disclosure. The waste receptacle 100 may be used in various types of facilities or environments to receive and contain waste. As described below, the waste receptacle 100 may include a frame and one or more replaceable panel inserts that are removably secured with respect to the frame by retention components and features. The panel inserts may be at least partially exposed along the outside of the waste receptacle 100 and may have a decorative appearance that suits the interior or exterior décor, the exterior landscaping, and/or the architectural construction of the facility at which the waste receptacle 100 is located. When desired, the panel inserts may be removed from the frame and replaced with new panel inserts having a different decorative appearance. In this manner, the owner of the waste receptacle 100 may achieve significant cost savings by purchasing only the new panel inserts and maintaining the remaining portions of the waste receptacle 100.

As compared to certain existing waste receptacles that include a frame and one or more replaceable panel inserts, embodiments of the waste receptacle 100 may include retention components and features that securely maintain the panel inserts in a desired position with respect to the frame and prevent the panel inserts from becoming dislodged over time, may include retention components and features that resist wear and maintain their integrity even after multiple replacements of the panel inserts, may reduce the need to keep dimensions of mating features of the panel inserts and other components of the waste receptacle 100 within tight tolerance ranges, thereby easing manufacture of the waste receptacle 100 and replacement of the panel inserts, and/or may allow the process of removing existing panel inserts and inserting new panel inserts to be completed easily and quickly with a single tool.

As shown in FIGS. 1A-1E, the waste receptacle 100 may include a frame 101 (which also may be referred to as an "outer frame") exposed along an outer surface of the waste receptacle 100 and providing a support structure for other components of the waste receptacle 100 to be mounted thereto. The frame 101 may include a bottom ring 102, a top ring 103, and a number of arms 104 (which also may be referred to as "vertical arms"). The bottom ring 102 and the top ring 103 may be vertically spaced apart from one another, and the arms 104 may extend vertically from the bottom ring 102 to the top ring 103. In certain example embodiments, as shown, the bottom ring 102 and the top ring 103 may have a circular shape, and the arms 104 each may have a curved shape that matches the curvature of the rings 102, 103. In other example embodiments, the bottom ring 102 and the top ring 103 may have other shapes, and the arms 104 each may have a shape that matches the shape of adjacent portions of the rings 102, 103.

The arms 104 may be spaced apart from one another along the respective circumferences of the rings 102, 103, such that a number of windows openings 105 are defined in the frame 101. In particular, each window opening 105 may be defined between an adjacent pair of the arms 104 and respective portions of the bottom ring 102 and the top ring 103. In certain example embodiments, as shown, the arms 104 may be positioned in a circumferential array and may be equally spaced apart from one another, such that the window openings 105 are equal in size. According to the illustrated embodiment, the frame 101 may include three arms 104 and three window openings 105. However, it will be appreciated that the frame 101 may include any number of arms 104 and any number of window openings 105 according to other example embodiments. In certain example embodiments, as shown, the bottom ring 102, the top ring 103, and the arms 104 of the frame 101 may be integrally formed with one another. For example, the frame 101 may be formed from sheet metal, such as 18 gauge steel. In particular, the sheet metal may be cut to size and to define the window openings 105, roll formed, and then seam welded to form the frame 101 including the bottom ring 102, the top ring 103, the arms 104, and the window openings 105. In other example embodiments, one or more of the bottom ring 102, the top ring 103, and the arms 104 may be separately formed and fixedly secured to one another, such as by welding, to form the frame 101.

As shown in FIGS. 1B-1E, the waste receptacle 100 may include a base 106 (which also may be referred to as a "base pan") attached to the frame 101 and positioned along the bottom of the waste receptacle 100, and a number of feet 107 attached to the base 106. The base 106 may have a shape that corresponds to the shape of the frame 101. For example, the base 106 may have a circular disc shape that corresponds to the circular shape of the bottom ring 102 of the frame 101, as shown, although other shapes of the base 106 may be used in other example embodiments. The base 106 may include a number of mounting holes 108 defined therein and configured to receive respective portions of the feet 107 therethrough. The mounting holes 108 may be spaced apart from one another and arranged in a circumferential array, as shown, although other arrangements of the mounting holes 108 may be used. As shown, the mounting holes 108 may include female threads configured to threadably engage the respective feet 107. In certain example embodiments, the base 106 may be formed from sheet metal, such as 20 gauge steel. In particular, the sheet metal may be cut to size and to define the threaded mounting holes 108, and then rolled into the bottom ring 102 of the frame 101 such that the base 106 is fixedly secured to the frame 101.

The feet 107 each may include a shaft 109 and a head 110 positioned at a bottom end of the shaft 109. The shaft 109 may include male threads configured to engage the female threads of the mounting holes 108, such that the feet 107 may be threadably attached to the base 106. As shown in FIG. 1B, the feet 107 may be attached to the base 106 such that the heads 110 of the feet 107 are positioned below the bottom of the frame 101. In this manner, the feet 107 may support the waste receptacle 100 on a support surface, such as a floor, while the bottom of the frame 101 remains vertically spaced apart from the support surface. If the support surface is not level, the feet 107 may be adjusted by threadably advancing or retracting the feet 107 relative to the base 106 such that the bottom of the frame 101 is level and the waste receptacle 100 is oriented in a vertical manner. In certain example embodiments, the feet 107 may be formed from a plastic, such as polyoxymethylene (POM), although other materials may be used. According to the illustrated embodiment, the waste receptacle 100 may include three feet 107 and the base 106 may include three mounting holes 108. However, it will be appreciated that the waste receptacle 100 may include any number of feet 107 and the base 106 may include any number of mounting holes 108 according to other example embodiments.

As shown in FIGS. 1A-1E, the waste receptacle 100 may include a crown 111 (which also may be referred to as a "rim") attached to the frame 101 and positioned near the top of the waste receptacle 100. The crown 111 may have a shape that corresponds to the shape of the frame 101. For example, the crown 111 may have a circular ring shape that corresponds to the circular shape of the top ring 103 of the frame 101, as shown, although other shapes of the crown 111 may be used in other example embodiments. A top portion of the crown 111 may be flared radially outward, as shown, such that the crown 111 extends radially outward beyond the frame 101. In certain example embodiments, the crown 111 may be formed from sheet metal, such as 18 gauge steel. In particular, the sheet metal may be cut to size and hydroformed to create the flared ring shape of the crown 111. As shown, the crown 111 may be positioned over the top ring 103 of the frame 101 such that a bottom portion of the crown 111 overlaps at least a portion of the top ring 103, and the crown 111 may be spot welded to the top ring 103 such that the crown 111 is fixedly secured to the frame 101.

As shown in FIGS. 1C-1E, the waste receptacle 100 may include a number of arm supports 112 (which also may be referred to as "vertical arm supports") attached to the frame 101 and positioned along an inner surface of the frame 101. In particular, each arm support 112 may be positioned along an inner surface of one of the arms 104 and attached thereto. The arm supports 112 each may have an elongated shape and may extend vertically along the respective arm 104 and from the base 106 toward the top ring 103. As shown, each arm support 112 may include a base portion 113 (which also may be referred to as a "central portion") and a pair of wings 114 extending from the base portion 113. The base portion 113 and the wings 114 each may extend vertically from a bottom end to a top end of the arm support 112. As shown, the wings 114 may be positioned along opposite lateral sides of the base portion 113 and may be offset from the base portion 113. The base portion 113 may abut and be attached to the respective arm 104, and the wings 114 each may be spaced apart from the respective arm 104. In this manner, each of the wings 114 may define a channel 115 between the arm support 112 and the respective arm 104. Each channel 115 may be configured to receive a portion of a panel insert, as described below. In certain example embodiments, the arm supports 112 may be formed from sheet metal, such as 18 gauge steel. In particular, the sheet metal may be cut to size and then bent to form the base portion 113 and the wings 114 of the arm support 112. The base portion 113 may be centered along a width of the respective arm 104 and spot welded to the respective arm 104 such that the arm support 112 is fixedly secured to the frame 101.

As shown in FIGS. 1D-1H, the waste receptacle 100 may include a number of brackets attached to the arm supports 112 and positioned along inner surfaces of the frame 101 and the crown 111. In particular, the waste receptacle 100 may include a frame hinge bracket 121 (which also may be referred to simply as a "hinge bracket") attached to one of the arm supports 112, and a pair of frame landing brackets 122 (which also may be referred to simply as "landing brackets") attached, respectively, to the other two arm supports 112. As shown in FIG. 1F, the frame hinge bracket 121 may include a base portion 123 (which also may be referred to as a "base central portion"), a pair of lower wings 124 extending from the base portion 123, a top portion 125 (which also may be referred to as a "top central portion"), and a pair of upper wings 126 extending from the top portion 125. The lower wings 124 may be positioned along opposite lateral sides of the base portion 123 and may be offset from the base portion 123, as shown. The top portion 125 may include an inner wall 127, a top wall 128, and an outer wall 129. The upper wings 126 may be positioned along opposite lateral sides of the outer wall 129 of the top portion 125, as shown. The frame hinge bracket 121 also may include an alignment tab 130 and a pair of abutment tabs 131 extending from the base portion 123. As shown, the alignment tab 130 may be centered along the width of the base portion 123 and may extend outward from the base portion 123. The abutment tabs 131 may be positioned along opposite lateral sides of the base portion 123 and below the lower wings 124. In certain example embodiments, the frame hinge bracket 121 may be formed from sheet metal, such as 18 gauge steel. In particular, the sheet metal may be cut to size and to define the apertures therein, and then bent to form the base portion 123, the lower wings 124, the top portion 125, the upper wings 126, and the alignment tab 130 of the frame hinge bracket 121.

The frame hinge bracket 121 may have a number of nuts 132 attached thereto. In particular, a first pair of nuts 132 may be respectively positioned and attached within apertures defined in the lower wings 124, a second pair of nuts 132 may be respectively positioned and attached within apertures defined in the top wall 128 of the top portion 125, and another nut 132 may be positioned and attached within an aperture defined in the inner wall 127 of the top portion 125. In certain example embodiments, the nuts 132 may be PEM® nuts, although other types of nuts suitable for attachment to sheet metal may be used in other example embodiments.

The frame hinge bracket 121 may be attached to the respective arm support 112, the frame 101, and the crown 111 as shown in FIGS. 1D, 1E, and 1H. In particular, the frame hinge bracket 121 may be centered with respect to the arm support 112 and positioned such that the base portion 123 of the frame hinge bracket 121 overlaps a portion of the base portion 113 of the arm support 112 and the abutment tabs 131 of the frame hinge bracket 121 abut the top end of the arm support 112. The frame hinge bracket 121 may be spot welded to the arm support 112 such that these components are fixedly secured to one another. After the frame hinge bracket 121 and the arm support 112 are secured to one another, the arm support 112 may be positioned along the inner surface of the respective arm 104 of the frame 101 such that the bottom end of the arm support 112 abuts the base 106, and the alignment tab 130 may be positioned within one of a number of alignment notches 143 defined in the top edge of the top ring 103 of the frame 101, as shown. The arm support 112 then may be spot welded to the arm 104 of the frame 101, as described above, and the frame hinge bracket 121 may be spot welded to the crown 111. In particular, the outer wall 129 of the top portion 125 and/or the upper wings 124 may be spot welded to the inner surface of the crown 111. In this manner, the frame hinge bracket 121, the arm support 112, the crown 111, and the frame 101 may be fixedly secured to one another.

As shown in FIG. 1G, the frame landing bracket 122 may include a base portion 133 (which also may be referred to as a "base central portion"), a pair of lower wings 134 extending from the base portion 133, a top portion 135 (which also may be referred to as a "top central portion"), and a pair of upper wings 136 extending from the top portion 135. The lower wings 134 may be positioned along opposite lateral sides of the base portion 133 and may be offset from the base portion 133, as shown. The top portion 135 may include an inner wall 137, a top wall 138, and an outer wall 139. The upper wings 136 may be positioned along opposite lateral sides of the outer wall 139 of the top portion 135, as shown. The frame landing bracket 122 also may include an alignment tab 140 and a pair of abutment tabs 141 extending from the base portion 133. As shown, the alignment tab 140 may be centered along the width of the base portion 133 and may extend outward from the base portion 133. The abutment tabs 141 may be positioned along opposite lateral sides of the base portion 133 and below the lower wings 134. In certain example embodiments, the frame landing bracket 122 may be formed from sheet metal, such as 18 gauge steel. In particular, the sheet metal may be cut to size and to define the apertures therein, and then bent to form the base portion 133, the lower wings 134, the top portion 135, the upper wings 136, and the alignment tab 140 of the frame hinge bracket 121.

The frame landing bracket 122 may have a number of nuts 142 attached thereto. In particular, a first pair of nuts 142 may be respectively positioned and attached within apertures defined in the lower wings 134. In certain example embodiments, the nuts 142 may be PEM® nuts, although other types of nuts suitable for attachment to sheet metal may be used in other example embodiments.

The frame landing bracket 122 may be attached to the respective arm support 112, the frame 101, and the crown 111 in a manner similar to the frame hinge bracket 121, as shown in FIGS. 1D and 1E. In particular, the frame landing bracket 122 may be centered with respect to the arm support 112 and positioned such that the base portion 133 of the frame landing bracket 122 overlaps a portion of the base portion 113 of the arm support 112 and the abutment tabs 141 of the frame landing bracket 122 abut the top end of the arm support 112. The frame landing bracket 122 may be spot welded to the arm support 112 such that these components are fixedly secured to one another. After the frame landing bracket 122 and the arm support 112 are secured to one another, the arm support 112 may be positioned along the inner surface of the respective arm 104 of the frame 101 such that the bottom end of the arm support 112 abuts the base 106, and the alignment tab 140 may be positioned within one of the alignment notches 143 defined in the top edge of the top ring 103 of the frame 101, as shown. The arm support 112 then may be spot welded to the arm 104 of the frame 101, as described above, and the frame landing bracket 122 may be spot welded to the crown 111. In particular, the outer wall 139 of the top portion 135 and/or the upper wings 134 may be spot welded to the inner surface of the crown 111. In this manner, the frame landing bracket 122, the arm support 112, the crown 111, and the frame 101 may be fixedly secured to one another.

As shown in FIGS. 1A-1C, the waste receptacle 100 may include a number of panel inserts 145 (which also may be referred to simply as "panels") removably secured with respect to the frame 101. According to the illustrated embodiment, the waste receptacle 100 may include three panel inserts 145. However, it will be appreciated that the waste receptacle 100 may include any number of panel inserts 145 according to other example embodiments. FIGS. 1I-1M illustrate an example panel insert 145 and a number of panel brackets 146 in accordance with one or more embodiments of the disclosure, which may be used as a part of the waste receptacle 100. As shown, the panel insert 145 may be formed as a substantially rectangular sheet having a curved or arcuate shape that corresponds to the curvature of the frame 101. The panel insert 145 may include a pair of alignment notches 147 defined in the top edge of the panel insert 145. As shown, one of the alignment notches 147 may be positioned near but spaced apart from one of the top corners of the panel insert 145, and the other alignment notch 147 may be positioned near but spaced apart from the other top corner of the pane insert 145. The panel insert 145 also may include a pair of mounting holes 148 defined therein and extending from the inner surface to the outer surface of the panel insert 145. As shown, one of the mounting holes 148 may be positioned near but spaced apart from one of the top corners of the panel insert 145, and the other mounting hole 148 may be positioned near but spaced apart from the other top corner of the panel insert 145. In certain example embodiments, the panel insert 145 may be formed from sheet metal, such as 18 gauge steel. In particular, the sheet metal may be cut to size and to define the alignment notches 147 and the mounting holes 148 therein, and then roll formed to form the panel insert 145 having the curved or arcuate shape. The panel insert 145 may have a decorative appearance, which may include one or more coatings, finishes, color treatments, textures, hole patterns, or other decorative features. In certain example embodiments, the panel insert 145 may be formed from a plastic or a plastic blend.

The panel brackets 146 (which also may be referred to as "lift brackets") may be attached to the panel insert 145 along the inner surface and the top edge of the panel insert 145 and may be used to facilitate insertion and removal of the panel insert 145. As shown, each panel bracket 146 may include a lift tab 149, an alignment tab 150, and a pair of mounting tabs 151. The lift tab 149 may extend inward from the panel insert 145 and may be configured to be grasped by a user to facilitate insertion and removal of the panel insert 145. The alignment tab 150 may extend in an opposite direction from the lift tab 149 and may be positioned within one of the alignment notches 147 of the panel insert 145 to facilitate alignment of the panel bracket 146 with respect to the panel insert 145. The mounting tabs 151 may extend transverse to and downward from the lift tab 149 and may abut the inner surface of the panel insert 145. The mounting tabs 151 may be spot welded to the inner surface of the panel insert 145 such that the panel bracket 146 is fixedly secured to the panel insert 145. In certain example embodiments, the panel brackets 146 may be formed from sheet metal, such as 18 gauge steel. In particular, the sheet metal may be cut to size and then bent to form the lift tab 149, the alignment tab 150, and the mounting tabs 151 of the panel bracket 146. According to the illustrated embodiment, two panel brackets 146 may be attached to each panel insert 145. However, it will be appreciated that any number of panel brackets 146 may be attached to each panel insert 145 according to other example embodiments.

FIGS. 1K-1M illustrate how the panel inserts 145 may be removably secured with respect to the frame 101 of the waste receptacle 100. As shown, each panel insert 145 may be removably received within two of the channels 115 defined between the arm supports 112 and the respective arms 104 of the frame 101. In particular, one of the lateral edges of the panel insert 145 may be received within one of the channels 115 defined between one of the arm supports 112 and the respective arm 104, and the other lateral edge of the panel insert 145 may be received within one of the channels 115 defined between an adjacent arm support 112 and the respective arm 104, as shown. As described above, the panel brackets 146 may be used to facilitate positioning of the panel insert 145 for insertion of the panel insert 145 into the channels 115 or removal of the panel insert 145 from the channels 115. As shown, when the panel insert 145 is received within the channels 115, the panel insert 145 may be partially exposed through the window opening 105 defined between the respective arms 104 of the frame 101.

As shown in FIG. 1M, the waste receptacle 100 may include a number of fasteners 152 configured to control vertical movement of the panel inserts 145 with respect to the frame 101. In particular, each fastener 152 may be configured to move between an engaged position preventing removal (i.e., upward vertical movement) of one of the panel inserts 145 from the respective channels 115 and a disengaged position allowing removal of the panel insert 145 from the respective channels 115. In certain example embodiments, as shown, the fasteners 152 may be screws, although other types of fasteners may be used in other example embodiments. As shown, each fastener 152 may be threadably engaged with one of the nuts 132 of the lower wings 124 of the frame hinge bracket 121 or one of the nuts 142 of the lower wings 134 of the frame landing bracket 122. When the fastener 152 is in the engaged position, the fastener 152 may extend through the respective nut 132, 142 and through one of the mounting holes 148 of one of the panel inserts 145, thereby preventing the panel insert 145 from being removed from the respective channels 115 and the frame 101. When the fastener 152 is in the disengaged position, the fastener 152 may extend through the respective nut 132, 142 but be removed from the mounting hole 148 of the panel insert 145, thereby allowing the panel insert 145 to be removed from the respective channels 115 and the frame 101.

FIGS. 1N-1P illustrate another example panel insert 145 and a number of panel brackets 146 in accordance with one or more embodiments of the disclosure, which may be used as a part of the waste receptacle 100. As shown, the panel insert 145 may be formed as a substantially rectangular sheet having a curved or arcuate shape that corresponds to the curvature of the frame 101. The panel insert 145 may include a pair of alignment notches 147 defined in the top edge of the panel insert 145. As shown, one of the alignment notches 147 may be positioned near but spaced apart from one of the top corners of the panel insert 145, and the other alignment notch 147 may be positioned near but spaced apart from the other top corner of the pane insert 145. In certain example embodiments, the panel insert 145 may be formed from sheet metal, such as 18 gauge steel. In particular, the sheet metal may be cut to size and to define the alignment notches 147 therein, and then roll formed to form the panel insert 145 having the curved or arcuate shape. The panel insert 145 may have a decorative appearance, which may include one or more coatings, finishes, color treatments, textures, hole patterns, or other decorative features.

The panel brackets 146 (which also may be referred to as "lift brackets") may be attached to the panel insert 145 along the inner surface and the top edge of the panel insert 145 and may be used to facilitate insertion and removal of the panel insert 145. As shown, each panel bracket 146 may include a lift tab 149, an alignment tab 150, a mounting portion 153, and a pair of retention tabs 154. The lift tab 149 may extend inward from the panel insert 145 and may be configured to be grasped by a user to facilitate insertion and removal of the panel insert 145. The alignment tab 150 may extend in an opposite direction from the lift tab 149 and may be positioned within one of the alignment notches 147 of the panel insert 145 to facilitate alignment of the panel bracket 146 with respect to the panel insert 145. The mounting portion 153 may extend transverse to and downward from the lift tab 149 and may abut the inner surface of the panel insert 145. The retention tabs 154 may be positioned along opposite lateral sides of the mounting portion 153 and may abut the inner surface of the panel insert 145. The mounting portion 153 and/or the retention tabs 154 may be spot welded to the inner surface of the panel insert 145 such that the panel bracket 146 is fixedly secured to the panel insert 145. In certain example embodiments, the panel brackets 146 may be formed from sheet metal, such as 18 gauge steel. In particular, the sheet metal may be cut to size and then bent to form the lift tab 149, the alignment tab 150, the mounting portion 153, and the retention tabs 154 of the panel bracket 146. According to the illustrated embodiment, two panel brackets 146 may be attached to each panel insert 145. However, it will be appreciated that any number of panel brackets 146 may be attached to each panel insert 145 according to other example embodiments.

FIGS. 1O and 1P illustrate how the panel inserts 145 may be removably secured with respect to the frame 101 of the waste receptacle 100. As shown, each panel insert 145 may be removably received within two of the channels 115 defined between the arm supports 112 and the respective arms 104 of the frame 101. In particular, one of the lateral edges of the panel insert 145 may be received within one of the channels 115 defined between one of the arm supports 112 and the respective arm 104, and the other lateral edge of the panel insert 145 may be received within one of the channels 115 defined between an adjacent arm support 112 and the respective arm 104, as shown. As described above, the panel brackets 146 may be used to facilitate positioning of the panel insert 145 for insertion of the panel insert 145 into the channels 115 or removal of the panel insert 145 from the channels 115. As shown, when the panel insert 145 is received within the channels 115, the panel insert 145 may be partially exposed through the window opening 105 defined between the respective arms 104 of the frame 101.

As shown in FIGS. 1O and 1P, the waste receptacle 100 may include a number of fasteners 152 configured to control vertical movement of the panel inserts 145 with respect to the frame 101. In particular, each fastener 152 may be configured to move between an engaged position, as shown in FIG. 1O, preventing removal (i.e., upward vertical movement) of one of the panel inserts 145 from the respective channels 115 and a disengaged position, as shown in FIG. 1P, allowing removal of the panel insert 145 from the respective channels 115. In certain example embodiments, as shown, the fasteners 152 may be screws, although other types of fasteners may be used in other example embodiments. As shown, each fastener 152 may be threadably engaged with one of the nuts 132 of the lower wings 124 of the frame hinge bracket 121 or one of the nuts 142 of the lower wings 134 of the frame landing bracket 122. When the fastener 152 is in the engaged position, the fastener 152 may extend through the respective nut 132, 142, and an end portion of the fastener 152 may contact one of the panel inserts 145 and be positioned above one of the retention tabs 154 of one of the panel brackets 146 attached to the panel insert 145. In this manner, the fastener 152 may prevent the panel insert 145 from being removed from the respective channels 115 and the frame 101. When the fastener 152 is in the disengaged position, the fastener 152 may extend through the respective nut 132, 142 but be removed from contact with the panel insert 145 and no longer positioned over the retention tab 154. In this manner, the fastener 152 may allow the panel insert 145 to be removed from the respective channels 115 and the frame 101.

As shown in FIGS. 1A-1C, 1Q, 1R, and 1T, the waste receptacle 100 may include a lid 157 (which also may be referred to as a "cover") movably secured with respect to the frame 101. In particular, the lid 157 may be configured to pivot with respect to the frame 101 between a closed position, as shown in FIG. 1B, and an open position, as shown in FIG. 1T. The lid 157 may have a shape that corresponds to the shape of the crown 111 and the frame 101. For example, the lid 157 may have a circular disk shape that corresponds to the circular shapes of the crown 111 and the top ring 103 of the frame 101, as shown, although other shapes may be used in other example embodiments. As shown, the lid 157 may include a central opening 158 defined therein and configured to allow waste to passed therethrough and into the waste receptacle 100. As shown, the lid 157 may be flared radially inward toward the central opening 158 to guide waste toward the central opening 158. In certain example embodiments, the lid 157 may be formed from sheet metal, such as 18 gauge steel. In particular, the sheet metal may be cut to size and to form the central opening 158, and then hydroformed to create the flared shape and contour of the lid 157.

As shown in FIGS. 1Q, 1R, and 1T, the waste receptacle 100 may include a number of brackets attached to the lid 157 and positioned along inner surfaces of the lid 157. In particular, the waste receptacle 100 may include a lid hinge bracket 161 (which also may be referred to simply as a "hinge bracket") attached to inner surfaces of the lid 157, and a pair of lid landing brackets 162 (which also may be referred to simply as "landing brackets") attached to inner surfaces of the lid 157. The lid hinge bracket 161 and the lid landing brackets 162 may be arranged as shown in FIG. 1R and spot welded to the inner surfaces of the lid 157. In certain example embodiments, the lid hinge bracket 161 and the lid landing brackets 162 may be formed from sheet metal, such as 18 gauge steel. In particular, the sheet metal may be cut to size and to define the apertures therein, and then bent to form the lid hinge bracket 161 and the lid landing brackets 162.

The lid hinge bracket 161 may have a number of nuts 163 attached thereto. In particular, a first pair of nuts 163 may be respectively positioned and attached within apertures defined in the lid hinge bracket 161 near an outer end of the lid hinge bracket 161, and another nut 163 may be positioned and attached within an aperture defined in the lid hinge bracket 161 near an inner end of the lid hinge bracket 161. In certain example embodiments, the nuts 163 may be PEM® nuts, although other types of nuts suitable for attachment to sheet metal may be used in other example embodiments. As shown in FIG. 1T, the lid 157 may be pivotally secured with respect to the frame 101 by a hinge 165. In particular, the hinge 165 may be attached to the lid hinge bracket 161 and the frame hinge bracket 121 by a number of fasteners 166 threadably engaging the respective nuts 132, 163, such that the lid 157 is pivotally secured with respect to the frame 101. As shown in FIG. 1T, a lid tether 167 may be attached to the lid hinge bracket 161 and the frame hinge bracket 121 by a number of fasteners 168 threadably engaging the respective nuts 132, 163, such that the open position of the lid 157 is restrained by the lid tether 167.

The lid landing brackets 162 each may have a number of nuts 169 attached thereto. In particular, a first nut 169 may be positioned and attached within an aperture defined in the lid landing bracket 162 near an outer end of the lid landing bracket 162. In certain example embodiments, the nuts 169 may be PEM® nuts, although other types of nuts suitable for attachment to sheet metal may be used in other example embodiments. Each lid landing bracket 162 also may have a bumper 170 attached thereto along a bottom surface of the lid landing bracket 162. In particular, the bumper 170 may be attached to the lid landing bracket 162 by a fastener 171 extending through the bumper 170 and threadably engaging the first nut 169. When the lid 157 is in the closed position, the bumpers 170 may rest, respectively, on the top portions 125 of the frame landing brackets 122 such that the lid 157 is vertically spaced apart from the crown 111, as shown in FIG. 1B. In certain example embodiments, the bumpers 170 may be formed of rubber, although other suitable materials may be used in other example embodiments.

As shown in FIGS. 1A-1C, 1Q, 1S, and 1T, the waste receptacle 100 may include a hood 173 (which also may be referred to as a "rain hood") fixedly secured with respect to the lid 157. In particular, the hood 173 may be positioned over the lid 157 and attached thereto. The hood 173 may have a shape that corresponds to the shape of the lid 157, the crown 111, and the frame 101. For example, the hood 173 may have a circular disk shape that corresponds to the circular shapes of the lid 157, the crown 111, and the top ring 103 of the frame 101, as shown, although other shapes may be used in other example embodiments. As shown, the hood 173 may be curved or domed to deter users from placing objects, such as waste, on top of the hood 173. In certain example embodiments, the hood 173 may be formed from sheet metal, such as 18 gauge steel. In particular, the sheet metal may be cut to size and then hydroformed to create the shape and contour of the hood 173.

As shown in FIGS. 1Q, 1S, and 1T, the waste receptacle 100 may include a number of brackets attached to the hood 173 and positioned along an inner surface of the hood 173. In particular, the waste receptacle 100 may include a number of hood support brackets 174 (which also may be referred to simply as a "support brackets") attached to the inner surface of the hood 173 and extending downward therefrom. The hood support brackets 174 may be arranged as shown in FIG. 1S and spot welded to the inner surface of the hood 173. In certain example embodiments, the hood support brackets 174 may be formed from sheet metal, such as 18 gauge steel. In particular, the sheet metal may be cut to size and to define the apertures therein, and then bent to form the hood support brackets 174. As shown, the hood support brackets 174 may be attached to the lid 157 by a number of fasteners 175, such that the hood 173 is fixedly secured to the lid 157. In certain example embodiments, the fasteners 175 may be rivets, as shown, although other types of fasteners may be used in other example embodiments.

Figure 1U:
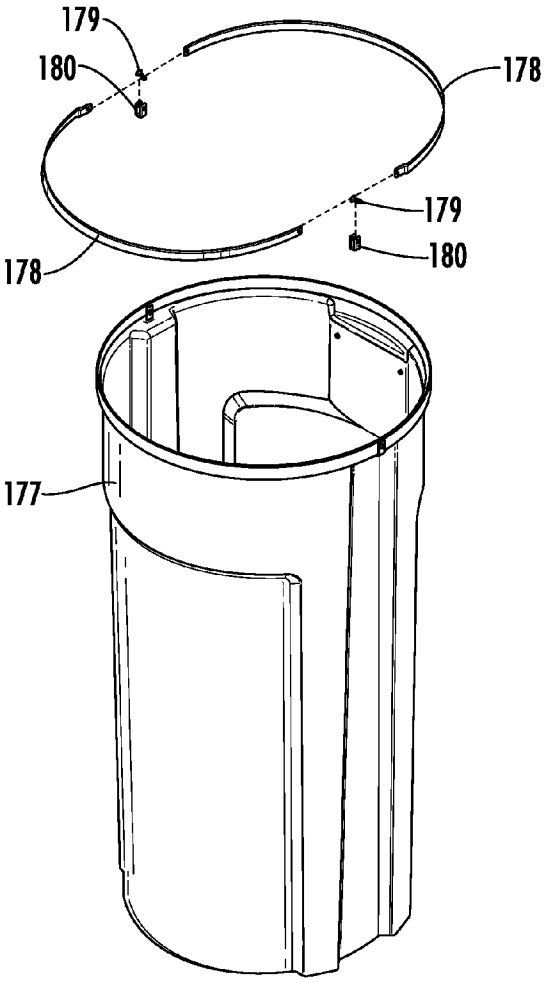
FIG. 1U is an exploded perspective view of a liner assembly of the waste receptacle of FIG. 1A.

As shown in FIGS. 1C, 1U, and 1V, the waste receptacle 100 may include a liner 177 removably positioned within the frame 101. The liner 177 may be shaped and contoured to correspond to the shape of the frame 101. In certain example embodiments, the liner 177 may be formed of a plastic, such as polyethylene, although other suitable materials may be used in other example embodiments. In certain example embodiments, the liner 177 may be formed of a plastic or a plastic blend via a rotomolding process. For example, the liner 177 may be formed of a low density polyethylene (LDPE) via a rotomolding process. As shown, the liner 177 may have a pair of bales 178 pivotally attached thereto near the top end of the liner 177 and configured to retain a liner bag within the liner 177. In particular, the bales 178 may be pivotally attached to the liner 177 by a pair of fasteners 179 and a pair of bale brackets 180, as shown in FIGS. 1U and 1V. In certain example embodiments, the bale brackets 180 may be omitted, and the bales 178 may be pivotally attached directly to the liner 177 by the fasteners 179. The liner 177 also may include a pair of liner handles 181 attached thereto, such as by one or more fasteners. As shown, the liner handles 181 may be positioned along outer surfaces of the liner 177 near the top end of the liner 177. In this manner, the liner handles 181 may be grasped by a user to facilitate removal of the liner 177 from the frame 101.

FIGS. 1W-1Z illustrate an ashtray subassembly which may be used as a part of the waste receptacle 100 in certain example embodiments. The ashtray subassembly may include an ashtray hood 182 (which also may be referred to as an "ashtray rain hood"), a number of ashtray support brackets 183 (which also may be referred to simply as a "support brackets"), an ashtray body 184 (which also may be referred to simply as a "body"), and an ashtray base 185 (which also may be referred to simply as a "base"). The ashtray hood 182 may be fixedly secured with respect to the hood 173. In particular, the ashtray hood 182 may be positioned over the hood 173 and attached thereto. The ashtray hood 182 may have a circular disk shape that corresponds to the circular shape of the hood 173, as shown, although other shapes may be used in other example embodiments. As shown, the ashtray hood 182 may be curved or domed to deter users from placing objects, such as waste, on top of the ashtray hood 182. In certain example embodiments, the ashtray hood 182 may be formed from sheet metal, such as 18 gauge steel. In particular, the sheet metal may be cut to size and then hydroformed to create the shape and contour of the ashtray hood 182.

Figure 1X:
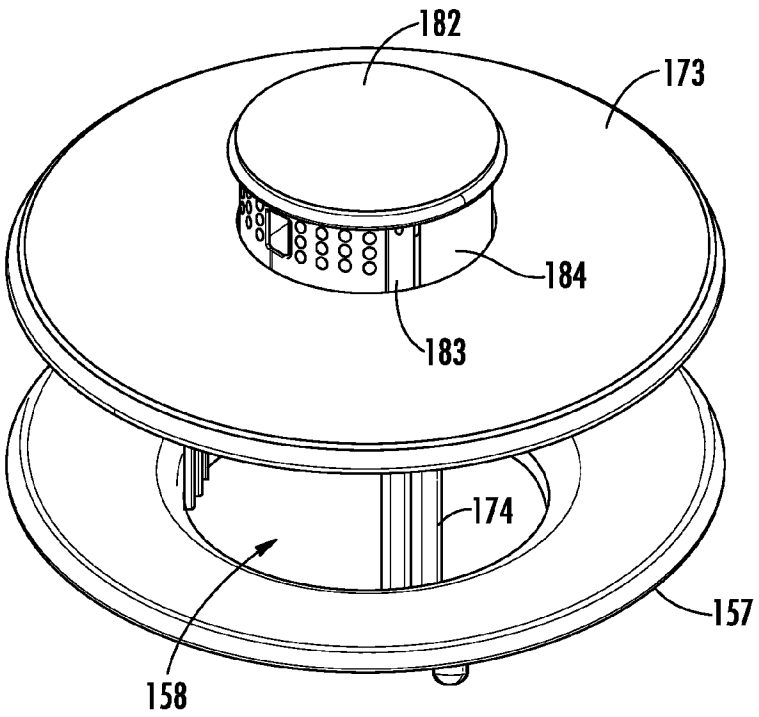
FIG. 1X is a perspective view of a portion of the waste receptacle of FIG. 1A.
Figure 1W:
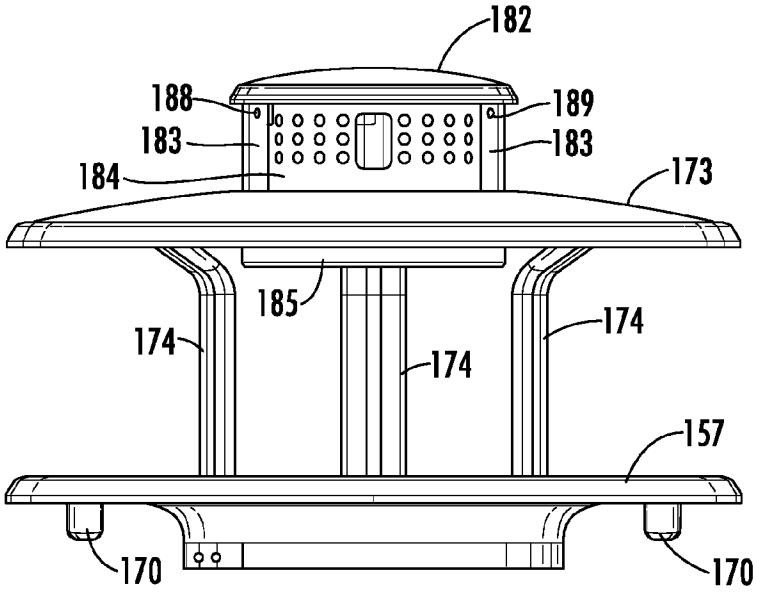
FIG. 1W is a front view of a portion of the waste receptacle of FIG. 1A.
Figure 1Z:
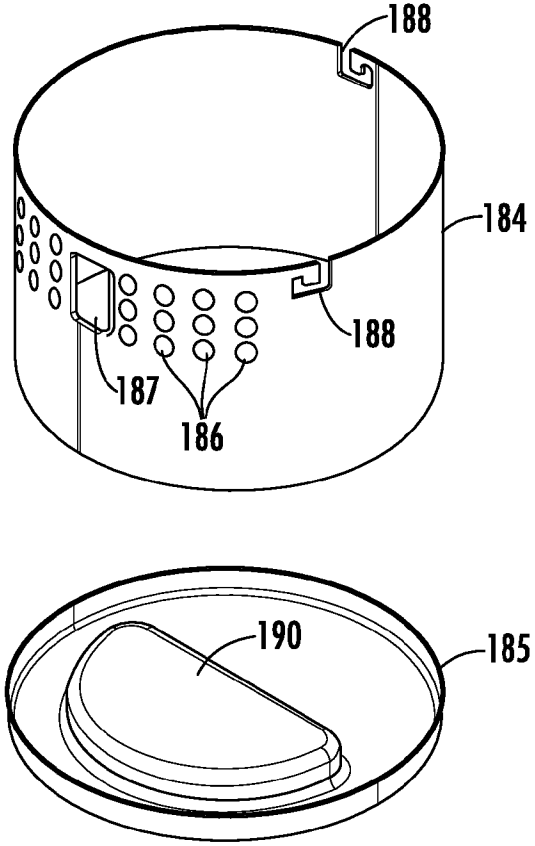
FIG. 1Z is an exploded perspective view of an ashtray body and an ashtray base of the waste receptacle of FIG. 1A.
Figure 1Y:
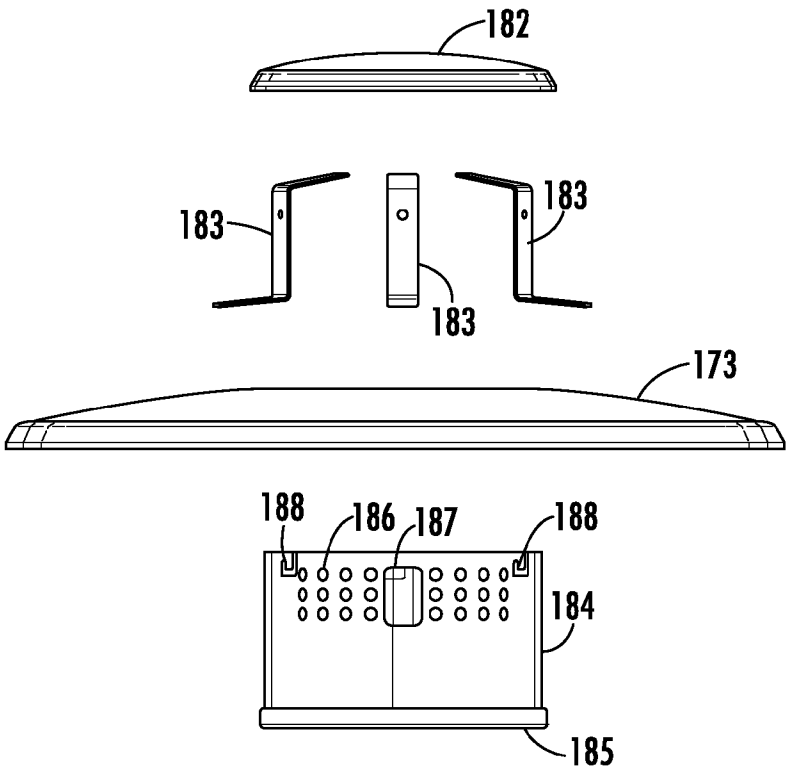
FIG. 1Y is an exploded front view of a portion of the waste receptacle of FIG. 1A.

The ashtray hood 182 may be attached to the hood 173 by the ashtray support brackets 183. As shown, the ashtray support brackets 183 may be attached to the inner surface of the ashtray hood 182 and may extend downward therefrom. The ashtray support brackets 183 may be arranged as shown in FIGS. 1W-1Y and spot welded to the inner surface of the ashtray hood 182 and to the inner surface of the hood 173, such that the ashtray hood 182 and the hood 173 are maintained in a spaced apart relationship and fixedly secured to one another. In other embodiments, alternative means of attachment, such as fasteners, may be used instead of welding. In certain example embodiments, the ashtray support brackets 183 may be formed from sheet metal, such as 18 gauge steel. In particular, the sheet metal may be cut to size and to define the apertures therein, and then bent to form the ashtray support brackets 183.

The ashtray body 184 may be fixedly secured to the ashtray base 185 to form a vessel for receiving and containing ashes, cigarettes, cigars, and the like placed therein. As shown in FIG. 1Z, the ashtray body 184 may have an open cylindrical shape, and the ashtray base 185 may have a disc shape in the form of a tray configured to receive a lower portion of the ashtray body 184 therein. The ashtray body 184 may include a number of openings defined therein and configured to allow a user to easily insert ashes, cigarettes, cigars, and the like into the interior space of the ashtray body 184. It will be appreciated that such openings also may facilitate venting of the interior space of the ashtray body 184, thereby allowing air to enter the interior space and smoke from ashes, cigarettes, cigars, and the like to exit the interior space. As shown, the ashtray body 184 may include a number of openings 186 defined therein and in communication with the interior space of the ashtray body 184. The openings 186 may be formed in one or more arrays, as shown. The ashtray body 184 also may include one or more primary openings 187 defined therein and in communication with the interior space of the ashtray body 184. The primary opening 187 may be positioned circumferentially between two or more of the openings 186, as shown. The primary opening 187 generally may be used for insertion of ashes, cigarettes, cigars, and the like into the interior space of the ashtray body 184, and the openings 186 generally may be used to facilitate venting of the interior space of the ashtray body 184, although all of the openings 186, 187 may be used for either purpose. The ashtray base 185 may be fixedly secured to the ashtray body 184, such as by welding, one or more fasteners, or other means of attachment. In this manner, the ashtray body 184 and the ashtray base 185 may form a vessel suitable for receiving and containing ashes, cigarettes, cigars, and the like between periodic emptying. In certain example embodiments, the ashtray body 184 and the ashtray base 185 each may be formed from sheet metal, such as 18 gauge steel. In particular, respective pieces of the sheet metal may be cut to size and to define the apertures therein, and then bent to form the ashtray body 184 and the ashtray base 185 prior to attachment to one another.

As shown in FIGS. 1W-1Z, the ashtray body 184 may be removably attached to the ashtray support brackets 183 in a manner that facilitates efficient emptying of contents within the ashtray body 184 and reattachment with respect to the remainder of the waste receptacle 100. In particular, the ashtray body 184 may be removably attached to the ashtray support brackets 183 by a number of rivets 189 (which also may be referred to as "rivet pins" or "pins"). Each of the ashtray support brackets 183 may have one of the rivets 189 fixedly secured thereto, with the rivet 189 having an exposed portion extending radially inward from the respective ashtray support bracket 183. As shown, the rivets 189 may be secured to the respective ashtray support brackets 183 near the upper ends thereof and near the ashtray hood 182. As shown in FIGS. 1Y and 1Z, the ashtray body 184 may include a number of slots 188 defined therein near the upper end of the ashtray body 184. The number of the slots 188 may correspond to the number of the rivets 189. As shown, each slot 188 may have a J-shape, with the long vertical leg of the slot 188 extending downward from the upper end of the ashtray body 184, and the short vertical leg of the slot 188 extending upward toward, but spaced apart from, the upper end of the ashtray body 184. In this manner, the ashtray body 184 may be attached to the ashtray support brackets 183 by inserting the ashtray body 184 upward through the corresponding central opening of the hood 173, aligning the long vertical legs of the slots 188 with the rivets 189, advancing the slots 188 upward to receive the rivets 189 within the long vertical legs of the slots 188, rotating the ashtray body 184 about its central axis until the rivets 189 are received within the short vertical legs of the slots 188, and then releasing the ashtray body 184 such that the rivets 189 are held within the short vertical legs of the slots 188 by the force of gravity. When the ashtray body 184 is attached, the upper end of the ashtray body 184 may be covered by and positioned near the inner surface of the ashtray hood 182. It will be appreciated that the ashtray body 184 may be removed from the ashtray support brackets 183 by raising the ashtray body 184 with respect to the rivets 189, rotating the ashtray body 184 about its central axis until the rivets 189 are received within the long vertical legs of the slots 188, moving the ashtray body 184 downward such that the rivets 189 are released from the long vertical legs of the slots 188, and then removing the ashtray body 184 from the central opening of the hood 173. In this manner, the connection between the slots 188 of the ashtray body 184 and the rivets 189 may allow the ashtray body 184 to be easily removed from the remainder of the waste receptacle 100 for emptying and then subsequently reattached for further use.

It also will be appreciated that the ashtray body 184 and the ashtray base 185 may be configured to properly contain ashes, cigarettes, cigars, and the like within the interior space of the ashtray body 184 when the lid 157 and the hood 173 are pivoted to the open position for removing a liner bag and waste from the liner 177. As shown in FIGS. 1W-1Z, the openings 186 and the primary opening 187 of the ashtray body 184 may be positioned within a circumferential sub-sector of the ashtray body 184 that is less than half of the circumference (i.e., less than 180°) of the ashtray body 184. Meanwhile, the remainder of the circumference of the ashtray body 184 may be formed as a solid wall without any openings defined therein (except for the slot 188 formed along the upper end of the ashtray body 184). In certain example embodiments, the circumferential sub-sector containing the openings 186 and the primary opening 187 may be less than less than 180°, less than 160°, less than 140°, less than 120°, less than 100°, or less than 80° of the circumference of the ashtray body 184. As shown, the ashtray body 184 may be attached to the remainder of the waste receptacle 100, via the ashtray support brackets as described above, such that the solid wall of the ashtray body 184 is positioned along the side of the receptacle 100 including the hinge 165 and the circumferential sub-sector containing the openings 186 and the primary opening 187 is positioned along the side of the receptacle 100 opposite the hinge 165. In this manner, when the lid 157 and the hood 173 are pivoted to the open position via the hinge, the contents within the ashtray body 184 may shift or otherwise move against the solid wall of the ashtray body 184 and remain contained within the interior space of the ashtray body 184. Further, the location of the circumferential sub-sector containing the openings 186 and the primary opening 187 may ensure that the contents are not able to exit the interior space of the ashtray body 184 through the openings 186, 187 when the lid 157 and the hood 173 are pivoted to the open position. As shown in FIG. 1Z, the ashtray base 185 may include a raised portion 190 extending upward into the interior space of the ashtray body 184. The raised portion 190 may be configured to control and concentrate the collection of ashes, cigarettes, cigars, and the like within the interior space of the ashtray body 184, and to control the movement of such contents when the lid 157 and the hood 173 are pivoted between the closed position and the open position. Ultimately, the ashtray subassembly may provide a straightforward and convenient means for receiving and containing ashes, cigarettes, cigars, and the like, which advantageously may be efficiently removed and reattached and also may prevent or inhibit containment issues that otherwise may exist when moving the lid 157 and the hood 173 between the closed position and the open position.

FIGS. 2A-2H illustrate a waste receptacle 200 (which also may be referred to as a "refuse receptacle") as well as individual components and features of the waste receptacle 200 in accordance with one or more example embodiments of the disclosure. The waste receptacle 200 may be used in various types of facilities or environments to receive and contain waste. As described below, the waste receptacle 200 may include a frame and one or more replaceable panel inserts that are removably secured with respect to the frame by retention components and features. The panel inserts may be at least partially exposed along the outside of the waste receptacle 200 and may have a decorative appearance that suits the interior or exterior décor, the exterior landscaping, and/or the architectural construction of the facility at which the waste receptacle 200 is located. When desired, the panel inserts may be removed from the frame and replaced with new panel inserts having a different decorative appearance. In this manner, the owner of the waste receptacle 200 may achieve significant cost savings by purchasing only the new panel inserts and maintaining the remaining portions of the waste receptacle 200.

As compared to certain existing waste receptacles that include a frame and one or more replaceable panel inserts, embodiments of the waste receptacle 200 may include retention components and features that securely maintain the panel inserts in a desired position with respect to the frame and prevent the panel inserts from becoming dislodged over time, may include retention components and features that resist wear and maintain their integrity even after multiple replacements of the panel inserts, may reduce the need to keep dimensions of mating features of the panel inserts and other components of the waste receptacle 200 within tight tolerance ranges, thereby easing manufacture of the waste receptacle 200 and replacement of the panel inserts, and/or may allow the process of removing existing panel inserts and inserting new panel inserts to be completed easily and quickly with a single tool.

As shown in FIGS. 2A-2F, the waste receptacle 200 may include a frame 201 (which also may be referred to as an "outer frame") exposed along an outer surface of the waste receptacle 200 and providing a support structure for other components of the waste receptacle 200 to be mounted thereto. The frame 201 may include a bottom ring 202, a top ring 203, and a number of arms 204 (which also may be referred to as "vertical arms"). The bottom ring 202 and the top ring 203 may be vertically spaced apart from one another, and the arms 204 may extend vertically from the bottom ring 202 to the top ring 203. In certain example embodiments, as shown, the bottom ring 202 and the top ring 203 may have a pill shape with two linear sides and two curved sides, and the arms 204 each may have a curved shape that matches the curvature of the rings 202, 203. In other example embodiments, the bottom ring 202 and the top ring 203 may have other shapes, and the arms 204 each may have a shape that matches the shape of adjacent portions of the rings 202, 203.

The arms 204 may be spaced apart from one another along the respective circumferences of the rings 202, 203, such that a number of windows openings 205 are defined in the frame 201. In particular, each window opening 205 may be defined between an adjacent pair of the arms 204 and respective portions of the bottom ring 202 and the top ring 203. In certain example embodiments, as shown, the arms 204 may be positioned in an array along the perimeter of the rings 202, 203, such that the window openings 205 are different in size. According to the illustrated embodiment, the frame 201 may include four arms 204 and four window openings 205. However, it will be appreciated that the frame 201 may include any number of arms 204 and any number of window openings 205 according to other example embodiments. In certain example embodiments, as shown, the bottom ring 202, the top ring 203, and the arms 204 of the frame 201 may be integrally formed with one another. For example, the frame 201 may be formed from sheet metal, such as 18 gauge steel. In particular, the sheet metal may be cut to size and to define the window openings 205, roll formed, and then seam welded to form the frame 201 including the bottom ring 202, the top ring 203, the arms 204, and the window openings 205. In other example embodiments, one or more of the bottom ring 202, the top ring 203, and the arms 204 may be separately formed and fixedly secured to one another, such as by welding, to form the frame 201.

As shown in FIGS. 2B-2F, the waste receptacle 200 may include a base 206 (which also may be referred to as a "base pan") attached to the frame 201 and positioned along the bottom of the waste receptacle 200, and a number of feet 207 attached to the base 206. The base 206 may have a shape that corresponds to the shape of the frame 201. For example, the base 206 may have a pill shape that corresponds to the pill shape of the bottom ring 202 of the frame 201, as shown, although other shapes of the base 206 may be used in other example embodiments. The base 206 may include a number of mounting holes 208 defined therein and configured to receive respective portions of the feet 207 therethrough. The mounting holes 208 may be spaced apart from one another and arranged in as array, as shown, although other arrangements of the mounting holes 208 may be used. As shown, the mounting holes 208 may include female threads configured to threadably engage the respective feet 207. In certain example embodiments, the base 206 may be formed from sheet metal, such as 20 gauge steel. In particular, the sheet metal may be cut to size and to define the threaded mounting holes 208, bent to form a number of angled tabs along a perimeter of the base 206, and then spot welded to the bottom ring 202 of the frame 201 such that the base 206 is fixedly secured to the frame 201.

Figure 2A:
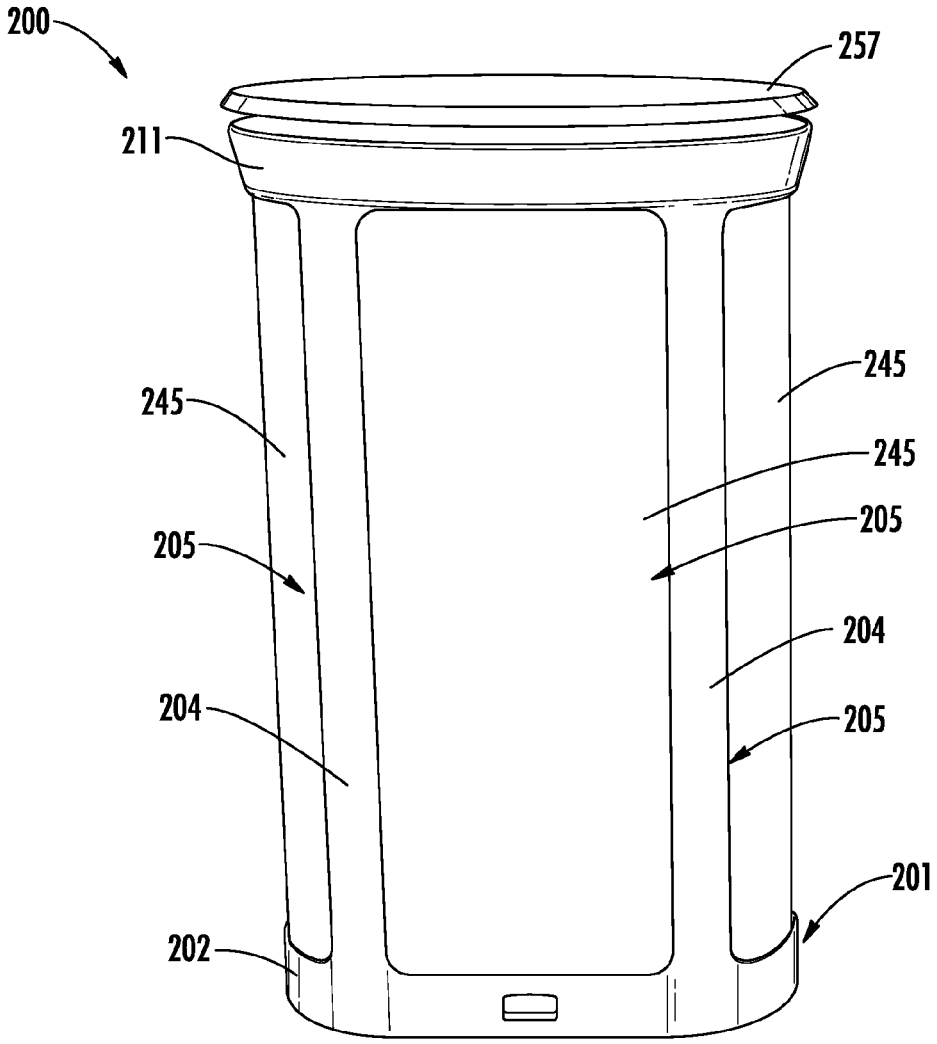
FIG. 2A is a perspective view of a waste receptacle in accordance with one or more example embodiments of the disclosure.
Figure 2C:
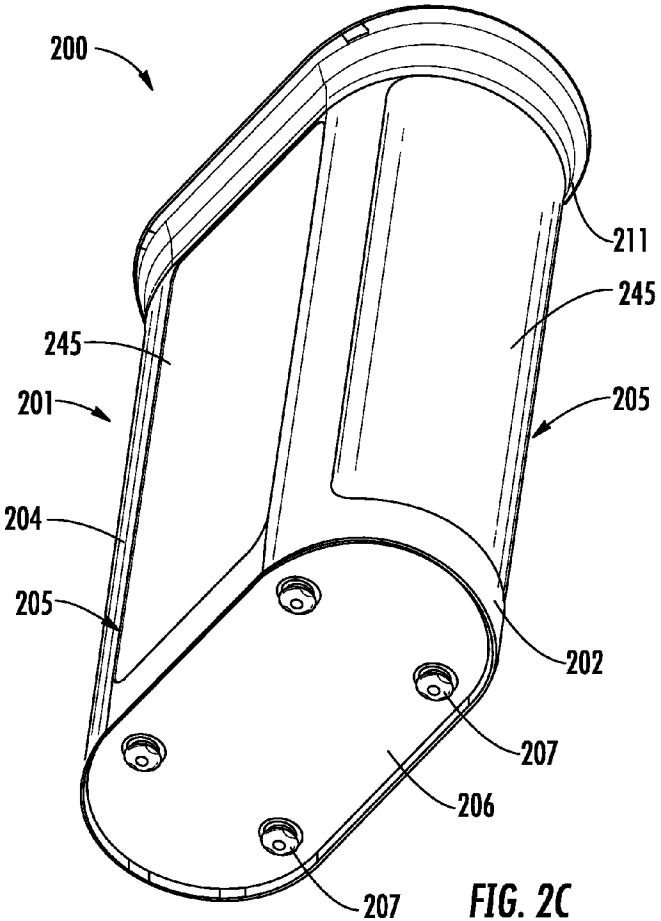
FIG. 2C is a perspective view of the waste receptacle of FIG. 2A.
Figure 2B:
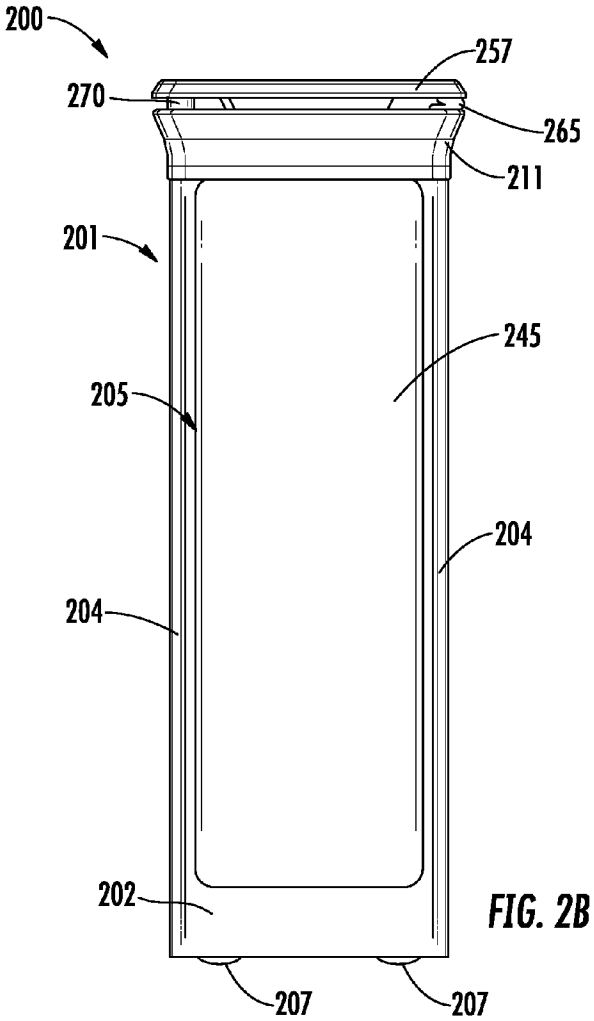
FIG. 2B is a side view of the waste receptacle of FIG. 2A.

The feet 207 each may include a shaft 209 and a head 210 positioned at a bottom end of the shaft 209. The shaft 209 may include male threads configured to engage the female threads of the mounting holes 208, such that the feet 207 may be threadably attached to the base 206. As shown in FIG. 2B, the feet 207 may be attached to the base 206 such that the heads 210 of the feet 207 are positioned below the bottom of the frame 201. In this manner, the feet 207 may support the waste receptacle 200 on a support surface, such as a floor, while the bottom of the frame 201 remains vertically spaced apart from the support surface. If the support surface is not level, the feet 207 may be adjusted by threadably advancing or retracting the feet 207 relative to the base 206 such that the bottom of the frame 201 is level and the waste receptacle 200 is oriented in a vertical manner. In certain example embodiments, the feet 207 may be formed from a plastic, such as polyoxymethylene (POM), although other materials may be used. According to the illustrated embodiment, the waste receptacle 200 may include four feet 207 and the base 206 may include three mounting holes 208. However, it will be appreciated that the waste receptacle 200 may include any number of feet 207 and the base 206 may include any number of mounting holes 208 according to other example embodiments.

As shown in FIGS. 2A-2H, the waste receptacle 200 may include a crown 111 (which also may be referred to as a "rim") attached to the frame 201 and positioned near the top of the waste receptacle 200. The crown 211 may have a shape that corresponds to the shape of the frame 201. For example, the crown 211 may have a pill shape that corresponds to the pill shape of the top ring 203 of the frame 201, as shown, although other shapes of the crown 211 may be used in other example embodiments. A top portion of the crown 211 may be flared outward, as shown, such that the crown 211 extends outward beyond the frame 201. In certain example embodiments, the crown 211 may be formed from sheet metal, such as 18 gauge steel. In particular, the sheet metal may be cut to size and hydroformed to create the flared shape of the crown 211. As shown, the crown 211 may be positioned over the top ring 203 of the frame 201 such that a bottom portion of the crown 211 overlaps at least a portion of the top ring 203, and the crown 211 may be spot welded to the top ring 203 such that the crown 211 is fixedly secured to the frame 201.

Figure 2D:
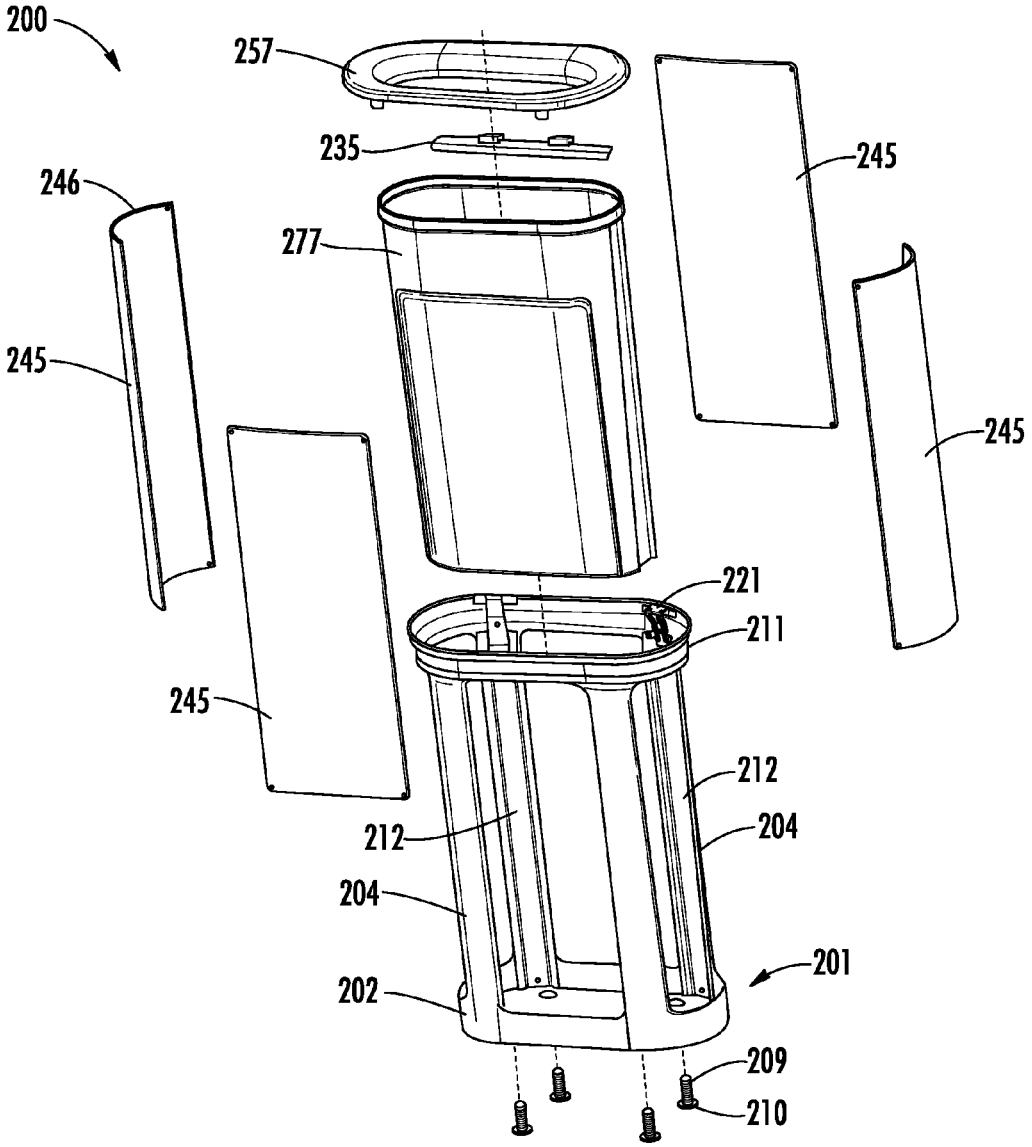
FIG. 2D is a partially exploded perspective view of the waste receptacle of FIG. 2A.
Figure 2F:
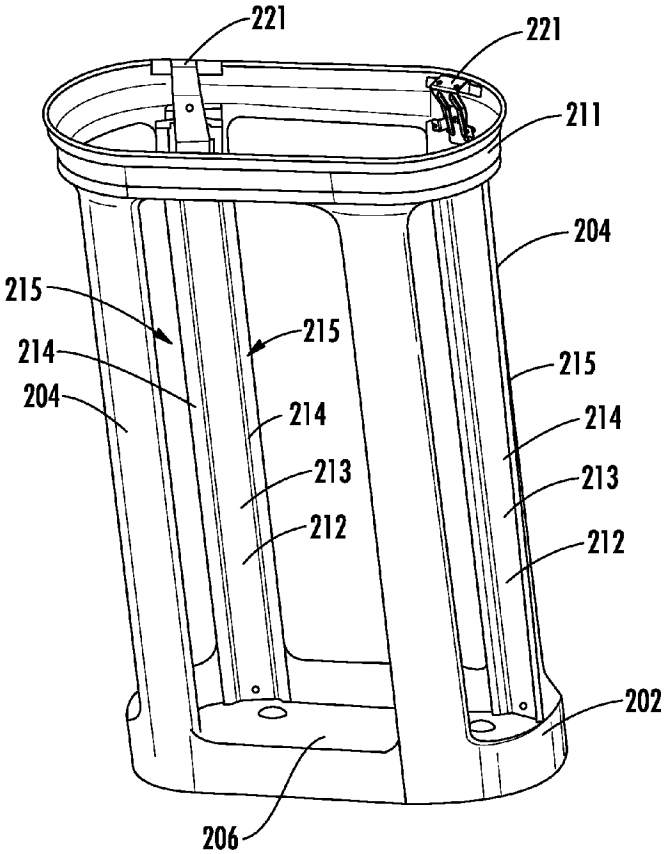
FIG. 2F is a perspective view of a portion of the waste receptacle of FIG. 2A.
Figure 2E:
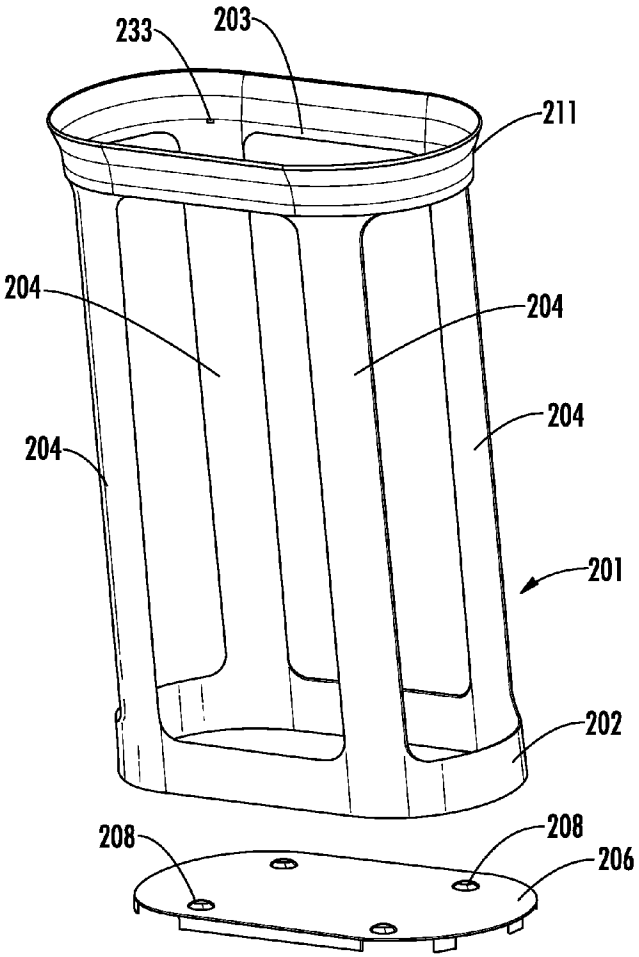
FIG. 2E is a partially exploded perspective view of a portion of the waste receptacle of FIG. 2A.

As shown in FIGS. 2D and 2F, the waste receptacle 200 may include a number of arm supports 212 (which also may be referred to as "vertical arm supports") attached to the frame 201 and positioned along an inner surface of the frame 201. In particular, each arm support 212 may be positioned along an inner surface of one of the arms 204 and attached thereto. The arm supports 212 each may have an elongated shape and may extend vertically along the respective arm 204 and from the base 206 toward the top ring 203. As shown, each arm support 212 may include a base portion 213 (which also may be referred to as a "central portion") and a pair of wings 214 extending from the base portion 213. The base portion 213 and the wings 214 each may extend vertically from a bottom end to a top end of the arm support 212. As shown, the wings 214 may be positioned along opposite lateral sides of the base portion 213 and may be offset from the base portion 213. The base portion 213 may abut and be attached to the respective arm 204, and the wings 214 each may be spaced apart from the respective arm 204. In this manner, each of the wings 214 may define a channel 215 between the arm support 212 and the respective arm 204. Each channel 215 may be configured to receive a portion of a panel insert, as described below. In certain example embodiments, the arm supports 212 may be formed from sheet metal, such as 18 gauge steel. In particular, the sheet metal may be cut to size and then bent to form the base portion 213 and the wings 214 of the arm support 212. The base portion 213 may be centered along a width of the respective arm 204 and spot welded to the respective arm 204 such that the arm support 212 is fixedly secured to the frame 201.

Figure 2G:
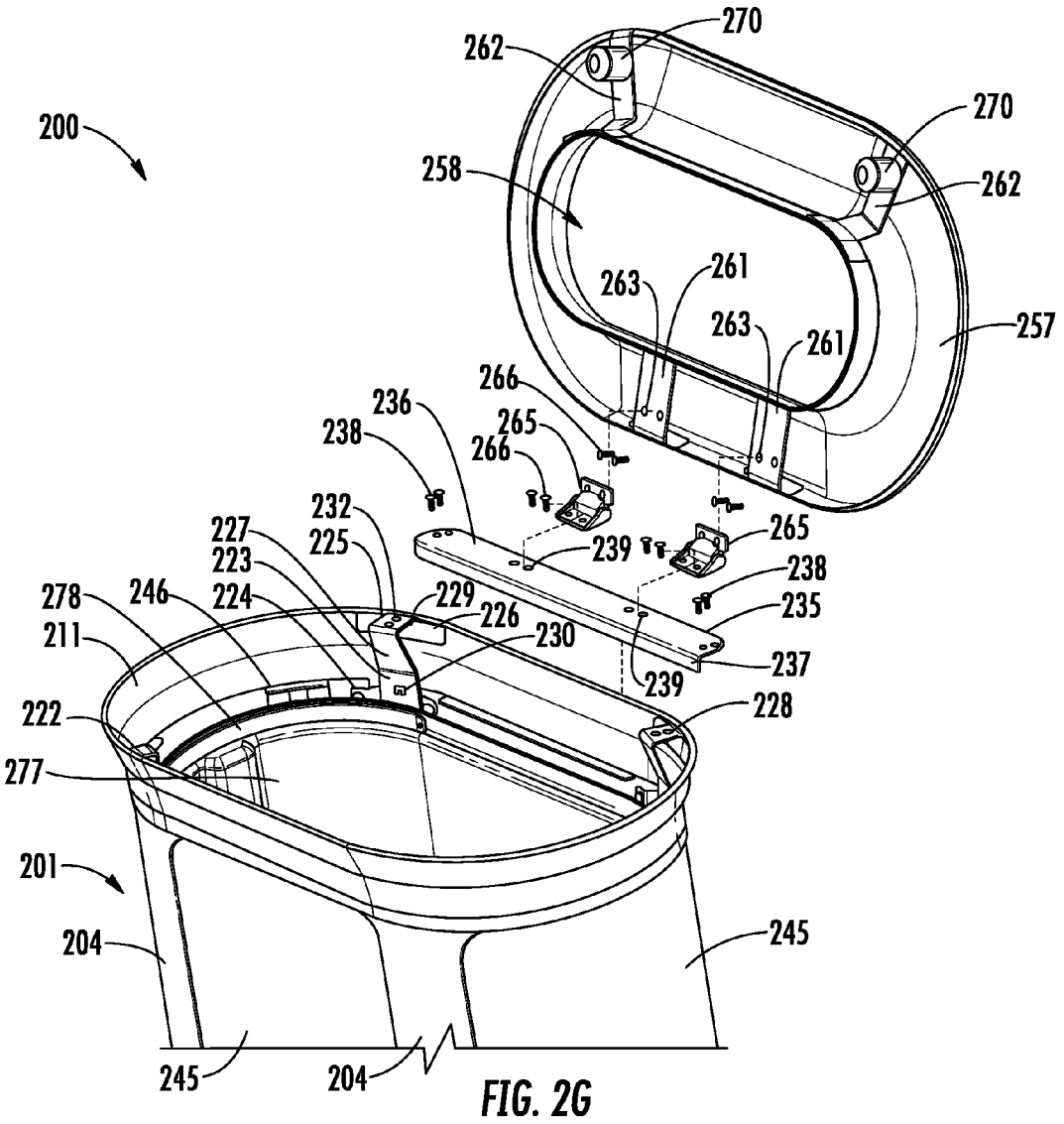
FIG. 2G is partially exploded perspective view of a portion of the waste receptacle of FIG. 2A.
Figure 2H:
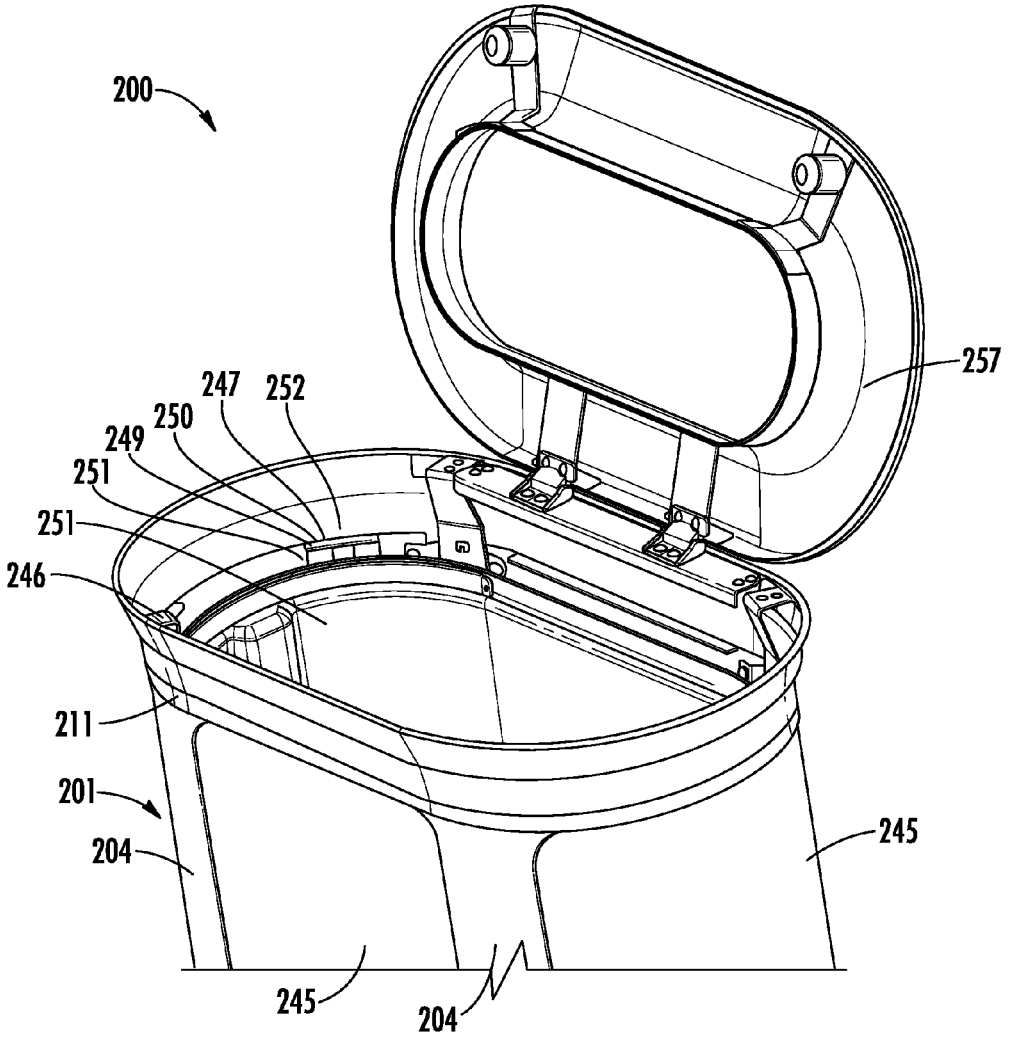
FIG. 2H is a perspective view of a portion of the waste receptacle of FIG. 2A.

As shown in FIGS. 2F-2H, the waste receptacle 200 may include a number of brackets attached to the arm supports 212 and positioned along inner surfaces of the frame 201 and the crown 211. In particular, the waste receptacle 200 may include a pair of frame hinge brackets 221 (which also may be referred to simply as a "hinge brackets") attached, respectively, to the back two arm supports 212, and a pair of frame landing brackets 222 (which also may be referred to simply as "landing brackets") attached, respectively, to the front two arm supports 212. As shown, the frame hinge brackets 221 each may include a base portion 223 (which also may be referred to as a "base central portion"), a pair of lower wings 224 extending from the base portion 223, a top portion 225 (which also may be referred to as a "top central portion"), and a pair of upper wings 226 extending from the top portion 225. The lower wings 224 may be positioned along opposite lateral sides of the base portion 223 and may be offset from the base portion 223, as shown. The top portion 225 may include an inner wall 227, a top wall 228, and an outer wall 229. The upper wings 226 may be positioned along opposite lateral sides of the outer wall 229 of the top portion 225, as shown. The frame hinge bracket 221 also may include an alignment tab 230 and a pair of abutment tabs 231 extending from the base portion 223. As shown, the alignment tab 230 may be centered along the width of the base portion 223 and may extend outward from the base portion 223. The abutment tabs 231 may be positioned along opposite lateral sides of the base portion 223 and below the lower wings 224. In certain example embodiments, the frame hinge bracket 221 may be formed from sheet metal, such as 18 gauge steel. In particular, the sheet metal may be cut to size and to define the apertures therein, and then bent to form the base portion 223, the lower wings 224, the top portion 225, the upper wings 226, and the alignment tab 230 of the frame hinge bracket 221.

The frame hinge bracket 221 may have a number of nuts 232 attached thereto. In particular, a first pair of nuts 232 may be respectively positioned and attached within apertures defined in the lower wings 224, and a second pair of nuts 232 may be respectively positioned and attached within apertures defined in the top wall 228 of the top portion 225. In certain example embodiments, the nuts 232 may be PEM® nuts, although other types of nuts suitable for attachment to sheet metal may be used in other example embodiments.

The frame hinge bracket 221 may be attached to the respective arm support 212, the frame 201, and the crown 211 as shown in FIGS. 2F-2H. In particular, the frame hinge bracket 221 may be centered with respect to the arm support 212 and positioned such that the base portion 223 of the frame hinge bracket 221 overlaps a portion of the base portion 213 of the arm support 212 and the abutment tabs 231 of the frame hinge bracket 221 abut the top end of the arm support 212. The frame hinge bracket 221 may be spot welded to the arm support 212 such that these components are fixedly secured to one another. After the frame hinge bracket 221 and the arm support 212 are secured to one another, the arm support 212 may be positioned along the inner surface of the respective arm 204 of the frame 201 such that the bottom end of the arm support 212 abuts the base 206, and the alignment tab 230 may be positioned within one of a number of alignment notches 233 defined in the top edge of the top ring 203 of the frame 201, as shown. The arm support 212 then may be spot welded to the arm 204 of the frame 201, as described above, and the frame hinge bracket 221 may be spot welded to the crown 211. In particular, the outer wall 229 of the top portion 225 and/or the upper wings 224 may be spot welded to the inner surface of the crown 211. In this manner, the frame hinge bracket 221, the arm support 212, the crown 211, and the frame 201 may be fixedly secured to one another.

The frame landing brackets 222 each may be configured in a manner similar to the frame hinge brackets 221. In particular, each frame landing bracket 222 may include a base portion 223 (which also may be referred to as a "base central portion"), a pair of lower wings 224 extending from the base portion 223, a top portion 225 (which also may be referred to as a "top central portion"), and a pair of upper wings 226 extending from the top portion 225. The lower wings 224 may be positioned along opposite lateral sides of the base portion 223 and may be offset from the base portion 223. The top portion 225 may include an inner wall 227, a top wall 228, and an outer wall 229. The upper wings 226 may be positioned along opposite lateral sides of the outer wall 229 of the top portion 225. The frame landing bracket 222 also may include an alignment tab 230 and a pair of abutment tabs 231 extending from the base portion 223. The alignment tab 230 may be centered along the width of the base portion 223 and may extend outward from the base portion 223. The abutment tabs 231 may be positioned along opposite lateral sides of the base portion 223 and below the lower wings 224. In certain example embodiments, the frame landing bracket 222 may be formed from sheet metal, such as 18 gauge steel. In particular, the sheet metal may be cut to size and to define the apertures therein, and then bent to form the base portion 223, the lower wings 224, the top portion 225, the upper wings 226, and the alignment tab 230 of the frame hinge bracket 221.

The frame landing bracket 222 may have a number of nuts 232 attached thereto. In particular, a first pair of nuts 232 may be respectively positioned and attached within apertures defined in the lower wings 234. In certain example embodiments, the nuts 232 may be PEM® nuts, although other types of nuts suitable for attachment to sheet metal may be used in other example embodiments.

The frame landing bracket 222 may be attached to the respective arm support 212, the frame 201, and the crown 211 in a manner similar to the frame hinge bracket 221. In particular, the frame landing bracket 222 may be centered with respect to the arm support 212 and positioned such that the base portion 223 of the frame landing bracket 222 overlaps a portion of the base portion 213 of the arm support 212 and the abutment tabs 230 of the frame landing bracket 222 abut the top end of the arm support 212. The frame landing bracket 222 may be spot welded to the arm support 212 such that these components are fixedly secured to one another. After the frame landing bracket 222 and the arm support 212 are secured to one another, the arm support 212 may be positioned along the inner surface of the respective arm 204 of the frame 201 such that the bottom end of the arm support 212 abuts the base 206, and the alignment tab 240 may be positioned within one of the alignment notches 233 defined in the top edge of the top ring 203 of the frame 201. The arm support 212 then may be spot welded to the arm 204 of the frame 201, as described above, and the frame landing bracket 222 may be spot welded to the crown 211. In particular, the outer wall 229 of the top portion 225 and/or the upper wings 226 may be spot welded to the inner surface of the crown 211. In this manner, the frame landing bracket 222, the arm support 212, the crown 211, and the frame 201 may be fixedly secured to one another.

As shown in FIGS. 2G and 2H, the waste receptacle 200 also may include a spanner bracket 235 attached to the frame hinge brackets 221. The spanner bracket 135 may have an elongated shape and may span the distance between the two frame hinge brackets 221, as shown. The spanner bracket 235 may include a top wall 236 that rests on the tops walls 228 of the frame hinge brackets 221, and an inner wall 237 that extends transverse to and downward from the top wall 236. As shown, the spanner bracket 235 may be attached to the frame hinge brackets 221 by a number of fasteners 238 extending through apertures defined in the top wall 236 and threadably engaging the nuts 232 of the top walls 228 of the frame hinge brackets 221.

The spanner bracket 235 may have a number of nuts 239 attached thereto. In particular, a first pair of nuts 239 may be respectively positioned and attached within apertures defined in the top wall 236 closer to one end of the spanner bracket 235, and a second pair of nuts 239 may be respectively positioned and attached within apertures defined in the top wall 236 closer to the other end of the spanner bracket 235. In certain example embodiments, the nuts 239 may be PEM® nuts, although other types of nuts suitable for attachment to sheet metal may be used in other example embodiments.

As shown in FIGS. 2A-2D, 2G, and 2H, the waste receptacle 200 may include a number of panel inserts 245 (which also may be referred to simply as "panels") removably secured with respect to the frame 201. According to the illustrated embodiment, the waste receptacle 200 may include four panel inserts 245. However, it will be appreciated that the waste receptacle 200 may include any number of panel inserts 245 according to other example embodiments. FIGS. 2A-2D, 2G, and 2H illustrate an example panel insert 245 and a number of panel brackets 246 in accordance with one or more embodiments of the disclosure, which may be used as a part of the waste receptacle 200. As shown, two of the panel inserts 245 may be formed as substantially rectangular sheets having a flat shape that corresponds to the flat front and back sides of the frame 201, and the other two panel inserts 245 may be formed as substantially rectangular sheets having a curved or arcuate shape that corresponds to the curved lateral sides of the frame 201. Each panel insert 245 may include a pair of alignment notches 247 defined in the top edge of the panel insert 245. One of the alignment notches 247 may be positioned near but spaced apart from one of the top corners of the panel insert 245, and the other alignment notch 247 may be positioned near but spaced apart from the other top corner of the panel insert 245. The panel insert 245 also may include a pair of mounting holes 248 defined therein and extending from the inner surface to the outer surface of the panel insert 245. One of the mounting holes 248 may be positioned near but spaced apart from one of the top corners of the panel insert 245, and the other mounting hole 248 may be positioned near but spaced apart from the other top corner of the panel insert 245. In certain example embodiments, the panel insert 245 may be formed from sheet metal, such as 18 gauge steel. In particular, the sheet metal may be cut to size and to define the alignment notches 247 and the mounting holes 248 therein, and then roll formed (for the curved panel inserts 245) to form the panel insert 245 having the curved or arcuate shape. The panel insert 245 may have a decorative appearance, which may include one or more coatings, finishes, color treatments, textures, hole patterns, or other decorative features. In certain example embodiments, the panel insert 245 may be formed from a plastic or a plastic blend.

The panel brackets 246 (which also may be referred to as "lift brackets") may be attached to the panel insert 245 along the inner surface and the top edge of the panel insert 245 and may be used to facilitate insertion and removal of the panel insert 245. As shown, each panel bracket 246 may include a lift tab 249, an alignment tab 250, and a pair of mounting tabs 251. The lift tab 249 may extend inward from the panel insert 245 and may be configured to be grasped by a user to facilitate insertion and removal of the panel insert 245. The alignment tab 250 may extend in an opposite direction from the lift tab 249 and may be positioned within one of the alignment notches 247 of the panel insert 245 to facilitate alignment of the panel bracket 246 with respect to the panel insert 245. The mounting tabs 251 may extend transverse to and downward from the lift tab 249 and may abut the inner surface of the panel insert 245. The mounting tabs 251 may be spot welded to the inner surface of the panel insert 2145 such that the panel bracket 246 is fixedly secured to the panel insert 245. In certain example embodiments, the panel brackets 246 may be formed from sheet metal, such as 18 gauge steel. In particular, the sheet metal may be cut to size and then bent to form the lift tab 249, the alignment tab 250, and the mounting tabs 251 of the panel bracket 246. According to the illustrated embodiment, two panel brackets 246 may be attached to each panel insert 245. However, it will be appreciated that any number of panel brackets 246 may be attached to each panel insert 245 according to other example embodiments.

FIGS. 2G and 2H illustrate how the panel inserts 245 may be removably secured with respect to the frame 201 of the waste receptacle 200. As shown, each panel insert 245 may be removably received within two of the channels 215 defined between the arm supports 212 and the respective arms 204 of the frame 201. In particular, one of the lateral edges of the panel insert 245 may be received within one of the channels 215 defined between one of the arm supports 212 and the respective arm 204, and the other lateral edge of the panel insert 245 may be received within one of the channels 215 defined between an adjacent arm support 212 and the respective arm 204, as shown. As described above, the panel brackets 246 may be used to facilitate positioning of the panel insert 245 for insertion of the panel insert 245 into the channels 215 or removal of the panel insert 245 from the channels 215. As shown, when the panel insert 245 is received within the channels 215, the panel insert 245 may be partially exposed through the window opening 205 defined between the respective arms 204 of the frame 201.

As shown in FIGS. 2G and 2H, the waste receptacle 100 may include a number of fasteners 252 configured to control vertical movement of the panel inserts 245 with respect to the frame 201. In particular, each fastener 252 may be configured to move between an engaged position preventing removal (i.e., upward vertical movement) of one of the panel inserts 245 from the respective channels 215 and a disengaged position allowing removal of the panel insert 245 from the respective channels 215. In certain example embodiments, as shown, the fasteners 252 may be screws, although other types of fasteners may be used in other example embodiments. As shown, each fastener 252 may be threadably engaged with one of the nuts 232 of the lower wings 224 of the frame hinge bracket 221 or one of the nuts 232 of the lower wings 224 of the frame landing bracket 222. When the fastener 252 is in the engaged position, the fastener 252 may extend through the respective nut 232, 242 and through one of the mounting holes 248 of one of the panel inserts 245, thereby preventing the panel insert 245 from being removed from the respective channels 215 and the frame 201. When the fastener 252 is in the disengaged position, the fastener 252 may extend through the respective nut 232 but be removed from the mounting hole 248 of the panel insert 245, thereby allowing the panel insert 245 to be removed from the respective channels 215 and the frame 201.

As shown in FIGS. 2A-2D, 2G, and 2H, the waste receptacle 200 may include a lid 257 (which also may be referred to as a "cover") movably secured with respect to the frame 201. In particular, the lid 257 may be configured to pivot with respect to the frame 201 between a closed position, as shown in FIG. 2B, and an open position, as shown in FIG. 2H. The lid 257 may have a shape that corresponds to the shape of the crown 211 and the frame 201. For example, the lid 257 may have a pill shape that corresponds to the pill shapes of the crown 211 and the top ring 203 of the frame 201, as shown, although other shapes may be used in other example embodiments. As shown, the lid 257 may include a central opening 258 defined therein and configured to allow waste to passed therethrough and into the waste receptacle 200. As shown, the lid 257 may be flared inward toward the central opening 258 to guide waste toward the central opening 258. In certain example embodiments, the lid 257 may be formed from sheet metal, such as 18 gauge steel. In particular, the sheet metal may be cut to size and to form the central opening 258, and then hydroformed to create the flared shape and contour of the lid 257.

As shown in FIGS. 2G and 2H, the waste receptacle 200 may include a number of brackets attached to the lid 257 and positioned along inner surfaces of the lid 257. In particular, the waste receptacle 200 may include a pair of lid hinge brackets 261 (which also may be referred to simply as a "hinge bracket") attached to inner surfaces of the lid 257, and a pair of lid landing brackets 262 (which also may be referred to simply as "landing brackets") attached to inner surfaces of the lid 257. The lid hinge brackets 261 and the lid landing brackets 262 may be arranged as shown in FIG. 2G and spot welded to the inner surfaces of the lid 257. In certain example embodiments, the lid hinge brackets 261 and the lid landing brackets 262 may be formed from sheet metal, such as 18 gauge steel. In particular, the sheet metal may be cut to size and to define the apertures therein, and then bent to form the lid hinge brackets 261 and the lid landing brackets 262.

The lid hinge brackets 261 each may have a number of nuts 263 attached thereto. In particular, a first pair of nuts 263 may be respectively positioned and attached within apertures defined in the lid hinge bracket 261 near an outer end of the lid hinge bracket 261. In certain example embodiments, the nuts 263 may be PEM® nuts, although other types of nuts suitable for attachment to sheet metal may be used in other example embodiments. As shown in FIGS. 2G and 2H, the lid 257 may be pivotally secured with respect to the frame 201 by a pair of hinges 265. In particular, the hinges 265 may be attached, respectively, to the lid hinge brackets 261 and the spanner bracket 235 by a number of fasteners 266 threadably engaging the respective nuts 232, 263, such that the lid 257 is pivotally secured with respect to the frame 201.

The lid landing brackets 162 each may have a number of nuts 269 attached thereto. In particular, a first nut 269 may be positioned and attached within an aperture defined in the lid landing bracket 262 near an outer end of the lid landing bracket 262. In certain example embodiments, the nuts 269 may be PEM® nuts, although other types of nuts suitable for attachment to sheet metal may be used in other example embodiments. Each lid landing bracket 262 also may have a bumper 270 attached thereto along a bottom surface of the lid landing bracket 262. In particular, the bumper 270 may be attached to the lid landing bracket 262 by a fastener 271 extending through the bumper 270 and threadably engaging the first nut 269. When the lid 257 is in the closed position, the bumpers 270 may rest, respectively, on the top portions 225 of the frame landing brackets 222 such that the lid 257 is vertically spaced apart from the crown 211, as shown in FIG. 2B. In certain example embodiments, the bumpers 270 may be formed of rubber, although other suitable materials may be used in other example embodiments.

As shown in FIGS. 2D, 2G, and 2H, the waste receptacle 200 may include a liner 277 removably positioned within the frame 201. The liner 277 may be shaped and contoured to correspond to the shape of the frame 201. In certain example embodiments, the liner 277 may be formed of a plastic, such as polyethylene, although other suitable materials may be used in other example embodiments. As shown, the liner 277 may have a pair of bales 278 pivotally attached thereto near the top end of the liner 277 and configured to retain a liner bag within the liner 277. In particular, the bales 278 each may be pivotally attached to the liner 277 by a pair of fasteners 279 and a pair of bale brackets 280, as shown.

Figure 3B:
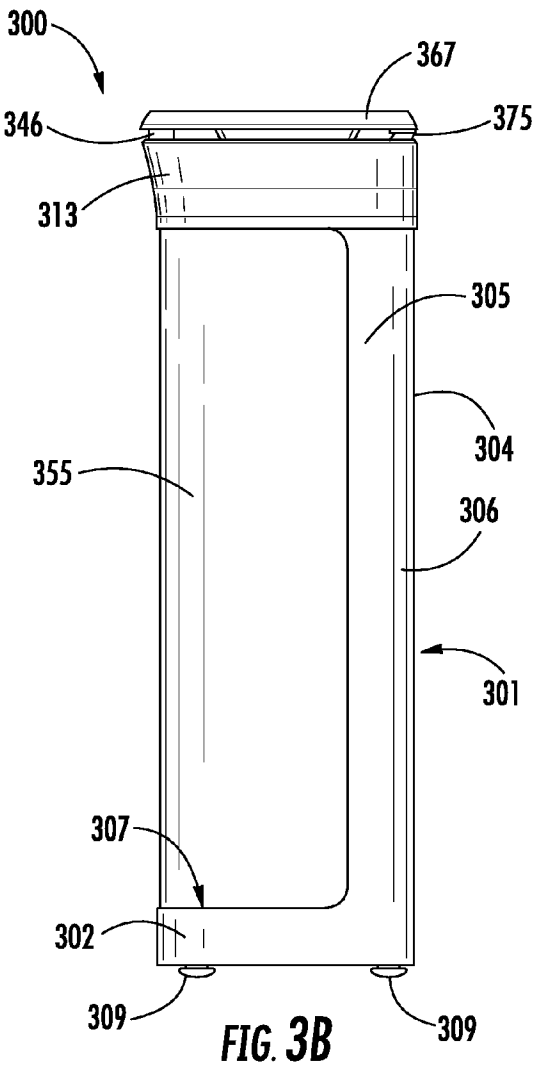
FIG. 3B is a side view of the waste receptacle of FIG. 3A.
Figure 3A:
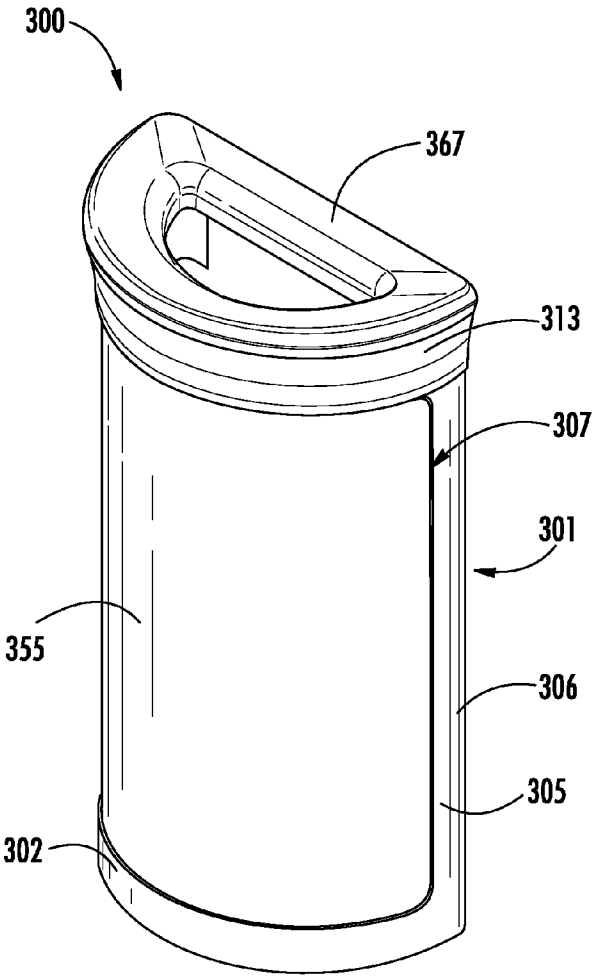
FIG. 3A is a perspective view of a waste receptacle in accordance with one or more example embodiments of the disclosure.
Figure 3C:
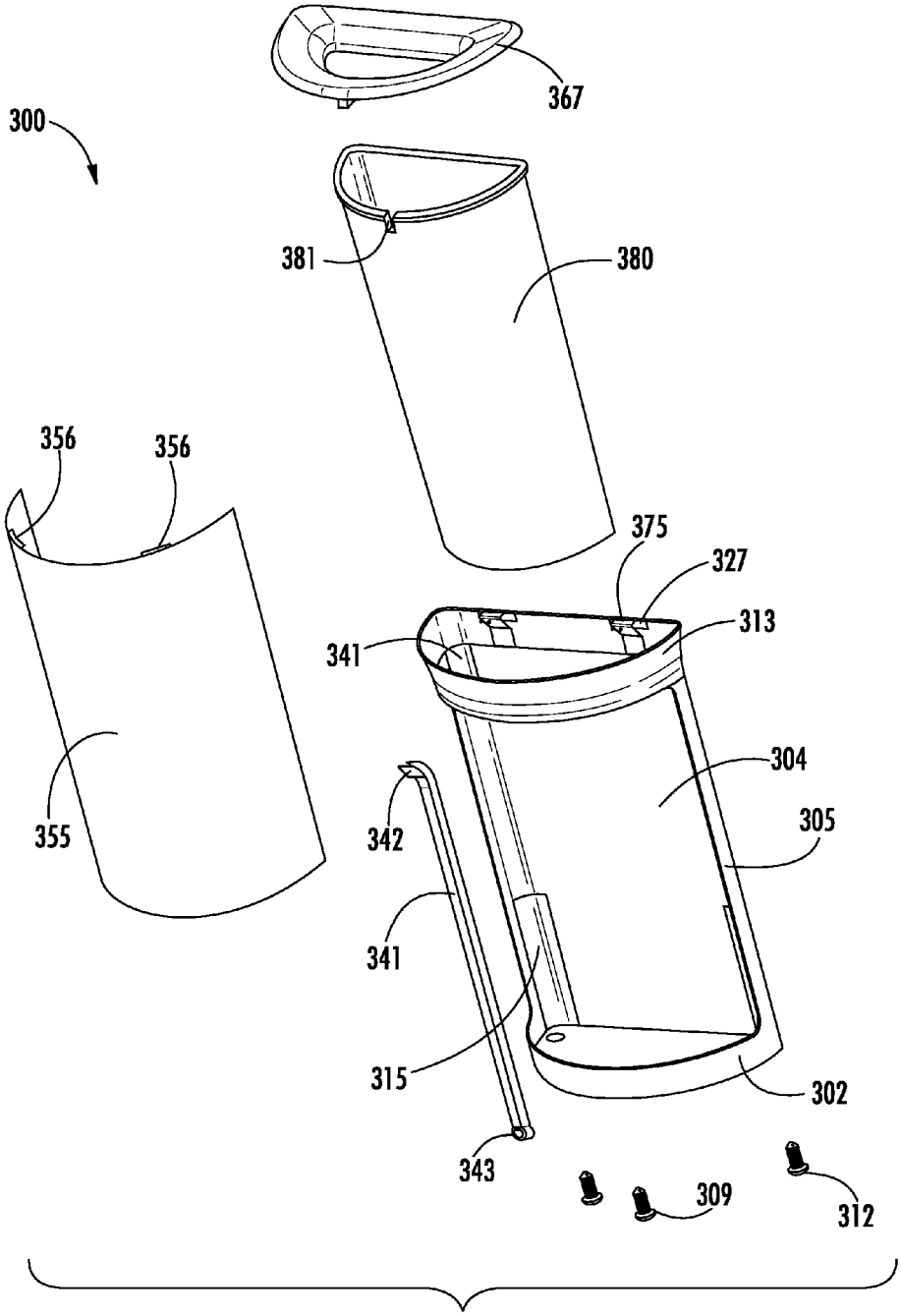
FIG. 3C is a partially exploded perspective view of the waste receptacle of FIG. 3A.
Figure 3D:
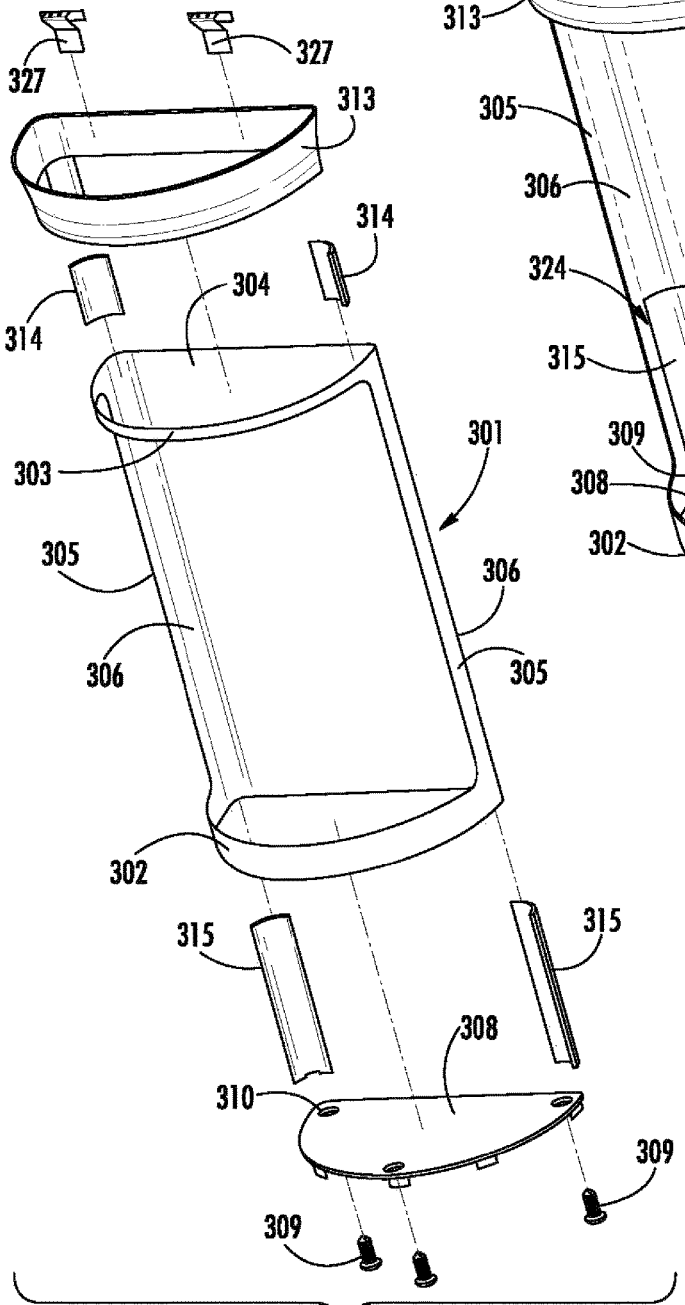
FIG. 3D is a partially exploded perspective view of a portion of the waste receptacle of FIG. 3A.
Figure 3E:
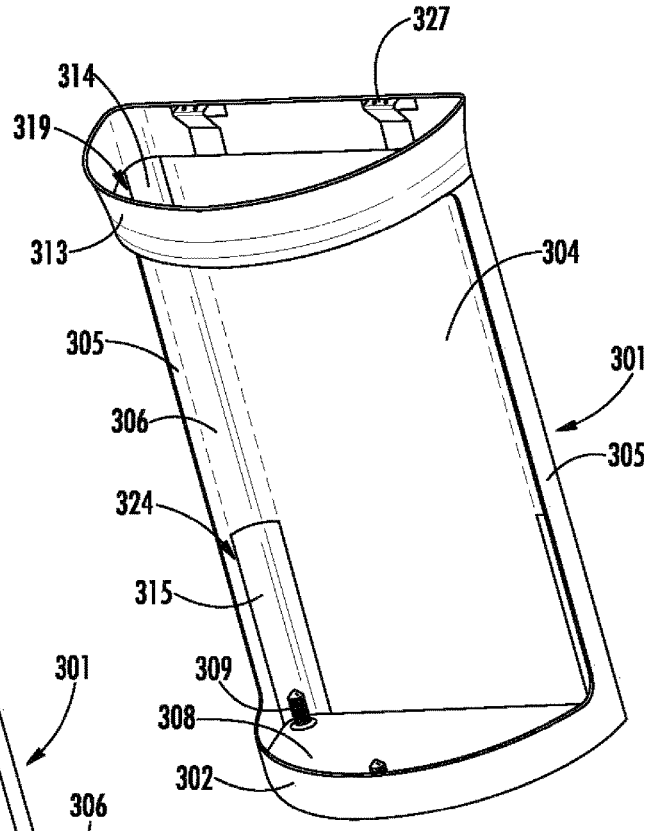
FIG. 3E is a perspective view of a portion of the waste receptacle of FIG. 3A.
Figure 3G:
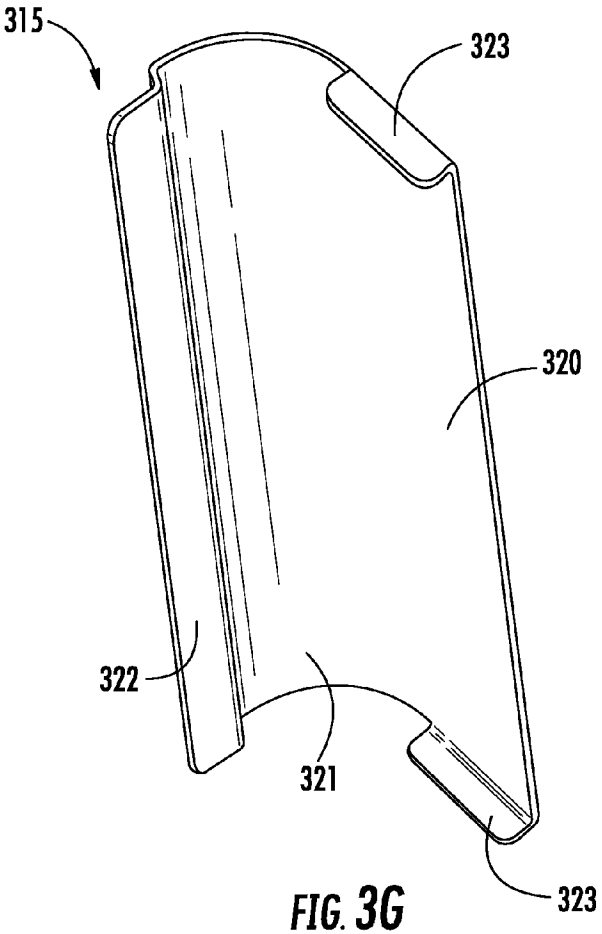
FIG. 3G is a perspective view of a lower panel retainer of the waste receptacle of FIG. 3A.
Figure 3F:
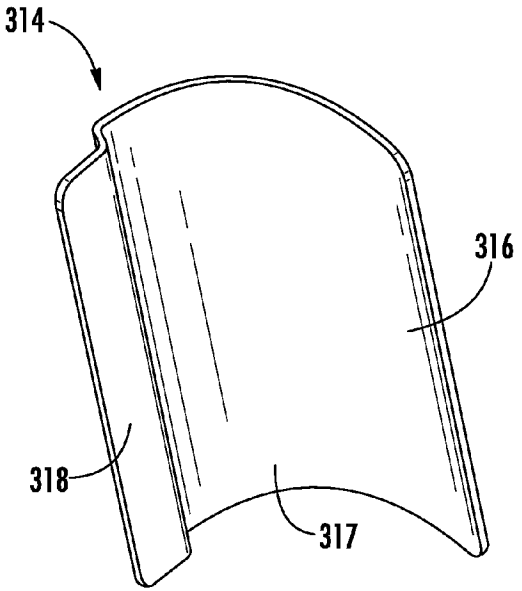
FIG. 3F is a perspective view of an upper panel retainer of the waste receptacle of FIG. 3A.
Figure 3I:
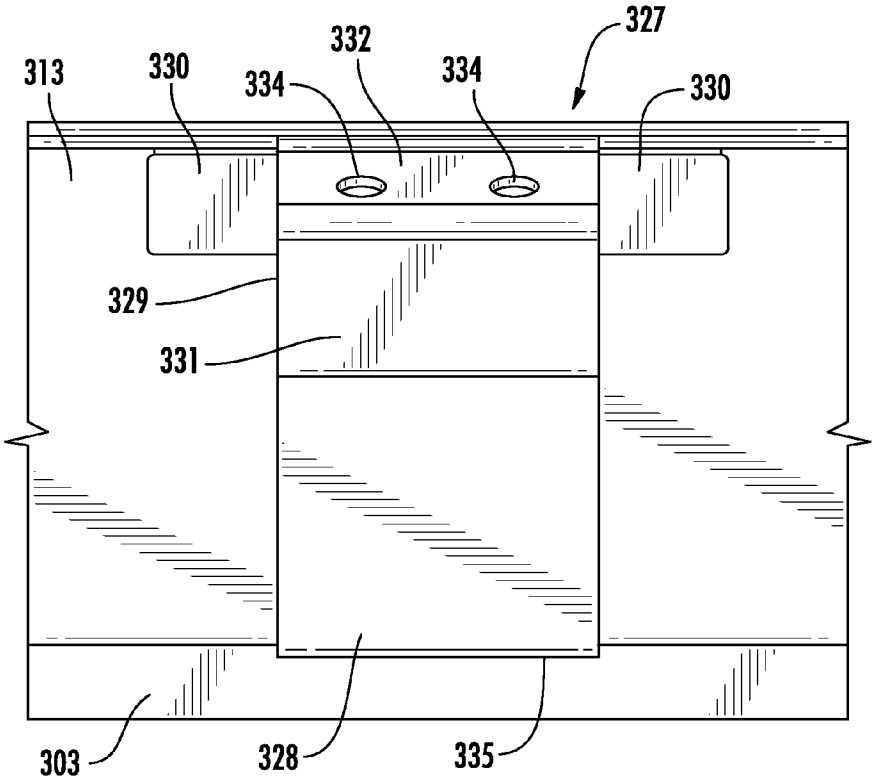
FIG. 3I is detailed perspective view of the frame hinge bracket of the waste receptacle of FIG. 3A.
Figure 3H:
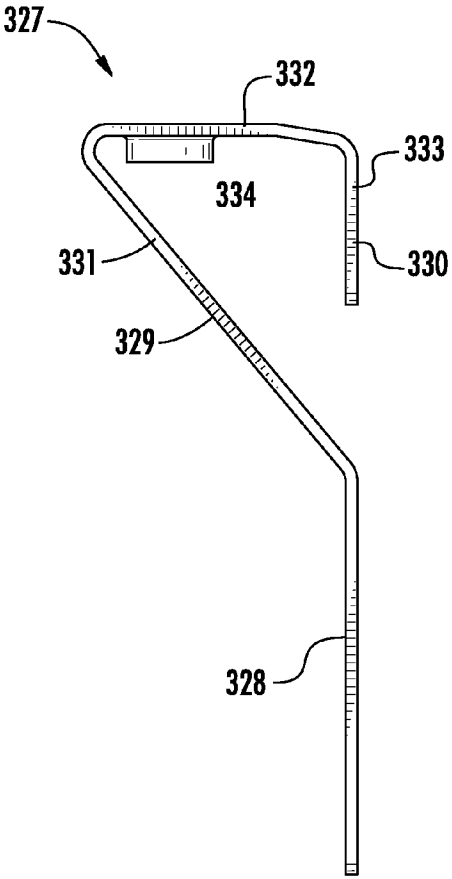
FIG. 3H is a side view of a frame hinge bracket of the waste receptacle of FIG. 3A.
Figure 3J:
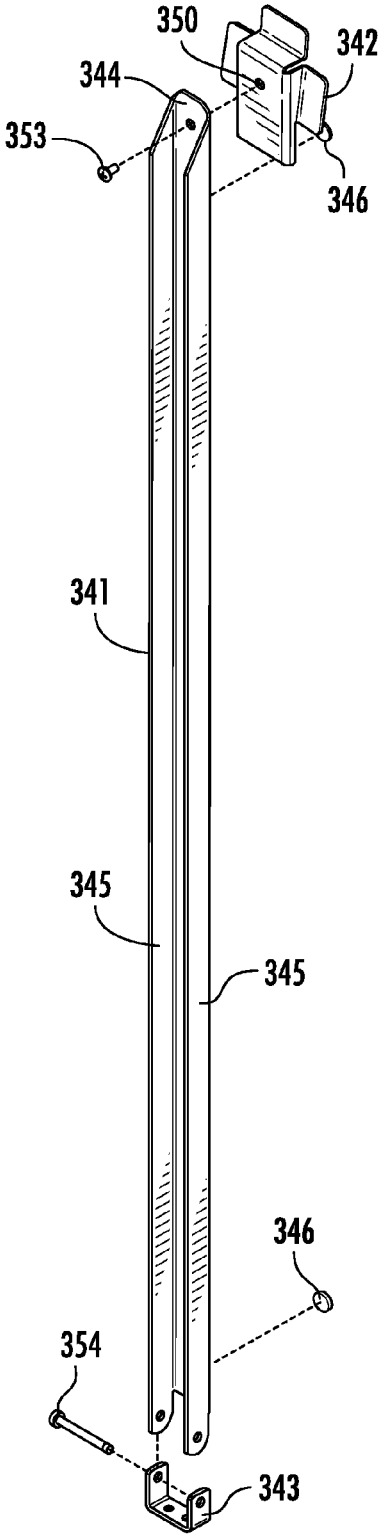
FIG. 3J is an exploded perspective view of a support arm, an upper support bracket, and a lower support bracket of the waste receptacle of FIG. 3A.
Figure 3K:
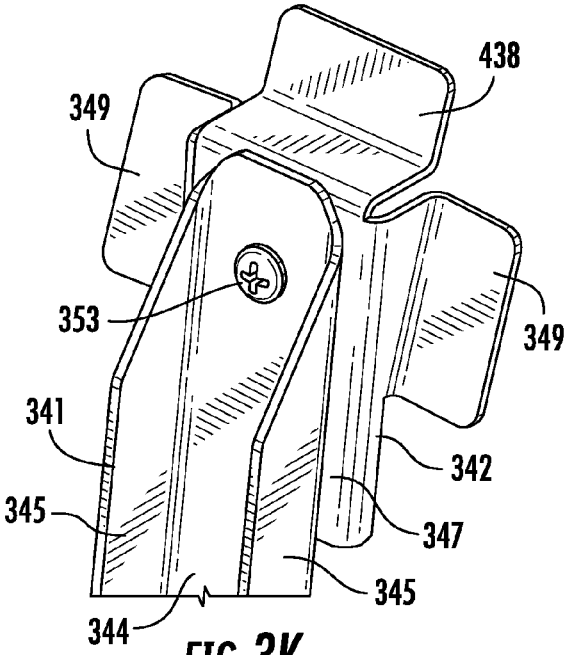
FIG. 3K is a detailed perspective view of the support arm and the upper support bracket of the waste receptacle of FIG. 3A.
Figure 3L:
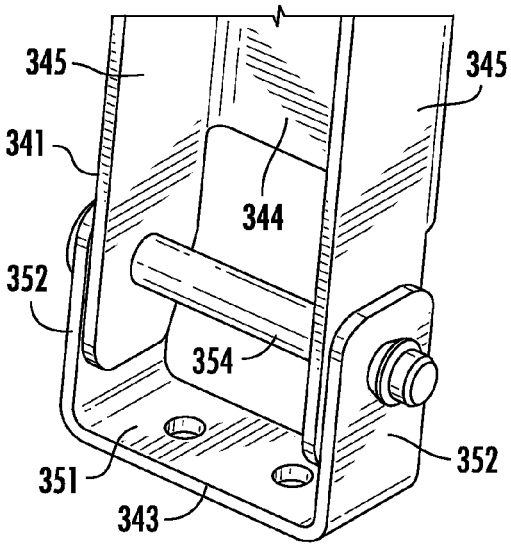
FIG. 3L is a detailed perspective view of the support arm and the lower support bracket of the waste receptacle of FIG. 3A.
Figure 3N:
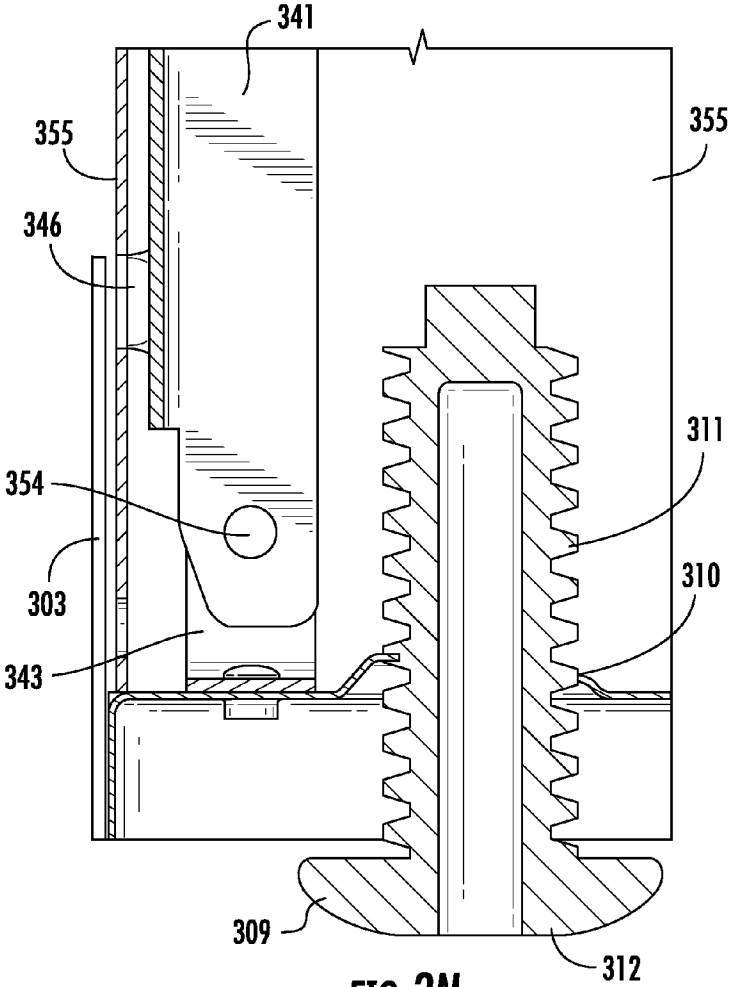
FIG. 3N is a detailed cross-sectional side view of a portion of the waste receptacle of FIG. 3A.
Figure 3M:
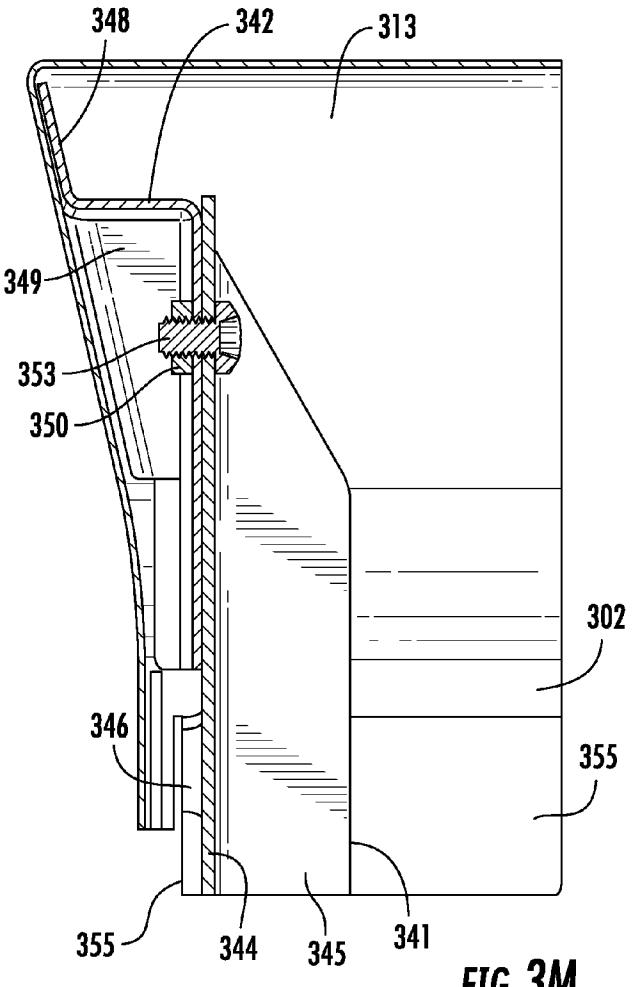
FIG. 3M is a detailed cross-sectional side view of a portion of the waste receptacle of FIG. 3A.
Figure 3P:
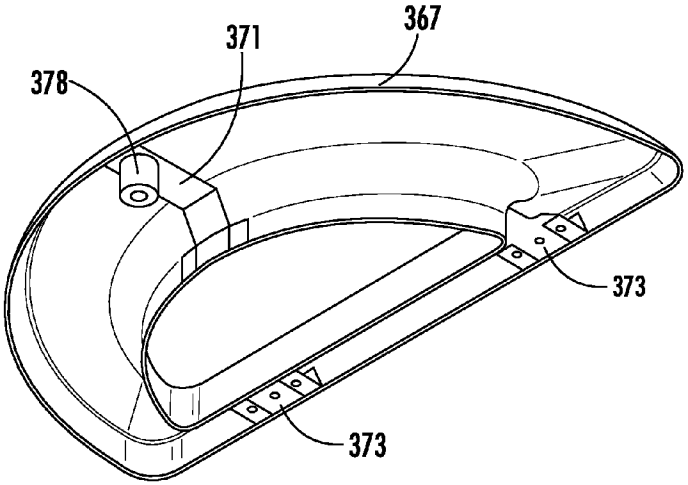
FIG. 3P is a perspective view of a portion of the waste receptacle of FIG. 3A.
Figure 3O:
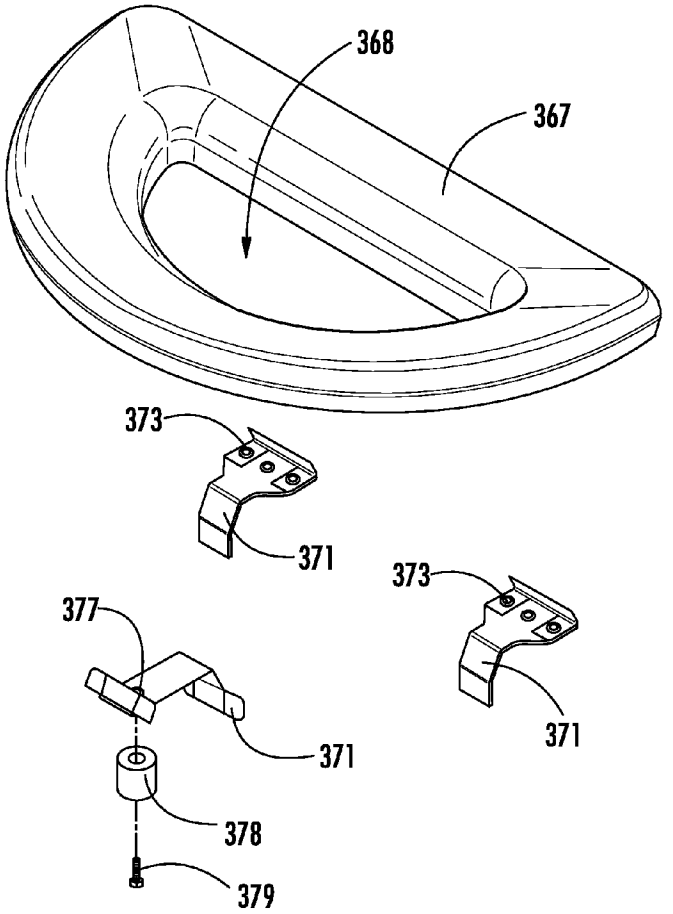
FIG. 3O is an exploded perspective view of a portion of the waste receptacle of FIG. 3A.
Figure 3R:
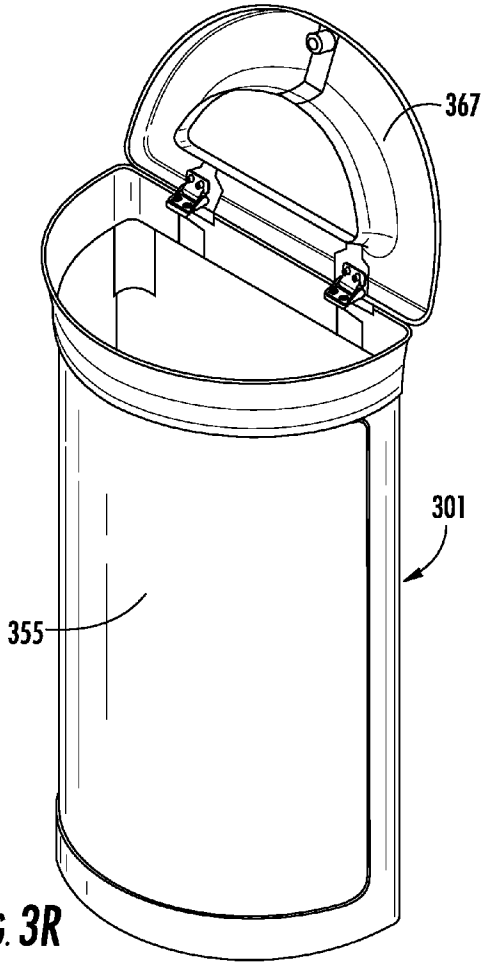
FIG. 3R is a perspective view of a portion of the waste receptacle of FIG. 3A.

FIGS. 3A-3R illustrate a waste receptacle 300 (which also may be referred to as a "refuse receptacle") as well as individual components and features of the waste receptacle 300 in accordance with one or more example embodiments of the disclosure. The waste receptacle 300 may be used in various types of facilities or environments to receive and contain waste. As described below, the waste receptacle 300 may include a frame and one or more replaceable panel inserts that are removably secured with respect to the frame by retention components and features. The panel inserts may be at least partially exposed along the outside of the waste receptacle 300 and may have a decorative appearance that suits the interior or exterior décor, the exterior landscaping, and/or the architectural construction of the facility at which the waste receptacle 300 is located. When desired, the panel inserts may be removed from the frame and replaced with new panel inserts having a different decorative appearance. In this manner, the owner of the waste receptacle 300 may achieve significant cost savings by purchasing only the new panel inserts and maintaining the remaining portions of the waste receptacle 300.

As compared to certain existing waste receptacles that include a frame and one or more replaceable panel inserts, embodiments of the waste receptacle 300 may include retention components and features that securely maintain the panel inserts in a desired position with respect to the frame and prevent the panel inserts from becoming dislodged over time, may include retention components and features that resist wear and maintain their integrity even after multiple replacements of the panel inserts, may reduce the need to keep dimensions of mating features of the panel inserts and other components of the waste receptacle 300 within tight tolerance ranges, thereby easing manufacture of the waste receptacle 300 and replacement of the panel inserts, and/or may allow the process of removing existing panel inserts and inserting new panel inserts to be completed easily and quickly with a single tool.

As shown in FIGS. 3A-3E, the waste receptacle 300 may include a frame 301 (which also may be referred to as an "outer frame") exposed along an outer surface of the waste receptacle 300 and providing a support structure for other components of the waste receptacle 300 to be mounted thereto. The frame 301 may include a bottom ring 302, a top ring 303, a back wall 304, a pair of side walls 305, and a pair of transition walls 306. The bottom ring 302 and the top ring 303 may be vertically spaced apart from one another, and the back wall 304, the side walls 305, and the transition walls 306 may extend vertically from the bottom ring 302 to the top ring 303. In certain example embodiments, as shown, the bottom ring 302 and the top ring 303 may have a D-shape (which also may be referred to as a "half-round shape") including a flat portion and a curved portion. The back wall 304 may have a flat shape that matches the flat portions of the rings 302, 303, and the side walls 305 each may have a curved shape that matches the curvature of the curved portions of the rings 302, 303. The transition walls 306 each may be positioned between the back wall 304 and one of the side walls 305 and may have a curved shape that matches the curvature of the curved portions of the rings 302, 303. In other example embodiments, the bottom ring 302, the top ring 303, the back wall 304, the side walls 305, and the transition walls 306 may have other shapes.

The side walls 305 may be spaced apart from one another along the respective circumferences of the rings 302, 303, such that a windows opening 307 is defined in the frame 301. According to the illustrated embodiment, the frame 301 may include only one window opening 307. However, it will be appreciated that the frame 301 may include any number of window openings 307 according to other example embodiments. In certain example embodiments, as shown, the bottom ring 302, the top ring 303, the back wall 304, the side walls 305, and the transition walls 306 of the frame 301 may be integrally formed with one another. For example, the frame 301 may be formed from sheet metal, such as 18 gauge steel. In particular, the sheet metal may be cut to size and to define the window opening 307, shaped, and then seam welded to form the frame 301. In other example embodiments, one or more of the bottom ring 302, the top ring 303, the back wall 304, the side walls 305, and the transition walls 306 may be separately formed and fixedly secured to one another, such as by welding, to form the frame 301.

As shown in FIGS. 3B-3E, the waste receptacle 300 may include a base 308 (which also may be referred to as a "base pan") attached to the frame 301 and positioned along the bottom of the waste receptacle 300, and a number of feet 309 attached to the base 308. The base 308 may have a shape that corresponds to the shape of the frame 301. For example, the base 308 may have a D-shape that corresponds to the D-shape of the bottom ring 302 of the frame 301, as shown, although other shapes of the base 308 may be used in other example embodiments. The base 308 may include a number of mounting holes 310 defined therein and configured to receive respective portions of the feet 309 therethrough. The mounting holes 310 may be spaced apart from one another and arranged in an array, as shown, although other arrangements of the mounting holes 310 may be used. As shown, the mounting holes 310 may include female threads configured to threadably engage the respective feet 309. In certain example embodiments, the base 308 may be formed from sheet metal, such as 18 gauge steel. In particular, the sheet metal may be cut to size and to define the threaded mounting holes 310, bent to form a number of angled tabs along a perimeter of the base 308, and then spot welded to the bottom ring 302 of the frame 301 such that the base 308 is fixedly secured to the frame 301.

The feet 309 each may include a shaft 311 and a head 312 positioned at a bottom end of the shaft 311. The shaft 311 may include male threads configured to engage the female threads of the mounting holes 310, such that the feet 309 may be threadably attached to the base 308. As shown in FIG. 3B, the feet 309 may be attached to the base 308 such that the heads 312 of the feet 309 are positioned below the bottom of the frame 301. In this manner, the feet 309 may support the waste receptacle 300 on a support surface, such as a floor, while the bottom of the frame 301 remains vertically spaced apart from the support surface. If the support surface is not level, the feet 309 may be adjusted by threadably advancing or retracting the feet 309 relative to the base 308 such that the bottom of the frame 301 is level and the waste receptacle 300 is oriented in a vertical manner. In certain example embodiments, the feet 309 may be formed from a plastic, such as polyoxymethylene (POM), although other materials may be used. According to the illustrated embodiment, the waste receptacle 300 may include three feet 309 and the base 308 may include three mounting holes 310. However, it will be appreciated that the waste receptacle 300 may include any number of feet 309 and the base 308 may include any number of mounting holes 310 according to other example embodiments.

As shown in FIGS. 3A-3E, the waste receptacle 300 may include a crown 313 (which also may be referred to as a "rim") attached to the frame 301 and positioned near the top of the waste receptacle 300. The crown 313 may have a shape that corresponds to the shape of the frame 301. For example, the crown 313 may have a D-shape that corresponds to the D-shape of the top ring 303 of the frame 301, as shown, although other shapes of the crown 313 may be used in other example embodiments. A top portion of the crown 313 may be flared outward, as shown, such that the crown 313 extends outward beyond the frame 301. In certain example embodiments, the crown 313 may be formed from sheet metal, such as 18 gauge steel. In particular, the sheet metal may be cut to size and hydroformed to create the flared shape of the crown 313. As shown, the crown 313 may be positioned over the top ring 303 of the frame 301 such that a bottom portion of the crown 313 overlaps at least a portion of the top ring 303, and the crown 313 may be spot welded to the top ring 303 such that the crown 313 is fixedly secured to the frame 301.

As shown in FIGS. 3C-3G, the waste receptacle 300 may include a pair of upper panel retainers 314 (which also may be referred to as "upper panel brackets") attached to the frame 301, and a pair of lower panel retainers 315 (which also may be referred to as "lower panel brackets") attached to the frame 301. As shown, the upper panel retainers 314 each may be positioned along respective inner surfaces of the back wall 304, one of the side walls 305, and one of the transition walls 306, and the top ends of the upper panel retainers 314 may be flush with the top edge of the top ring 303. Each upper panel retainer 314 may include a back portion 316, a transition portion 317, and a wing 318, as shown in FIG. 3F. The back portion 316 may have a flat shape that corresponds to the flat shape of the back wall 304 of the frame 301, and the transition portion 317 may have a curved shape that corresponds to the curved shape of the transition wall 306. The wing 318 may have a flat shape and may be inwardly offset from the transition portion 317, as shown. As shown in FIG. 3E, the back portion 316 may abut the back wall 304, the transition portion 317 may abut the transition wall 306, and the wing 318 may be spaced apart from the respective side wall 305. In this manner, the wing 318 may define a channel 319 between the upper panel retainer 314 and the respective side wall 305. The channel 319 may be configured to receive a portion of a panel insert, as described below. In certain example embodiments, the upper panel retainers 314 may be formed from sheet metal, such as 18 gauge steel. In particular, the sheet metal may be cut to size and then bent to form the back portion 316, the transition portion 317, and the wing 318 of the upper panel retainer 314. The upper panel retainers 314 may be positioned against the back wall 304 and the respective transition wall 306, as shown in FIG. 3E, and spot welded to the back wall 304 and/or the respective transition wall 306 such that the upper panel retainers 314 are fixedly secured to the frame 301.

In a similar manner, the lower panel retainers 315 each may be positioned along respective inner surfaces of the back wall 304, one of the side walls 305, and one of the transition walls 306, and the bottom ends of the lower panel retainers 315 may abut the base 308. Each lower panel retainer 315 may include a back portion 320, a transition portion 321, a wing 322, and a pair of tabs 323, as shown in FIG. 3G. The back portion 320 may have a flat shape that corresponds to the flat shape of the back wall 304 of the frame 301, and the transition portion 321 may have a curved shape that corresponds to the curved shape of the transition wall 306. The wing 322 may have a flat shape and may be inwardly offset from the transition portion 321, as shown. As shown in FIG. 3E, the back portion 320 may abut the back wall 304, the transition portion 321 may abut the transition wall 306, and the wing 322 may be spaced apart from the respective side wall 305. In this manner, the wing 322 may define a channel 324 between the lower panel retainer 315 and the respective side wall 305. The channel 324 may be configured to receive a portion of a panel insert, as described below. In certain example embodiments, the lower panel retainers 315 may be formed from sheet metal, such as 18 gauge steel. In particular, the sheet metal may be cut to size and then bent to form the back portion 320, the transition portion 321, and the wing 322 of the lower panel retainer 315. The lower panel retainers 315 may be positioned against the back wall 304 and the respective transition wall 306, as shown in FIG. 3E, and spot welded to the back wall 304 and/or the respective transition wall 306 such that the lower panel retainers 315 are fixedly secured to the frame 301.

In certain example embodiments, the waste receptacle 300 may include a single panel retainer for each side of the receptacle 300. In other words, for each side of the waste receptacle, the respective upper panel retainer 314 and the respective lower panel retainer 315 may be integrally formed with one another, such that the upper panel retainer 314 and the lower panel retainer 315 are portions of a single panel retainer, as indicated by dashed lines in FIG. 3E. In this manner, the single panel retainer may extend from the base 308 to the top edge of the top ring 303 and may define a single continuous channel including the channel 319 and the channel 324 described above. Providing the upper panel retainer 314 and the lower panel retainer 315 as portions of the single panel retainer may ease assembly of the waste receptacle 300 and may ensure that the panel insert is securely received within the continuous channel along the height of the frame 301. The single panel retainer may be formed from sheet metal, such as 18 gauge steel, in the same manner described above.

As shown in FIGS. 3C-3E, 3H, and 3I, the waste receptacle 300 may include a pair of frame hinge brackets 327 (which also may be referred to simply as a "hinge bracket") positioned along and attached to an inner surface of the crown 313. As shown in FIGS. 3H and 3I, each frame hinge bracket 327 may include a base portion 328 (which also may be referred to as a "base central portion"), a top portion 329 (which also may be referred to as a "top central portion"), and a pair of upper wings 330 extending from the top portion 329. The top portion 329 may include an inner wall 331, a top wall 332, and an outer wall 333. The upper wings 330 may be positioned along opposite lateral sides of the outer wall 333 of the top portion 329, as shown. In certain example embodiments, the frame hinge brackets 327 may be formed from sheet metal, such as 18 gauge steel. In particular, the sheet metal may be cut to size and to define the apertures therein, and then bent to form the base portion 328, the top portion 329, and the upper wings 330 of the frame hinge bracket 327. The frame hinge bracket 327 may have a number of nuts 334 attached thereto. In particular, a first pair of nuts 334 may be respectively positioned and attached within apertures defined in the top wall 332 of the top portion 329. In certain example embodiments, the nuts 334 may be PEM® nuts, although other types of nuts suitable for attachment to sheet metal may be used in other example embodiments.

The frame hinge brackets 327 may be attached to the crown 313 as shown in FIGS. 3E and 3I. In particular, each frame hinge bracket 317 may be positioned such that a portion of the base portion 328 is received within one of a number of alignment notches 335 defined in the top edge of the top ring 303 of the frame 301, and the outer wall 333 of the top portion 329 and the upper wings 330 abut the inner surface of the crown 313, as shown. The frame hinge bracket 327 may be spot welded to the crown 313. In particular, the outer wall 333 of the top portion 329 and/or the upper wings 330 may be spot welded to the inner surface of the crown 313. In this manner, the frame hinge bracket 327 and the crown 313 may be fixedly secured to one another.

As shown in FIGS. 3C and 3J-3N, the waste receptacle 300 may include a support arm 341 (which also may be referred to as a "retention arm"), an upper support bracket 342, and a lower support bracket 343 positioned within the frame 301. The support arm 341 may have an elongated shape extending vertically from the lower support bracket 343 to the upper support bracket 342. As shown, the support arm 341 may include an outer wall 344 and a pair of side walls 345 extending perpendicular to and inward from the outer wall 344. In certain example embodiments, the support arm 341 may be formed from sheet metal, such as 16 gauge steel. In particular, the sheet metal may be cut to size and to define the apertures therein, and then bent to form the outer wall 344 and the side walls 345 of the support arm 341. As shown, the support arm 341 may have a number of bumpers 346 attached thereto. In particular, a first bumper 346 may be attached to the outer surface of the outer wall 344 near the top end of the support arm 341, and a second bumper 346 may be attached to the outer surface of the outer wall 344 near the bottom end of the support arm 341. In certain example embodiments, the bumpers 346 may be attached to the support arm 341 by an adhesive, although other means of attachment, such as fasteners, may be used in other example embodiments. In certain example embodiments, the bumpers 346 may be formed of rubber, although other suitable materials may be used in other example embodiments.

As shown in FIGS. 3J and 3K, the upper support bracket 342 may include a base portion 347 (which also may be referred to as a "central portion"), an upper wing 348 extending outward and upward from the base portion 347, and a pair of lower wings 349 extending outward and laterally from the base portion 347. The lower wings 349 may be positioned along opposite lateral sides of the base portion 347, as shown. In certain example embodiments, the upper support bracket 342 may be formed from sheet metal, such as 18 gauge steel. In particular, the sheet metal may be cut to size and to define the apertures therein, and then bent to form the base portion 347, the upper wing 348, and the lower wings 349 of the upper support bracket 342. The upper support bracket 342 may have a number of nuts 350 attached thereto. In particular, a first nut 350 may be positioned and attached within an aperture defined in the base portion 347, as shown. In certain example embodiments, the nuts 350 may be PEM® nuts, although other types of nuts suitable for attachment to sheet metal may be used in other example embodiments. The upper support bracket 342 may be attached to an inner surface of the crown 313, as shown in FIG. 3M. In particular, the upper support bracket 342 may be positioned such that the outer surfaces of the upper wing 348 and the lower wings 349 abut the inner surface of the crown 313, and the wings 348, 349 may be spot welded to the inner surface of the crown 313, such that the upper support bracket 342 is fixedly secured to the crown 313.

As shown in FIGS. 3J and 3L, the lower support bracket 343 may include a base portion 351 (which also may be referred to as a "central portion"), and a pair of side walls 352 extending upward from the base portion 351. The side walls 352 may be positioned along opposite lateral sides of the base portion 351, as shown. In certain example embodiments, the lower support bracket 343 may be formed from sheet metal, such as 16 gauge steel. In particular, the sheet metal may be cut to size and to define the apertures therein, and then bent to form the base portion 351 and the side walls 352 of the lower support bracket 343. The lower support bracket 343 may be attached to an inner surface of the base 308, as shown in FIG. 3N. In particular, the lower support bracket 343 may be positioned such that the base portion 351 rests on the inner surface of the base 308 and is riveted thereto, such that the lower support bracket 343 is fixedly secured to the base 308.

As shown, in FIGS. 3J-3N, the support arm 341 may be removably secured to the upper support bracket 342 and the lower support bracket 343. In particular, the support arm 341 may be removably secured to the upper support bracket 342 by a fastener 353 extending through an aperture in the outer wall 344 of the support arm 341 and threadably engaging the nut 350 of the upper support bracket 342. In certain example embodiments, as shown, the fastener 353 may be a screw, although other types of fasteners may be used in other example embodiments. The support arm 341 may be removably secured to the lower support bracket 343 by a fastener 354 extending through apertures in the side walls 345 of the support arm 341 and apertures in the side walls 352 of the lower support bracket 343. In certain example embodiments, as shown, the fastener 354 may include a clevis pin and a clip, although other types of fasteners may be used in other example embodiments. In certain example embodiments, the lower support bracket 343 may be omitted, and the lower end of the support arm 341 may be received within a receptacle defined in the base 308. In such embodiments, the support arm 341 may be removably secured to the base 308 by the fastener 354 in a manner similar to that described above, such that the support arm 341 is pivotally attached to the base 308.

As shown in FIGS. 3A-3C, 3M, and 3N, the waste receptacle 300 may include a panel insert 355 (which also may be referred to simply as a "panel") removably secured with respect to the frame 301. According to the illustrated embodiment, the waste receptacle 100 may include only one panel insert 355. However, it will be appreciated that the waste receptacle 300 may include any number of panel inserts 355 according to other example embodiments. FIGS. 3A-3C illustrate an example panel insert 355 and a number of panel brackets 356 in accordance with one or more embodiments of the disclosure, which may be used as a part of the waste receptacle 300. As shown, the panel insert 355 may be formed as a substantially rectangular sheet having a curved or arcuate shape that corresponds to the curvature of the frame 301. The panel insert 355 may include a pair of alignment notches 357 defined in the top edge of the panel insert 355. As shown, one of the alignment notches 357 may be positioned near but spaced apart from one of the top corners of the panel insert 355, and the other alignment notch 357 may be positioned near but spaced apart from the other top corner of the pane insert 355. In certain example embodiments, the panel insert 355 may be formed from sheet metal, such as 18 gauge steel. In particular, the sheet metal may be cut to size and to define the alignment notches 357 therein, and then roll formed to form the panel insert 355 having the curved or arcuate shape. The panel insert 355 may have a decorative appearance, which may include one or more coatings, finishes, color treatments, textures, hole patterns, or other decorative features. In certain example embodiments, the panel insert 355 may be formed from a plastic or a plastic blend.

The panel brackets 356 (which also may be referred to as "lift brackets") may be attached to the panel insert 355 along the inner surface and the top edge of the panel insert 355 and may be used to facilitate insertion and removal of the panel insert 355. As shown, each panel bracket 356 may include a lift tab 359, an alignment tab 360, and a pair of mounting tabs 361. The lift tab 359 may extend inward from the panel insert 355 and may be configured to be grasped by a user to facilitate insertion and removal of the panel insert 355. The alignment tab 360 may extend in an opposite direction from the lift tab 259 and may be positioned within one of the alignment notches 357 of the panel insert 355 to facilitate alignment of the panel bracket 356 with respect to the panel insert 355. The mounting tabs 361 may extend transverse to and downward from the lift tab 359 and may abut the inner surface of the panel insert 355. The mounting tabs 361 may be spot welded to the inner surface of the panel insert 355 such that the panel bracket 356 is fixedly secured to the panel insert 355. In certain example embodiments, the panel brackets 356 may be formed from sheet metal, such as 18 gauge steel. In particular, the sheet metal may be cut to size and then bent to form the lift tab 359, the alignment tab 360, and the mounting tabs 361 of the panel bracket 356. According to the illustrated embodiment, two panel brackets 356 may be attached to the panel insert 355. However, it will be appreciated that any number of panel brackets 356 may be attached to the panel insert 355 according to other example embodiments.

FIGS. 3M, 3N, and 3R illustrate how the panel insert 355 may be removably secured with respect to the frame 301 of the waste receptacle 300. As shown, the panel insert 355 may be removably received within the channels 319 defined between the upper panel retainers 314 and the respective side walls 305 of the frame 301 and within the channels 324 defined between the lower panel retainers 315 and the respective side walls 305 of the frame 301. In particular, one of the lateral edges of the panel insert 355 may be received within one of the channels 319 and one of the channels 324, and the other lateral edge of the panel insert 355 may be received within the other channel 319 and the other channel 324, as shown. As described above, the panel brackets 356 may be used to facilitate positioning of the panel insert 355 for insertion of the panel insert 355 into the channels 319, 324 or removal of the panel insert 355 from the channels 319, 324. As shown, when the panel insert 355 is received within the channels 319, 324, the panel insert 355 may be partially exposed through the window opening 307 defined in the frame 301.

As shown in FIGS. 3M and 3N, the support arm 341, the upper support bracket 342, and the fastener 353 may be configured to control vertical movement of the panel insert 355 with respect to the frame 301. In particular, the fastener 353 may be configured to move between an engaged position preventing removal (i.e., upward vertical movement) of the panel insert 355 from the respective channels 319, 324 and a disengaged position allowing removal of the panel insert 355 from the respective channels 319, 324. When the fastener 353 is in the engaged position, the fastener 353 may extend through the nut 350, thereby preventing the panel insert 355 from being removed from the respective channels 319, 324 and the frame 301. Additionally, when the fastener 353 is in the engaged position, the bumpers 346 of the support arm 341 may abut the inner surface of the panel insert 355, thereby preventing inward movement of the panel insert 355 with respect to the frame 301. When the fastener 353 is in the disengaged position, the fastener 353 may be removed from the nut 350 and the support arm 341 may be pivoted away from the upper support bracket 342, thereby allowing the panel insert 355 to be removed from the respective channels 319, 324 and the frame 301.

As shown in FIGS. 3A-3C and 3O-3R, the waste receptacle 300 may include a lid 367 (which also may be referred to as a "cover") movably secured with respect to the frame 301. In particular, the lid 367 may be configured to pivot with respect to the frame 301 between a closed position, as shown in FIG. 3B, and an open position, as shown in FIG. 3R. The lid 367 may have a shape that corresponds to the shape of the crown 313 and the frame 301. For example, the lid 367 may have a D-shape that corresponds to the D-shape of the crown 313 and the top ring 303 of the frame 301, as shown, although other shapes may be used in other example embodiments. As shown, the lid 367 may include a central opening 368 defined therein and configured to allow waste to be passed therethrough and into the waste receptacle 300. As shown, the lid 367 may be flared inward toward the central opening 368 to guide waste toward the central opening 368. In certain example embodiments, the lid 367 may be formed from sheet metal, such as 18 gauge steel. In particular, the sheet metal may be cut to size and to form the central opening 368, and then hydroformed to create the flared shape and contour of the lid 367.

As shown in FIGS. 3O-3R, the waste receptacle 300 may include a number of brackets attached to the lid 367 and positioned along inner surfaces of the lid 367. In particular, the waste receptacle 300 may include a pair of lid hinge brackets 371 (which also may be referred to simply as a "hinge brackets") attached to inner surfaces of the lid 367, and a lid landing bracket 372 (which also may be referred to simply as "landing brackets") attached to inner surfaces of the lid 367. The lid hinge brackets 371 and the lid landing bracket 372 may be arranged as shown in FIG. 3P and spot welded to the inner surfaces of the lid 367. In certain example embodiments, the lid hinge brackets 371 and the lid landing bracket 372 may be formed from sheet metal, such as 18 gauge steel. In particular, the sheet metal may be cut to size and to define the apertures therein, and then bent to form the lid hinge brackets 371 and the lid landing bracket 372.

Figure 3Q:
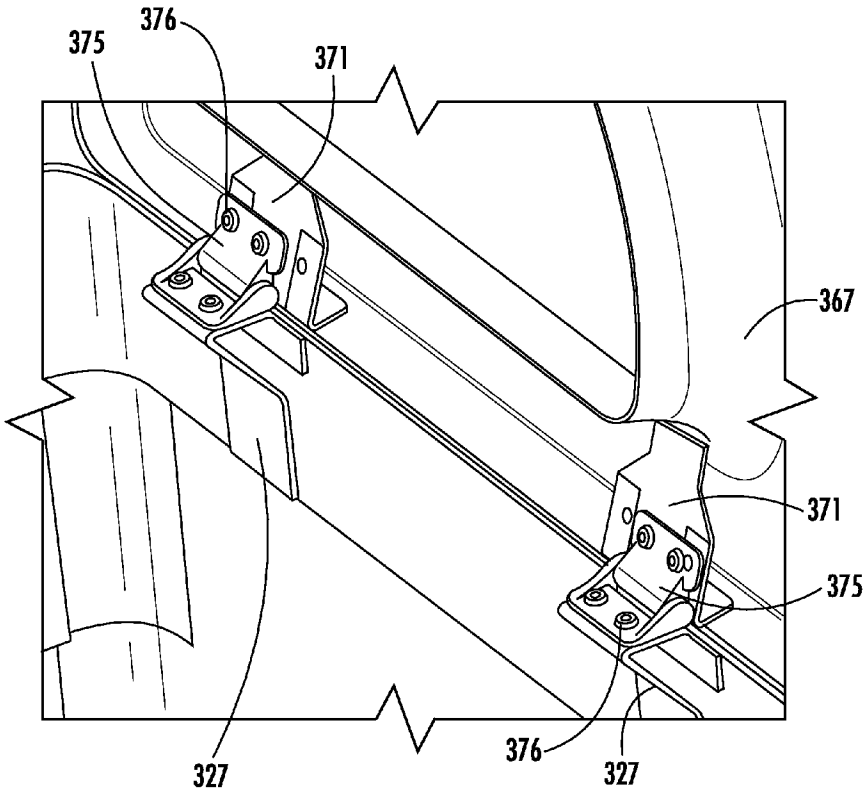
FIG. 3Q is a detailed perspective view of a portion of the waste receptacle of FIG. 3A.

The lid hinge brackets 371 each may have a number of nuts 373 attached thereto. In particular, three nuts 373 may be respectively positioned and attached within apertures defined in the lid hinge bracket 371 near an outer end of the lid hinge bracket 371. In certain example embodiments, the nuts 373 may be PEM® nuts, although other types of nuts suitable for attachment to sheet metal may be used in other example embodiments. As shown in FIGS. 3Q and 3R, the lid 367 may be pivotally secured with respect to the frame 301 by a pair of hinges 375. In particular, the hinges 375 may be attached, respectively, to the lid hinge brackets 371 and the frame hinge brackets 327 by a number of fasteners 376 threadably engaging the respective nuts 334, 373, such that the lid 367 is pivotally secured with respect to the frame 301.

The lid landing bracket 372 also may have a number of nuts 377 attached thereto. In particular, a first nut 377 may be positioned and attached within an aperture defined in the lid landing bracket 372 near an outer end of the lid landing bracket 372. In certain example embodiments, the nuts 377 may be PEM® nuts, although other types of nuts suitable for attachment to sheet metal may be used in other example embodiments. The lid landing bracket 372 also may have a bumper 378 attached thereto along a bottom surface of the lid landing bracket 372. In particular, the bumper 378 may be attached to the lid landing bracket 372 by a fastener 379 extending through the bumper 378 and threadably engaging the first nut 377. When the lid 367 is in the closed position, the bumper 378 may rest on the upper support bracket 342 such that the lid 367 is vertically spaced apart from the crown 313, as shown in FIG. 3B. In certain example embodiments, the bumper 378 may be formed of rubber, although other suitable materials may be used in other example embodiments.

As shown in FIG. 3C, the waste receptacle 300 may include a liner 380 removably positioned within the frame 301. The liner 380 may be shaped and contoured to correspond to the shape of the frame 301. In certain example embodiments, the liner 380 may be formed of a plastic, such as polyethylene, although other suitable materials may be used in other example embodiments. As shown, the liner 380 may include a cinch opening 381 defined therein along the top edge of the liner 380 and configured to retain a liner bag within the liner 380.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

That which is claimed is:

1. A waste receptacle comprising:

a frame comprising a plurality of vertical arms spaced apart from one another and a plurality of window openings, each window opening defined between an adjacent pair of the vertical arms;

a plurality of vertical arm supports spaced apart from one another, each vertical arm support fixedly secured to one of the vertical arms and defining a pair of channels between the vertical arm support and the one of the vertical arms;

a plurality of frame landing brackets, each frame landing bracket attached to a vertical arm support;

a plurality of panel inserts removably secured with respect to the frame, each panel insert removably received within two of the channels and partially exposed through one of the window openings;

a plurality of fasteners each configured to move between an engaged position preventing removal of one of the panel inserts from the respective channels and a disengaged position allowing removal of the one of the panel inserts from the respective channels; and a lid pivotably attached to the frame and configured to pivot between a closed position and an open position, wherein in the closed position a set of bumpers attached to the lid rest on the plurality of frame landing brackets.

2. The waste receptacle of claim 1, wherein the frame and the plurality of vertical arms are formed of sheet metal, and wherein the panel inserts are formed of sheet metal, a plastic, or a plastic blend.

3. The waste receptacle of claim 1, wherein the frame further comprises a bottom ring and a top ring vertically spaced apart from the bottom ring, and wherein the vertical arms extend from the bottom ring to the top ring.

4. The waste receptacle of claim 1, wherein the frame has a round shape, and wherein the panel inserts each have a curved shape corresponding to the shape of the frame.

5. The waste receptacle claim 1, wherein the frame has a pill shape with two flat sides and two curved sides, wherein one or more of the panel inserts has a curved shape, and wherein one or more of the panel inserts has a flat shape.

6. The waste receptacle of claim 1, wherein each vertical arm support comprises a base portion and a pair of wings extending from the base portion, wherein the base portion is fixedly secured to the one of the vertical arms, and wherein the wings are spaced apart from the one of the vertical arms to define the channels between the vertical arm support and the one of the vertical arms.

7. The waste receptacle of claim 1, wherein the fasteners comprise screws.

8. The waste receptacle of claim 1, further comprising a frame hinge bracket, wherein the fasteners engage the frame hinge bracket.

9. A waste receptacle comprising:

a frame comprising a back wall, a pair of side walls, and a window opening defined between the side walls;

a frame landing bracket attached to the frame;

a plurality of panel retainers spaced apart from one another, each panel retainer fixedly secured to the back wall and defining a channel between the panel retainer and the frame;

a panel insert removably secured with respect to the frame, the panel insert removably received within two of the channels and partially exposed through the window opening;

a fastener configured to move between an engaged position preventing removal of the panel insert from the channels and a disengaged position allowing removal of the panel insert from the channels; and a lid pivotably attached to the frame and configured to pivot between a closed position and an open position, wherein in the closed position a bumper attached to the lid rests on the frame landing bracket.

10. The waste receptacle of claim 9, wherein the frame and the panel retainers are formed of sheet metal, and wherein the insert is formed of sheet metal, a plastic, or a plastic blend.

11. The waste receptacle of claim 9, wherein the frame further comprises a bottom ring and a top ring vertically spaced apart from the bottom ring, and wherein the back wall and the side walls extend from the bottom ring to the top ring.

12. The waste receptacle of claim 9, wherein the frame has a D-shape, and wherein the panel insert has a curved shape corresponding to the shape of the frame.

13. The waste receptacle of claim 9, wherein each panel retainer comprises a back portion and a wing, wherein the back portion is fixedly secured to the back wall, and wherein the wing is spaced apart from one of the side walls to define the channel between the panel retainer and the one of the side walls.

14. The waste receptacle of claim 9, wherein the fastener comprises a screw, and wherein the screw engages a nut when the fastener is in the engaged position.

15. The waste receptacle of claim 9, further comprising a support arm positioned within the frame, and wherein the fastener is supported by the support arm.

16. A waste receptacle comprising:

a frame;

a frame landing bracket attached to the frame;

a lid pivotably attached to the frame and configured to pivot between a closed position and an open position, the lid comprising a bumper configured to rest on the frame landing bracket when the lid is in the closed position;

a hood positioned above the lid and configured to move with the lid between the closed position and the open position; and an ashtray body positioned at least partially above the hood and configured to move with the lid between the closed position and the open position, the ashtray body comprising a plurality of openings defined therein and in communication with an interior space of the ashtray body, the plurality of openings contained within a circumferential sub-sector of the ashtray body that is less than half of a circumference of the ashtray body.

17. The waste receptacle of claim 16, wherein the lid is pivotably attached to the frame by a hinge positioned along a first side of the waste receptacle, and wherein the circumferential sub-sector of the ashtray body is positioned along a second side of the waste receptacle opposite the first side.

18. The waste receptacle of claim 16, further comprising:

a plurality of ashtray support brackets attached to the hood; and a plurality of rivets, each rivet fixedly secured to one of the ashtray support brackets;

wherein the ashtray body is removably attached to the hood by the ashtray support brackets and the rivets.

19. The waste receptacle of claim 18, wherein the ashtray body further comprises a plurality of slots defined therein, each slot configured to removably receive one of the rivets therein.

20. The waste receptacle of claim 19, wherein each slot extends from an upper end of the ashtray body, and wherein each slot has a J-shape.

* * * * *